US006271710B1

(12) United States Patent
Ooishi

(10) Patent No.: US 6,271,710 B1
(45) **Date of Patent: *Aug. 7, 2001**

(54) TEMPERATURE DEPENDENT CIRCUIT, AND CURRENT GENERATING CIRCUIT, INVERTER AND OSCILLATION CIRCUIT USING THE SAME

(75) Inventor: Tsukasa Ooishi, Hyogo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/659,979

(22) Filed: Jun. 7, 1996

(30) Foreign Application Priority Data

| | | |
|---|---|---|
| Jun. 12, 1995 | (JP) | 7-143772 |
| Nov. 24, 1995 | (JP) | 7-305675 |
| May 16, 1996 | (JP) | 8-121606 |

(51) Int. Cl.[7] ..... G05F 3/26

(52) U.S. Cl. ..... 327/512; 327/538; 327/543; 323/315

(58) Field of Search ..... 327/512, 513, 327/538, 540, 541, 543; 330/288, 289; 323/313, 316, 315

(56) References Cited

U.S. PATENT DOCUMENTS

| | | | | |
|---|---|---|---|---|
| 4,464,631 | * | 8/1984 | Prentice | 330/253 |
| 4,673,867 | * | 6/1987 | Davis | 323/315 |
| 4,769,589 | * | 9/1988 | Rosenthal | 323/315 |
| 5,081,380 | * | 1/1992 | Chen | 327/262 |
| 5,144,223 | * | 9/1992 | Gillingham | 323/313 |
| 5,221,888 | * | 6/1993 | Moody | 323/315 |
| 5,399,960 | * | 3/1995 | Gross | 323/313 |
| 5,614,816 | * | 3/1997 | Nahas | 323/316 |

FOREIGN PATENT DOCUMENTS

| | | | |
|---|---|---|---|
| 55-97096 | | 7/1980 | (JP) . |
| 58-105482 | | 6/1983 | (JP) . |
| 59-191194 | | 10/1984 | (JP) . |
| 60-117805 | * | 6/1985 | (JP) 330/288 |
| 63-152094 | | 6/1988 | (JP) . |
| 3-44205 | * | 2/1991 | (JP) 330/288 |

OTHER PUBLICATIONS

"CMOS Analog Integrated Circuits Based on Weak Inversion Operation" by Eric Vittoz et al., IEEE Journal of Solid–State Circuits, vol. SC–12, No. 3, Jun. 1971, 224–231.

"Battery Operated 16M DRAM with Post Package Programmable and Variable Self Refresh" by Do–Chan Choi et al., 1994 Symposium on VLSI Circuits Digest of Technical Papers, pp. 83–84.

"Low Power Self Refresh Mode DRAM with Temperature Detecting Circuit" by Yoshihiro Kagenishi et al., 1993 Symposium on VLSI Circuits, pp.43–44.

"Electronic Circuits" by Schilling et al., pp. 145–150, 1989.*

* cited by examiner

*Primary Examiner*—Tuan T. Lam
(74) *Attorney, Agent, or Firm*—McDermott, Will & Emery

(57) ABSTRACT

Constant current is generated by a constant current generating circuit. This constant current is divided by a current dividing circuit, and current having temperature dependency is generated by a temperature dependent circuit based on the constant current. This current and the divided current are added in an adding circuit, and driving current is supplied to a ring oscillator. In the ring oscillator, one gate input of each of the odd number of stages of inverters is connected to an output of an inverter in the previous stage, and the other gate input thereof is connected to an output of an inverter in the second previous stage.

11 Claims, 43 Drawing Sheets

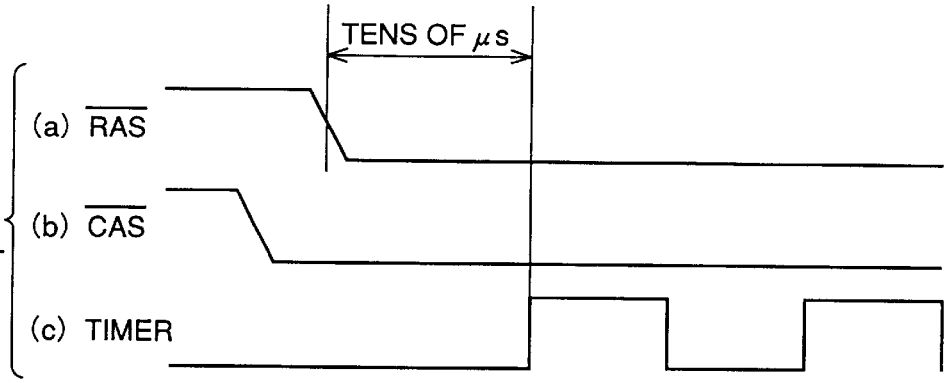
FIG.57 PRIOR ART
FIG.58 PRIOR ART
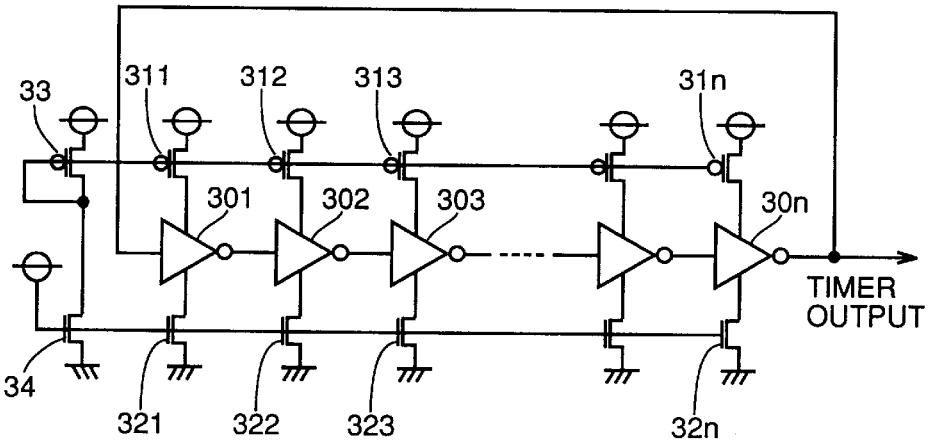

TEMPERATURE DEPENDENT CIRCUIT, AND CURRENT GENERATING CIRCUIT, INVERTER AND OSCILLATION CIRCUIT USING THE SAME

BACKGROUND OF THE INVENTION

1. Field of the Invention

The present invention relates to a circuit in which current flowing therein varies depending on a temperature (hereinafter referred to as a temperature dependent circuit), and a current generating circuit, an inverter and an oscillation circuit using the same. More specifically, the present invention relates to a temperature dependent circuit, a current generating circuit, an inverter and an oscillation circuit which are used for a DRAM (Dynamic Random Access Memory) having a self-refresh function.

2. Description of the Background Art

A DRAM is a memory in which memory cells using memory cell transistors and memory cell capacitance are arranged in an array form. Since a memory cell is a volatile element, data retained therein must be refreshed within a fixed period. In recent years, however, there has been developed a DRAM with an additional function to refresh data therein automatically by itself when set to a special mode.

This function has made it possible for users to use a RAM without taking care of refreshing data therein. At he same time, this function allows the maximum performance of the DRAM and reduction in power consumption. In other words, data is refreshed by the DRAM itself at longer intervals than prescribed, whereby the number of times to refresh data can be reduced, resulting in reduction in the number of times of DRAM operations.

FIG. 56 is a schematic block diagram showing a DRAM having such a refresh function. In FIG. 56, a row address strobe signal $\overline{RAS}$, a column address strobe signal $\overline{CAS}$ and a write enable signal $\overline{WE}$ are applied to a signal input portion 1, from which an internal RAS signal is applied to one input terminal of multiplexer 4. A self refresh detection circuit 2 detects a self refresh mode. More specifically, self refresh detection circuit 2 detects, as a refresh mode, a timing when tens of $\mu$sec have passed after a column address strobe signal $\overline{CAS}$ falled prior to a row address strobe signal $\overline{RAS}$ which is called a $\overline{CAS}$ before $\overline{RAS}$ (CBR) which cannot be generated at the time of a normal access. This detection signal is applied to a timer 3 as well as to multiplexers 4 and 7 as a switching signal. Timer 3 starts oscillating in response to the self refresh detection signal. An output of this timer 3 is applied to the other input terminal of multiplexer 4 and an address counter 5. Address counter 5 counts a timer output and outputs an internal address signal to one input terminal of multiplexer 7. An external address signal is input from an address buffer 6 to the other input terminal of multiplexer 7. Multiplexer 7 selects the internal address signal or the external address signal and applies an X address signal and a Y address signal to a row decoder 9 and a column decoder 10, respectively. Row decoder 9 decodes the X address signal to designate an X address of a memory cell array 8, and column decoder 10 decodes the Y address signal to designate a Y address of memory cell 8. External data which has been input to an I/O portion 12 is written into a memory cell at the designated address of the memory cell array, or data is read from the memory cell at the designated address in memory cell array 8 and then amplified in a sense amplifier 11 to be output to I/O portion 12.

FIG. 57 is a timing chart illustrating a self refresh operation of the DRAM of FIG. 56. In normal read and write operations of the DRAM of FIG. 56, multiplexer 4 selects an output of signal input portion 1, and multiplexer 7 selects an external address signal of an output of address buffer 6. In addition, an address of memory cell array 8 is designated by the external address signal.

On the other hand, in a self refresh mode, a column address strobe signal $\overline{CAS}$ falls before a row address strobe signal $\overline{RAS}$ falls as shown in (*a*) and (*b*) of FIG. 57 and self refresh detection circuit 2 detects lapse of tens of $\mu$sec from the fall of the row address signal $\overline{RAS}$. Timer 3 starts oscillating in response to the detection output as shown in FIG. 57(*c*). At this time, multiplexer 4 has been switched to the side of an output of timer 3 in response to the detection output of self refresh detection circuit 2, and applies an output of timer 3 to a read/write circuit (not shown) as an internal RAS. Address counter 5 counts an oscillation output of timer 3, and outputs an internal address signal. Multiplexer 7 applies the internal address signal, that is, an output of address counter 5 to row decoder 9 and column decoder 10 in response to the detection output of self refresh detection circuit 2. Row decoder 9 selects a set of word lines in response to an X address signal, and a plurality of memory cells connected thereto are refreshed automatically by sense amplifier 11.

FIG. 58 is a circuit diagram specifically showing a timer circuit of FIG. 56. In FIG. 58, timer circuit 3 is constituted by a ring oscillator. In other words, inverters 301, 302 . . . 30*n* of the odd number of stages are connected to each other in a loop shape, constituting an oscillation stage. In addition, p channel transistors 311, 312 . . . 31*n* are connected between power supply terminals of respective inverters 301, 302 . . . 30*n* and a power supply line, and n channel transistors 321, 322 . . . 32*n* are connected between ground terminals of respective inverters 301, 302 . . . 30*n* and a ground line. These transistors are provided in order to restrict current flowing into each inverter 301, 302, . . . 30*n*. An n channel transistor 34 is provided to equalize the amount of current applied by transistors 311, 312, . . . 31*n* from the side of power supply potential of inverters 301, 302 . . . 30*n* with the amount of current applied by transistors 321, 322 . . . 32*n* from the side of ground potential of inverters 301, 302, . . . 30*n*. This n channel transistor 34 has its gate connected to a power supply line of a fixed potential, its source grounded, and its drain connected to a diode-connected p channel transistor 33. The gate of n channel transistor 34 is connected to the gates of n channel transistors 321, 322 . . . 32*n*, and p channel transistor 33 copies current flowing into n channel transistor 34 to supply the current to the gates of p channel transistors 311, 312, . . . 31*n*.

An output of the ring oscillator arranged as described above has its oscillation frequency determined by current which is determined by n channel transistor 34 having a gate potential fixed to a power supply line of a fixed potential. Accordingly, oscillation at a fixed frequency is possible. However, the oscillation at a fixed frequency can be realized only when conditions are constant, and the oscillation frequency varies as the conditions changes.

For example, as shown in FIG. 60A, an oscillation frequency is increased as a power supply potential is varied. This is because increase in a power supply potential causes increase in a gate potential of n channel transistor 34 which is fixed to a power supply potential of a fixed potential, whereby current applied by this n channel transistor 34 is increased, resulting in increase in current flowing into inverters 301, 302 . . . 30*n*. Furthermore, as shown in FIG. 60B, an oscillation frequency is reduced as a temperature is increased. This is because increase in a temperature causes reduction in a current driving ability of n channel transistor 34, whereby current applied by this n channel transistor 34 is reduced, resulting in reduction in current flowing into inverters 301, 302 . . . 30*n*. In addition, increase in a temperature causes increase in internal resistance of inverters 301, 302 . . . 30*n*, whereby current is difficult to flow therein, resulting in reduction in an oscillation frequency.

If the ring oscillator shown in FIG. 58 is used as timer 3 shown in FIG. 56, data retention characteristic of a memory cell in the DRAM might become inferior. In other words, an interval of refreshing in the DRAM is determined by the data retention characteristic of a memory cell in the DRAM. If a memory cell has superior data retention characteristic, data therein may be refreshed at longer intervals than prescribed. Therefore, the number of times to refresh data is reduced, resulting in reduction in the number of times of DRAM operations. Generally, the data retention characteristic of a memory cell becomes inferior as a temperature is increased as shown in FIG. 59. This is because data stored as charges in opposing electrodes of a cell plate 41 and a storage node 42 in a memory cell leaks from a diffusion layer portion 43 on the side of storage node 42 in the substrate direction, causing reduction in the amount of charges.

Generally, portable computers which in particular require large power consumption are hardly used at an extremely high temperature, and therefore, data may be refreshed at longer intervals. If the ring oscillator as shown in FIG. 58 is used for a timer which determines a data refresh interval, an oscillation frequency of a timer is reduced at a high temperature, and data is refreshed at longer intervals. Accordingly, if an oscillation frequency is adjusted to either a high temperature or a low temperature, data would not be refreshed at prescribed intervals in an opposite condition.

SUMMARY OF THE INVENTION

It is therefore a primary object of the present invention to provide a temperature dependent circuit for generating current which is varied depending on a temperature (hereinafter referred to as current having a temperature dependency), and a current generating circuit, an inverter and an oscillation circuit in which an oscillation frequency is increased as a temperature is increased, using the same.

In a temperature dependent circuit in accordance with one aspect of the present invention, input electrodes of one transistor and the other transistor which constitute a current mirror circuit are connected in common, current is supplied to a first electrode and the input electrode of one transistor as well as to the input electrode of the other transistor, and resistive elements having different temperature characteristics are connected between second electrodes of respective transistors and a first power supply line.

Therefore, according to the present invention, current having a temperature dependency can be produced.

In a circuit for generating current having a temperature dependency in accordance with another aspect of the present invention, constant current is used as it is or divided into 1/n (n>1) by a current dividing circuit, and current having a temperature dependency is produced from constant current by the temperature dependent circuit, and then, current from the current dividing circuit and current having a temperature dependency from the temperature dependent circuit are added by an adding circuit to be output.

In an inverter in which current flowing therein has a temperature dependency in accordance with a further aspect of the present invention, a first clock signal is applied to one gate input of the inverter circuit, a second clock signal is applied to the other gate input thereof, a first transistor of a first conductivity type is connected between a first power supply terminal of the inverter circuit and a first power supply line, a gate potential is applied to an input electrode of the first transistor, a second transistor of a second conductivity type is connected between a second power supply terminal of the inverter circuit and a second power supply line, and a gate potential is applied to an input electrode of the second transistor.

Therefore, according to the present invention, current resulting from adding small current obtained by dividing constant current to current having a temperature dependency is applied to the gates of the first and the second transistors connected to the sides of the first and the second power supplies, respectively, whereby an output can be prevented from being in a floating state.

In an oscillation circuit in which oscillation frequency has a temperature dependency in accordance with a still further aspect of the present invention, a first clock signal is applied to one gate input of each of a plurality of inverter circuits each having two gate inputs, a second clock signal is applied to the other gate input thereof, and a first transistor of a first conductivity type is connected between a first power supply terminal of each inverter circuit and a first power supply line. A current signal of one polarity is applied to an input electrode of the first transistor, a second transistor of a second conductivity type is connected between a second power supply terminal of each inverter circuit and a second power supply line, a current signal of the other polarity is applied to an input electrode of the second transistor, and current flowing into the inverter circuits is restricted by the first and the second transistors.

Consequently, according to the present invention, an oscillation frequency determined by current can be increased at a high temperature, and therefore, an oscillation frequency which allows implementation of a refresh interval suitable for refresh characteristic of a memory cell can be obtained if the oscillation circuit is used for timer for self-refreshing of a DRAM, for example.

In accordance with another aspect of the present invention, respective input electrodes of one transistor and another transistor which constitute a current mirror circuit are connected in common, current is supplied to the input electrode and a first electrode of one transistor described above, current is supplied to a first electrode of another transistor described above, and resistive elements having different temperature characteristics are connected between respective second electrodes of the transistors and a first power supply line.

In a current generating circuit in accordance with a further aspect of the present invention, constant current is applied from a constant current source to a first electrode of a first transistor out of first and second transistors which constitute a current mirror circuit, and current is extracted from a first electrode of the second transistor.

In accordance with a still further aspect of the present invention, constant current is supplied from a current source to a diode-connected first transistor, a resistive element is connected between an input electrode of the first transistor and a reference potential, an input electrode of a second transistor is connected to the input electrode of the first transistor, and current according to current flowing in the resistive element is extracted from the second transistor.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 57 is a timing chart illustrating a self refresh mode of the DRAM shown in FIG. 56.

FIG. 58 is a circuit diagram showing a conventional timer circuit using a ring oscillator.

DESCRIPTION OF THE PREFERRED EMBODIMENTS

Figure 1:
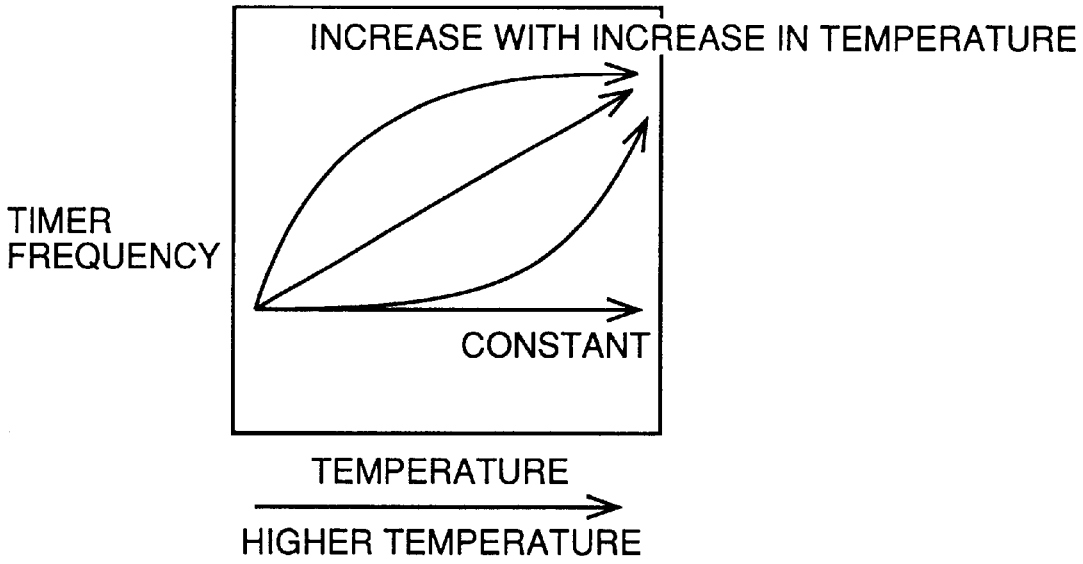
FIG. 1 is a diagram illustrating the principle of the present invention.
Figure 2:
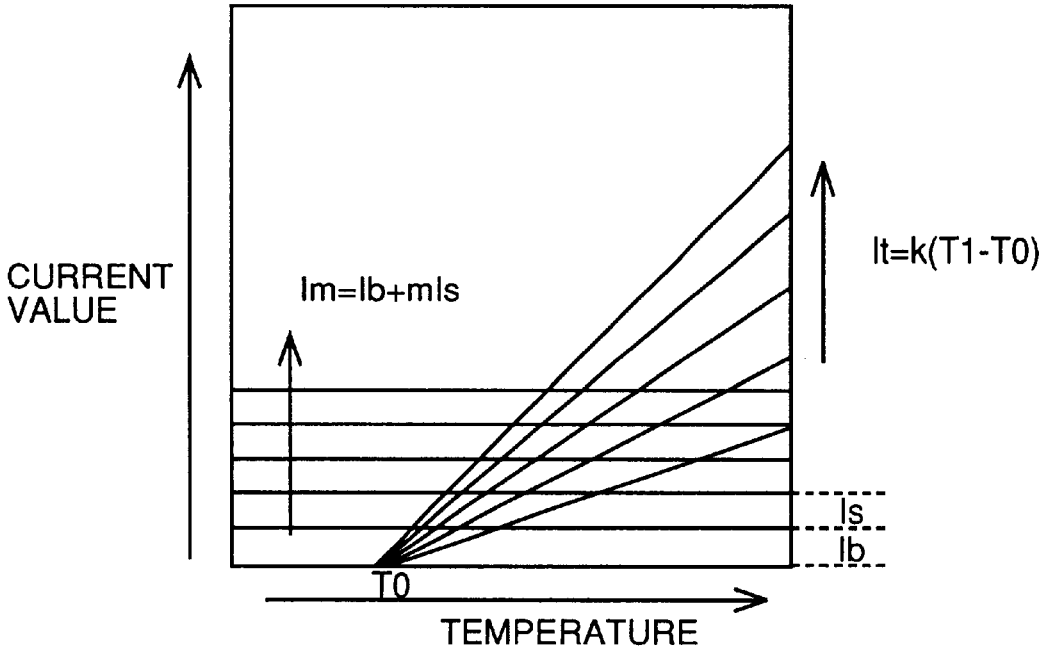
FIG. 2 is a diagram illustrating current control of a ring oscillator in accordance with an embodiment of the present invention.

FIGS. 1 and 2 are diagrams illustrating the principle of the present invention.

In the present invention, current is controlled so that a timer frequency, that is, an oscillation frequency is increased with increase in a temperature as shown in FIG. 1. More specifically, three kinds of currents are first produced as shown in FIG. 2. First is current Ib for applying constant current all the time. This current compensates for the minimum current for preventing deadlock of a circuit when current having a temperature dependency does not flow into the circuit on a certain condition. Second is current Is which can be increased or decreased at regular intervals or at arbitrary intervals depending on a condition. This is used to examine a reference oscillation frequency. Accordingly, current Im which determines an oscillation frequency of a ring oscillator is represented by the sum of Ib and Is. Third is current It which is increased depending on a temperature when a temperature is T0 or higher. This current has a temperature dependency, and further, temperature characteristic of this current can be improved or degraded at regular intervals or at arbitrary intervals. The final temperature characteristic of an oscillation frequency is determined by the sum of this current It and current Im which determines a reference frequency.

Figure 3:
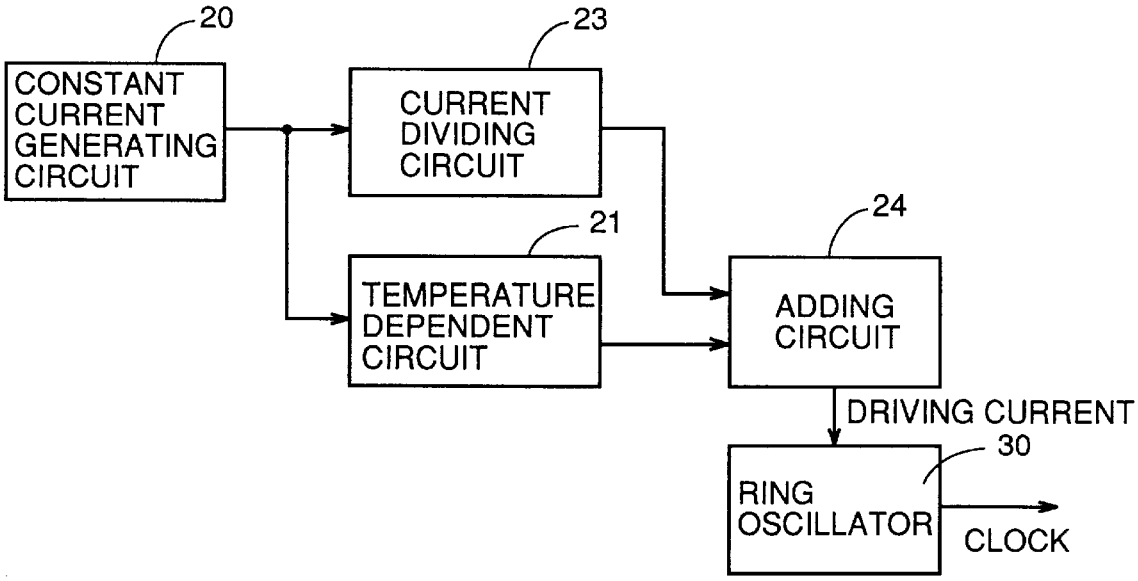
FIG. 3 is a schematic block diagram showing a current generating circuit in accordance with an embodiment of the present invention.

FIG. 3 is a schematic block diagram showing an embodiment of the present invention. In FIG. 3, a constant current generating circuit 20 generates current which is a base of all the current controls. Constant current generated by constant current generating circuit 20 is applied to a temperature dependent circuit 21 and a current dividing circuit 23. Although constant current generating circuit 20 may be provided in each of temperature dependent circuit 21 and current dividing circuit 23, constant current generating circuit 20 is often in a condition of consuming current all the time, and therefore, constant current generating circuit 20 is shared in the present embodiment in order to reduce current consumption. In addition, since this constant current having a temperature dependency preferably has a small voltage dependency, the following embodiments will be described accordingly. Current dividing circuit 23 extracts and divides reference constant current to generate small current Ib and step current Is. Temperature dependent circuit 21 produces current having temperature dependency from the constant current. These currents are applied to adding circuit 24 and added therein, whereby current suitable for the temperature condition is produced and finally applied to ring oscillator 30 to support oscillation.

Figure 4:
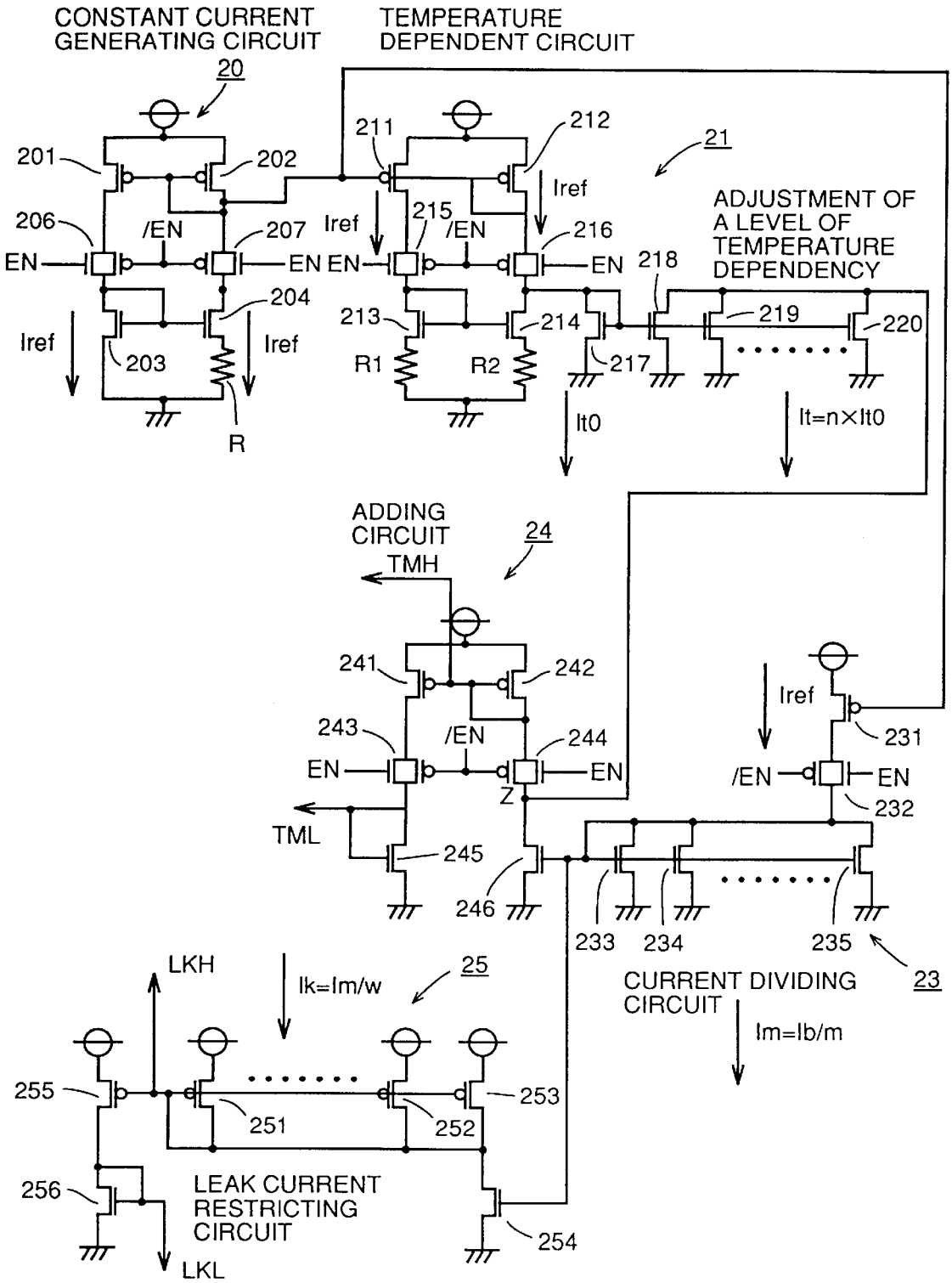
FIG. 4 is an electric circuit diagram showing a current generating circuit in accordance with the embodiment of the present invention more specifically.

FIG. 4 is a circuit diagram showing a block diagram of FIG. 3 more specifically. In FIG. 4, constant current generating circuit 20 is a circuit in which a current mirror circuit consisting of p channel transistors 201 and 202 and a current mirror circuit consisting of n channel transistors 203 and 204 are connected through gate transistors 206 and 207, and a resistance R is connected between the source of n channel transistor 204 and the ground. Since this constant current generating circuit 20 is described in IEEE J.S.S.C. Vol. SC-12, No. 3, June 1977, pp. 224–231 by ERIC VITTS et. al., specific operation thereof will not be repeated. The constant current generating circuit described in the above mentioned document and constant current generating circuit 20 of FIG. 4 are different from each other in that transfer gates 206 and 207 are provided in constant current generating circuit 20 of FIG. 4. These transfer gates 206 and 207 are provided for cutting off a circuit and for reducing current, respectively, when constant current generating circuit 20 is not used, and the transfer gates are activated when current flows into the circuit with an activation signal EN being at an "H" level and an activation signal $\overline{EN}$ being at an "L" level. These activation signals are activated when self refresh detection circuit 2 shown in FIG. 11 detects a self refresh mode.

Constant current generated in constant current generating circuit 20 is transmitted as a gate potential of a p channel transistor 231 of current dividing circuit 23. The p channel transistor 231 has its drain connected to a power supply line, and its source connected to the drains and the gates of a plurality of n channel transistors 233, 234 and 235 through a transfer gate 232 which is activated by activation signals EN and $\overline{EN}$. Each of a plurality of n channel transistors 233, 234 and 235 has its source grounded. These transistors 233, 234 and 235 produce current Im by dividing current Iref flowing into p channel transistor 231. This current Im has a value including the values of current Ib and current Is. Im having an arbitrary value can be obtained by changing the number m of these current dividing transistors 233, 234 and 235.

The reference current Iref generated in constant current generating circuit 20 is also applied to temperature dependent circuit 21. Temperature dependent circuit 21 includes p channel transistors 211 and 212 each receiving reference current Iref from constant current generating circuit 20 at its gate, transfer gates 215 and 216, n channel transistors 213 and 214 constituting a current mirror circuit, and resistances R1 and R2 connected between n channel transistors 213 and 214 and the ground, respectively, and having different temperature characteristics. Resistance R1 is made of metal such as polysilicon and has temperature characteristic of almost zero, while resistance R2 is a p type well formed by doping p type impurities into a silicon substrate and has temperature characteristic of a positive value, and resistance values of these resistances R1 and R2 are selected so that R1 is smaller than R2 when a temperature is increased.

Furthermore, a mirror-connected n channel transistor 217 is connected to the drain of n channel transistor 214 to which resistance R2 is connected. This n channel transistor 217 receives current leaking from n channel transistor 214. In addition, n channel transistors 218, 219 and 220 for adjusting a level of temperature dependency are connected in parallel to the gate and the drain of n channel transistor 217. Current in the mirror-connected n channel transistor 217 is amplified by n channel transistors 218, 219 and 220, and then is supplied to adding circuit 24.

Adding circuit 24 includes p channel transistors 241 and 242 constituting a current mirror circuit, transfer gates 243 and 244 which are rendered conductive in response to activation signals EN and $\overline{EN}$, and n channel transistors 245 and 246 connected through transfer gates 243 and 244 to p channel transistors 241 and 242, respectively. Current Im divided by current dividing circuit 23 is input to the gate of n channel transistor 246, current It is applied from temperature dependent circuit 21 to a node Z which is the drain of n channel transistor 246, and It and Im are extracted from node Z. This current is copied in the current mirror circuit constituted by p channel transistors 241 and 242, and then supplied as a gate potential TMH of a transistor for controlling current in an inverter of ring oscillator 30. In addition, a gate potential TML having a polarity opposite thereto is output from n channel transistor 245.

A leak current restricting circuit 25 of FIG. 4 will be described later.

Operation of the current generating circuit shown in FIG. 4 will now be described. When activation signals EN and $\overline{EN}$ are at an "H" level and at an "L" level, respectively, reference current Iref is generated by constant current generating circuit 20, and applied to temperature dependent circuit 21 and current dividing circuit 23. In current dividing circuit 23, p channel transistor 231 receives the reference current Iref at its gate, which in turn is divided by n channel transistors 233, 234 and 235 which are connected in parallel on the side of the ground, whereby small current Im is produced. This small current Im has a value including the values of the above described currents Ib and Is.

On the other hand, in temperature dependent circuit 21, the reference current Iref flows from p channel transistors 211 and 212 through respective transfer gates 215 and 216 into a current mirror circuit constituted by n channel transistors 213 and 214. At this time, if resistances R1 and R2 have the same resistance value, current having the same value flows into the ground potential, and current leaking to the side of adjacent diode-connected n channel transistor 217 is almost 0. If this point is set to the point of a temperature T0, a component It of current having a temperature dependency is 0 at T0. However, since resistance R2 has a temperature dependency, a resistance value of resistance R2 is larger than that of resistance R1 at a high temperature, and fall of potential on the side of resistance R2 is increasing when reference current Iref flows therein. However, since n channel transistor 213 on the side of resistance R1 is diode-connected, potential at the source of n channel transistor 214 on the side of resistance R2 is pulled up by the fall of potential at resistance R2, and a potential between the gate and the source thereof is reduced, whereby current driving ability of n channel transistor 214 is reduced. Therefore, n channel transistor 214 applies only a portion of the reference current Iref to the side of the ground. Consequently, remaining current leaks to the side of adjacent diode-connected n channel transistor 217. Furthermore, this current Ito is copied by mirror connection between n channel transistors 217 and 218 and amplified by a plurality of transistors 219 and 220, and the resultant current It is applied to adding circuit 24. This amplification can be varied arbitrarily by changing the number n of transistors connected in parallel, and temperature dependency can be varied as well at the same time.

Current It and current Im are extracted from common node Z by adding circuit 24. This current is copied in a current mirror circuit constituted by p channel transistors 241 and 242 provided on the side of a power supply of adding circuit 24 to be a gate potential of a transistor for controlling current in an inverter of a ring oscillator as a TMH signal. In addition, a TML signal having a polarity opposite thereto is output from the drain of diode-connected n channel transistor 245.

Figure 5A:
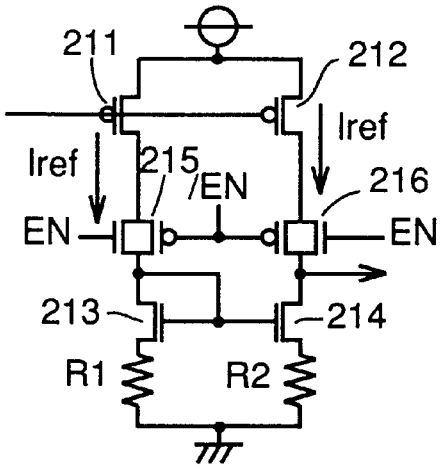
FIGS. 5A to 5D are diagrams showing further examples of a current comparison portion shown in FIG. 4, respectively.
Figure 5B:
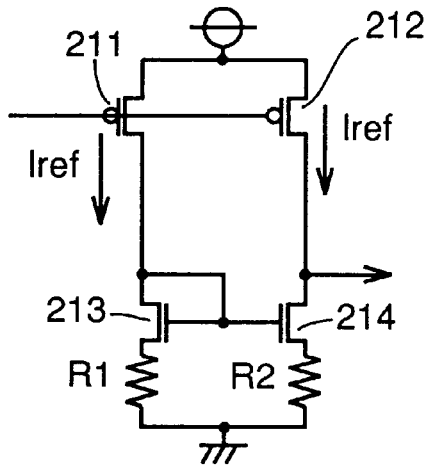
Figure 5C:
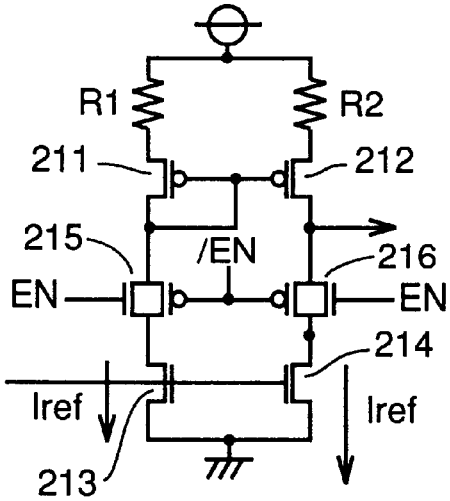
Figure 5D:
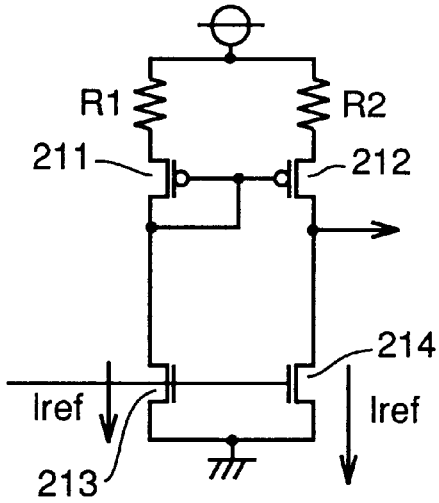

FIGS. 5A to 5D are diagrams showing further examples of a current comparison portion shown in FIG. 4, respectively, wherein FIG. 5A is a diagram showing a current comparison portion in temperature dependent circuit 21 shown in FIG. 4 with resistances R1 and R2 provided on the side of the ground, and FIG. 5B is a diagram showing the current comparison portion shown in FIG. 5A without transfer gates 215 and 216. FIG. 5C is a diagram showing a current comparison portion with resistances R1 and R2 provided on the side of the power supply, and FIG. 5D is a diagram showing the current comparison portion of FIG. 5C without transfer gates 215 and 216.

In FIGS. 5C and 5D, a current mirror circuit is constituted by p channel transistors 211 and 212, and reference current Iref is applied to the gates of n channel transistors 213 and 214. It is determined by current to be compared in the current comparison portion whether resistances R1 and R2 are provided on the side of the ground as shown in FIGS. 5A and 5B or on the side of the power supply as shown in FIGS. 5C and 5D. Resistances R1 and R2 may be provided on either side if used merely as resistance. At this time, the resistive elements are desired to be provided on the side of the ground if a higher potential or a potential higher than the power supply voltage is of interest, and the resistive elements are desired to be provided on the side of the power supply if a lower potential or a negative potential lower than the ground potential is of interest.

Figure 6A:
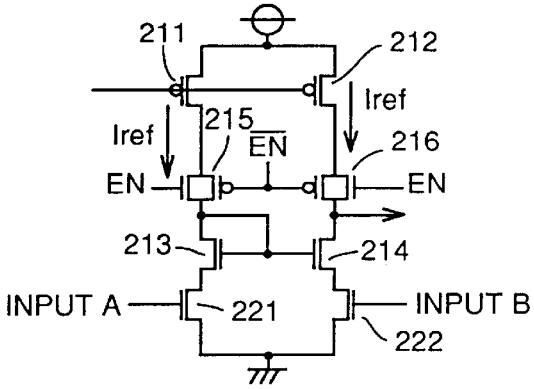
FIGS. 6A to 6D are diagrams showing still further examples of the current comparison portion, respectively.
Figure 6B:
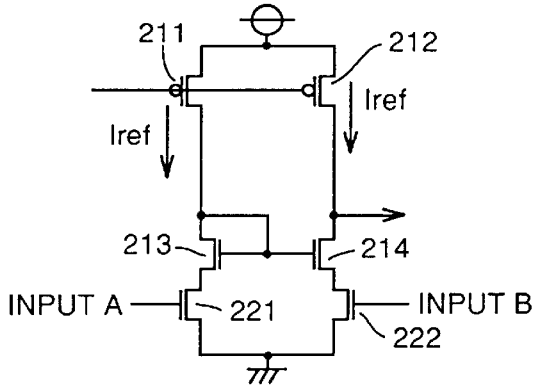

FIGS. 6A to 6D are diagrams showing still further examples of the current comparison portion, respectively, wherein FIG. 6A is a circuit diagram in which n channel transistors 221 and 222 are provided instead of resistive elements R1 and R2 shown in FIG. 5A, and FIG. 6B is a circuit diagram in which transfer gates 215 and 216 of FIG. 6A are excluded. Respective resistance values of n channel transistors 221 and 222 can be changed by controlling respective gate potentials of n channel transistors 221 and 222, and respective drain voltages of n channel transistors 221 and 222 are compared with each other in the current mirror circuit.

Figure 6C:
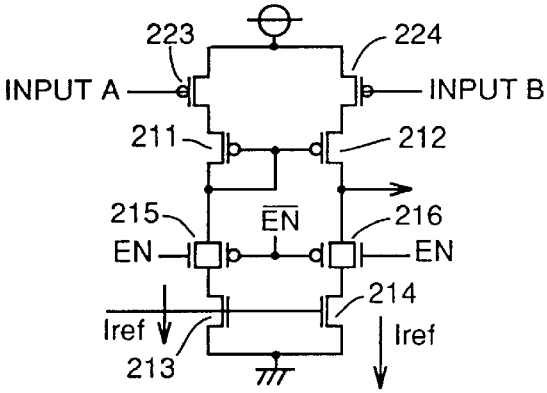
Figure 6D:
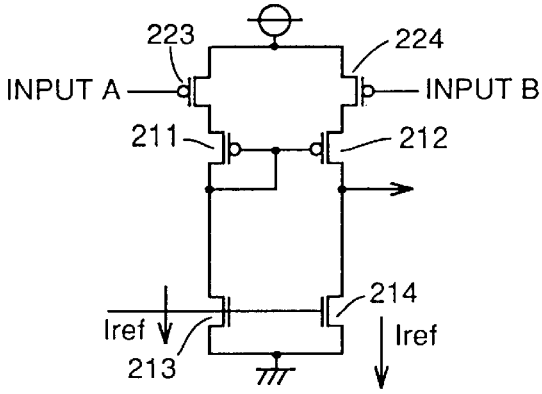

FIG. 6C is a diagram in which p channel transistors 223 and 224 are provided on the side of the power supply instead of resistive elements R1 and R2 of FIG. 5C, and FIG. 6D is a diagram in which transfer gates 215 and 216 of FIG. 6C are excluded.

Figure 7:
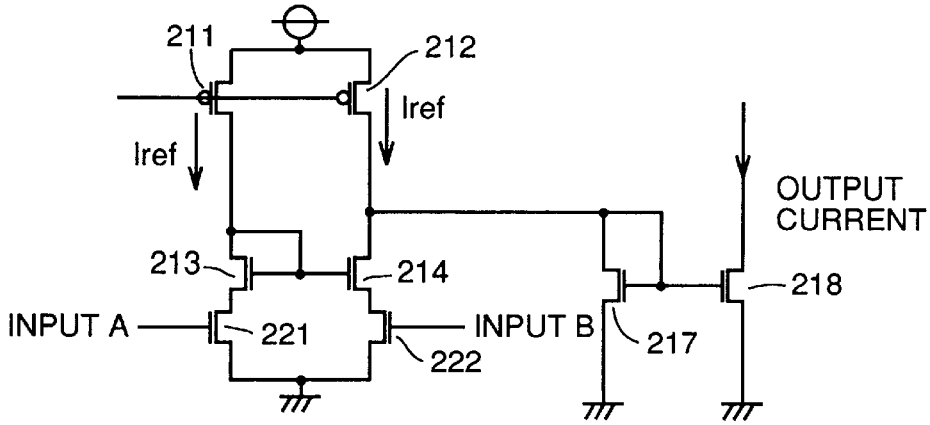
FIG. 7 is a circuit diagram showing an example in which an n channel transistor 217 is connected to an output of the current comparison portion shown in FIG. 6D.

FIG. 7 is a diagram showing an example in which an n channel transistor 217 is connected to an output of the current comparison portion of FIG. 6D, as in the case of FIG. 4. An output of the current comparison portion is output in level in the case of the example shown in FIG. 4 described above, while an output thereof is extracted in the form of current in the case of the example shown in FIG. 7.

Provided that a reference potential is applied to an input A and an input B is to be measured in FIG. 7, respective resistance values of n channel transistors 221 and 222 are increased if a potential at the input B is lower than the reference potential. Then, the ability to apply current to the side of the input B degrades and charges are accumulated at an output potential node, resulting in increase in a potential in the above described embodiment, while excess charges are made to be discharged to diode-connected n channel transistor 217 in this case. Since this n channel transistor 217 is diode-connected, a gate potential thereof is determined by an amount of current flowing therein. In addition, if this gate potential is connected to an n channel transistor 218 in the next stage, a current mirror structure is obtained, so that the same current can be extracted.

Figure 8:
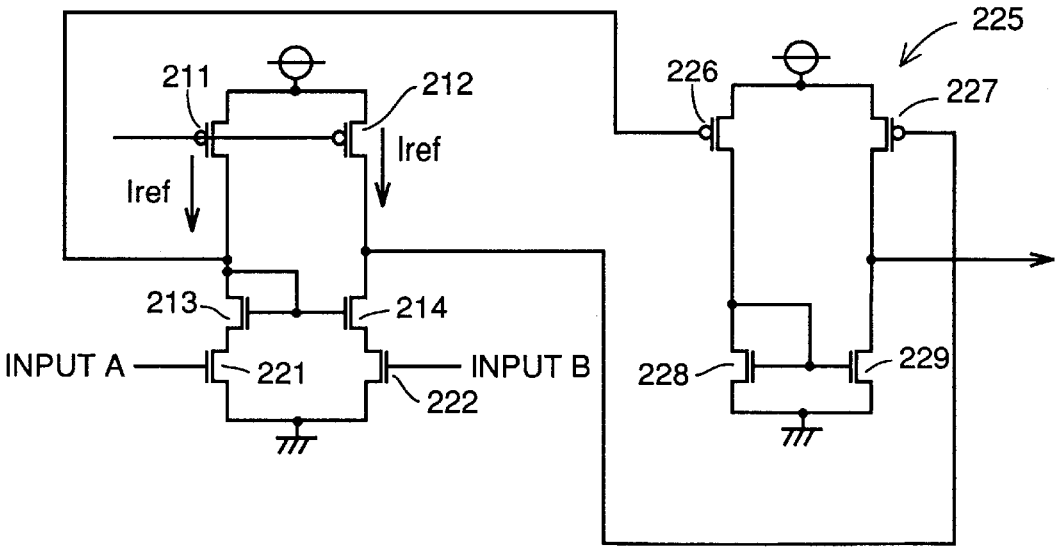
FIG. 8 is a circuit diagram showing an example in which an amplifier is connected to an output of the current comparison portion.

FIG. 8 is a diagram showing an example in which an amplifier is connected to an output of the current comparison portion. In FIG. 8, the difference between respective resistance values of n channel transistors 221 and 222 each used as a resistive element causes difference in current between the right and the left sides according to signals input to inputs A and B, and an output potential thereof is amplified by an amplifier 225. Amplifier 225 consists of a current mirror circuit constituted by n channel transistors 228 and 229, and p channel transistors 226 and 227 respectively connected between the drain of n channel transistor 228 and the power supply line and between the drain of n channel transistor 229 and the power supply line. In addition, amplifier 225 amplifies a small amplitude of an output of the current comparison portion.

Figure 9A:
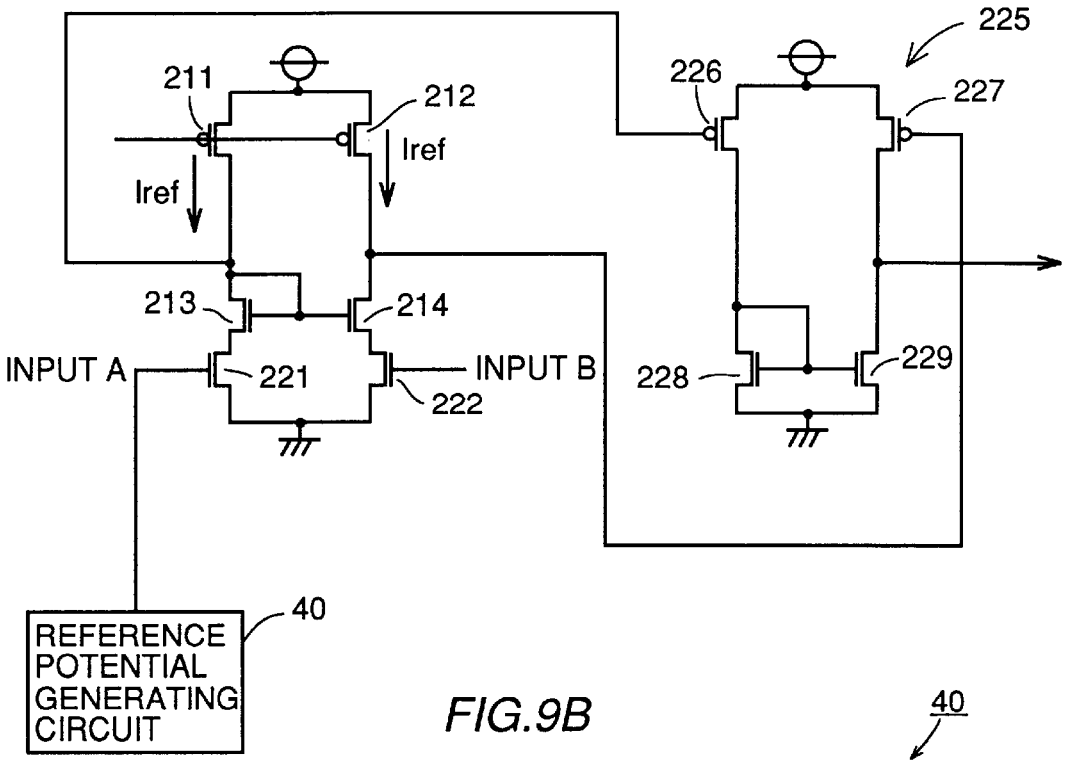
FIG. 9A is a circuit diagram showing a specific example in which a reference potential is made to be applied to an input A of the current comparison portion shown in FIG. 8.
Figure 9B:
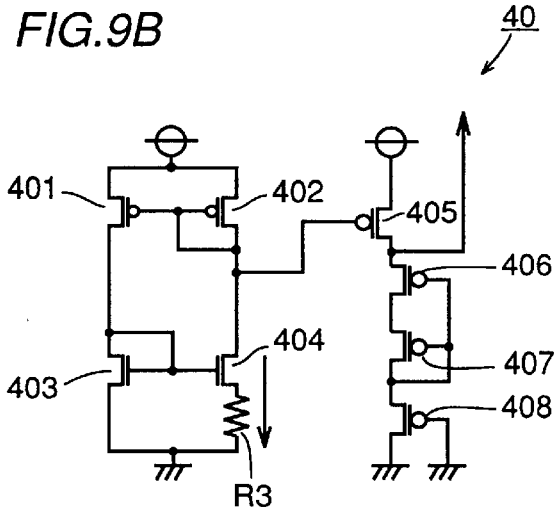
FIG. 9B is a circuit diagram showing a specific exam reference potential generating circuit.

FIGS. 9A and 9B are circuit diagrams showing a specific example in which a reference potential is made to be applied to input A of the current comparison portion shown in FIG. 8, wherein FIG. 9A shows the whole circuit, and FIG. 9B shows a specific example of a reference potential generating circuit therein.

In reference potential generating circuit 40, a current mirror circuit constituted by p channel transistors 401 and 402 and a current mirror circuit constituted by n channel transistors 403 and 404 are connected between the power supply line and the ground line, and a resistance R3 is connected between the source of n channel transistor 404 and the ground. The p channel transistor 402 has its source connected to the gate of a p channel transistor 405, p channel transistor 405 has its drain connected to the power supply line, and p channel transistors 406, 407 and 408 as resistive elements are connected in series between the source of p channel transistor 405 and the ground. More specifically, p channel transistor 405 has its source connected to the drain of p channel transistor 406, p channel transistor 407 has its drain connected to the source of p channel transistor 406, and p channel transistor 408 has its drain connected to the source of p channel transistor 407 and its source grounded. In addition, p channel transistors 406 and 407 has their gates connected to the source of p channel transistor 407, and p channel transistor 408 has its gate grounded.

In reference potential generating circuit 40 shown in FIG. 9B, current having the same value as that flowing in resistance R3 flows in p channel transistors 406, 407 and 408, and a reference potential is generated between the source of p channel transistor 405 and the ground based on both the current and respective resistance values of p channel transistors 406 to 408 and is applied to the gate of n channel transistor 221 in the current comparison portion. Then, the current comparison portion compares a potential applied to input B with the reference potential, and applies the resultant output to amplifier 225.

Figure 10A:
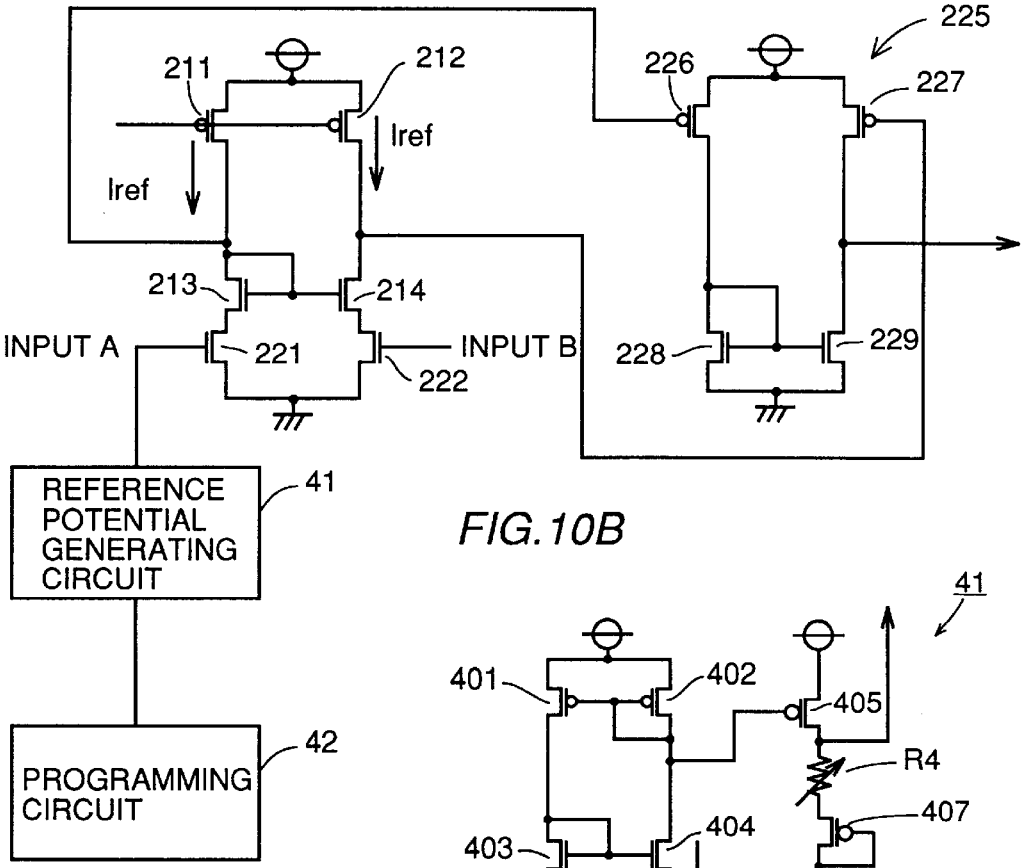
FIGS. 10A to 10D are circuit diagrams showing a yet further example of the current comparison portion.
Figure 10B:
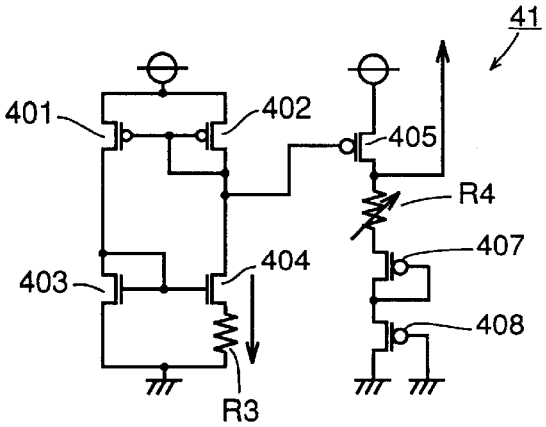
Figure 10C:
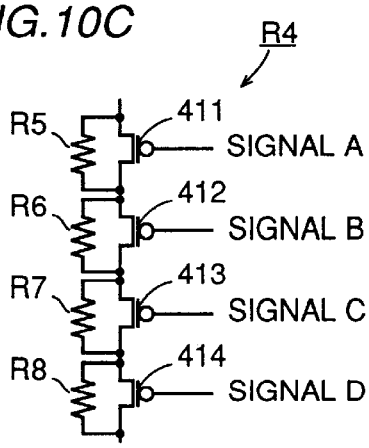

FIGS. 10A to 10D are circuit diagrams showing a further example of the current comparison portion. In the example shown in FIG. 10A, a reference potential generated by a reference potential generating circuit 41 is made to be changed in a programming circuit 42. More specifically, as shown in FIG. 10B, a variable resistance R4 is connected between the source of a p channel transistor 405 and the drain of a p channel transistor 407 in reference potential generating circuit 41, and the structure of reference potential generating circuit 41 is otherwise the same as that of the above described reference potential generating circuit 40 shown in FIG. 9B. The reference potential is varied by changing the value of variable resistance R4. As shown in FIG. 10C, variable resistance R4 is constituted by p channel transistors 411–414 connected in series to each other, and resistances R5–R8 respectively connected in parallel to p channel transistors 411–414. In addition, signals A to D are applied from programming circuit 42 to respective gates of p channel transistors 411 to 414. For example, if all of the signals A to D attain an "H" level, p channel transistors 411 to 414 are turned off, and resistances R5 to R8 are connected in series to each other to be connected between the source of p channel transistor 405 and the drain of p channel transistor 407 in reference potential generating circuit 41. If the signal A falls to an "L" level and the signals B to D attain an "H" level, a series circuit of resistances R6, R7 and R8 is connected between the source of p channel transistor 405 and the drain of p channel transistor 407.

Figure 10D:
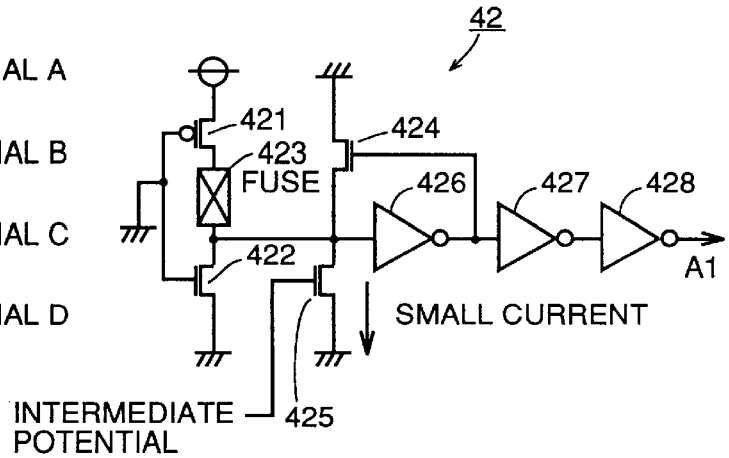

It is noted that four circuits are provided for programming circuit 42 in order to generate signals A to D, and only one circuit is shown in FIG. 10D. As shown in FIG. 10D, a p channel transistor 421, a fuse 423 and an n channel transistor 422 are connected in series between the power supply line and the ground. The connection point between fuse 423 and n channel transistor 422 is connected to an input of an inverter 426 and respective drains of n channel transistors 424 and 425, and n channel transistors 424 and 425 have their sources grounded. An intermediate potential of the power supply potential is applied to the gate of n channel transistor 425. An output of inverter 426 is connected to the gate of n channel transistor 424 and an input of an inverter 427, and a latch circuit is constituted by n channel transistor 424 and inverter 426. An output of inverter 427 is connected to an input of an inverter 428, and an output of inverter 428 is applied as signal A to the gate of p channel transistor 411 shown in FIG. 10C.

In programming circuit 42 shown in FIG. 10D, when fuse 423 is not blown, p channel transistor 421 is rendered conductive and the input of inverter 426 attains an "H" level, so that small current flows into n channel transistor 425. An output of the latch circuit constituted by n channel transistor 424 and inverter 426 falls to an "L" level, and signal A at an "L" level is output through inverters 427 and 428, whereby n channel transistor 411 shown in FIG. 10C is rendered conductive, and both ends of resistance R5 are shorted. If fuse 423 is blown, the input of inverter 426 falls to an "L" level, and the output of the latch circuit attains an "H" level, whereby p channel transistor 411 is turned off, and resistance R is made effective.

Figure 11:
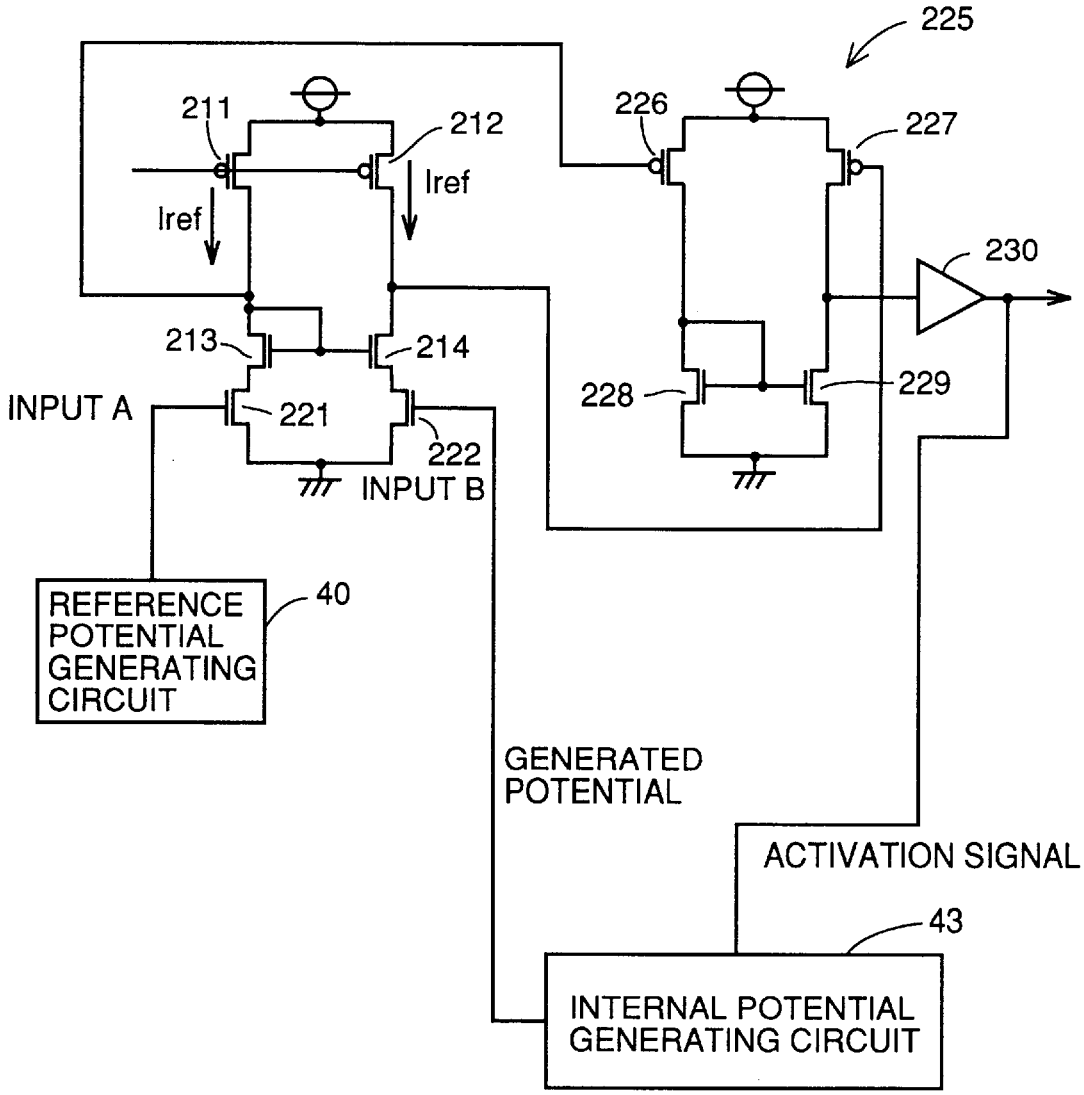
FIG. 11 is a circuit diagram showing a yet further example of the current comparison portion.

FIG. 11 is a circuit diagram showing a still further example of the current comparison portion. The example shown in FIG. 11 is adapted to be applied to a level detector for making a comparison between an internal potential generated by an internal potential generating circuit 43 and a reference potential to determine whether the internal potential reaches the reference potential. A buffer 230 is connected to an output of an amplifier 225, and an output of buffer 230 is applied as an activation signal to internal potential generating circuit 43. Internal potential generating circuit 43 generates an internal potential in response to the activation signal and applies the generated internal potential to an input B of the current comparison portion. The reference potential generated by reference potential generating circuit 40 and the internal potential are compared to each other in the current comparison portion, a signal according to the difference therebetween is applied to amplifier 225, and an activation signal is applied through buffer 230 to internal potential generating circuit 43. Internal potential generating circuit 43 generates an internal potential so as to reduce the difference. Internal potential generating circuit 43 stops its operation if the internal potential reaches the reference potential, and continues its operation otherwise. Thus, the operation of internal potential generating circuit 43 can be stopped at a required time, resulting in reduction in power consumption.

Although the internal potential is made to reach the reference potential in the above described example, the present invention is not limited to this, and the internal potential can be made close to a prescribed level rather than the reference potential by making respective sizes of n channel transistors 221 and 222 unbalanced and making respective resistance values of n channel transistors 221 and 222 at the time when they are rendered conductive different from each other.

Figure 12:
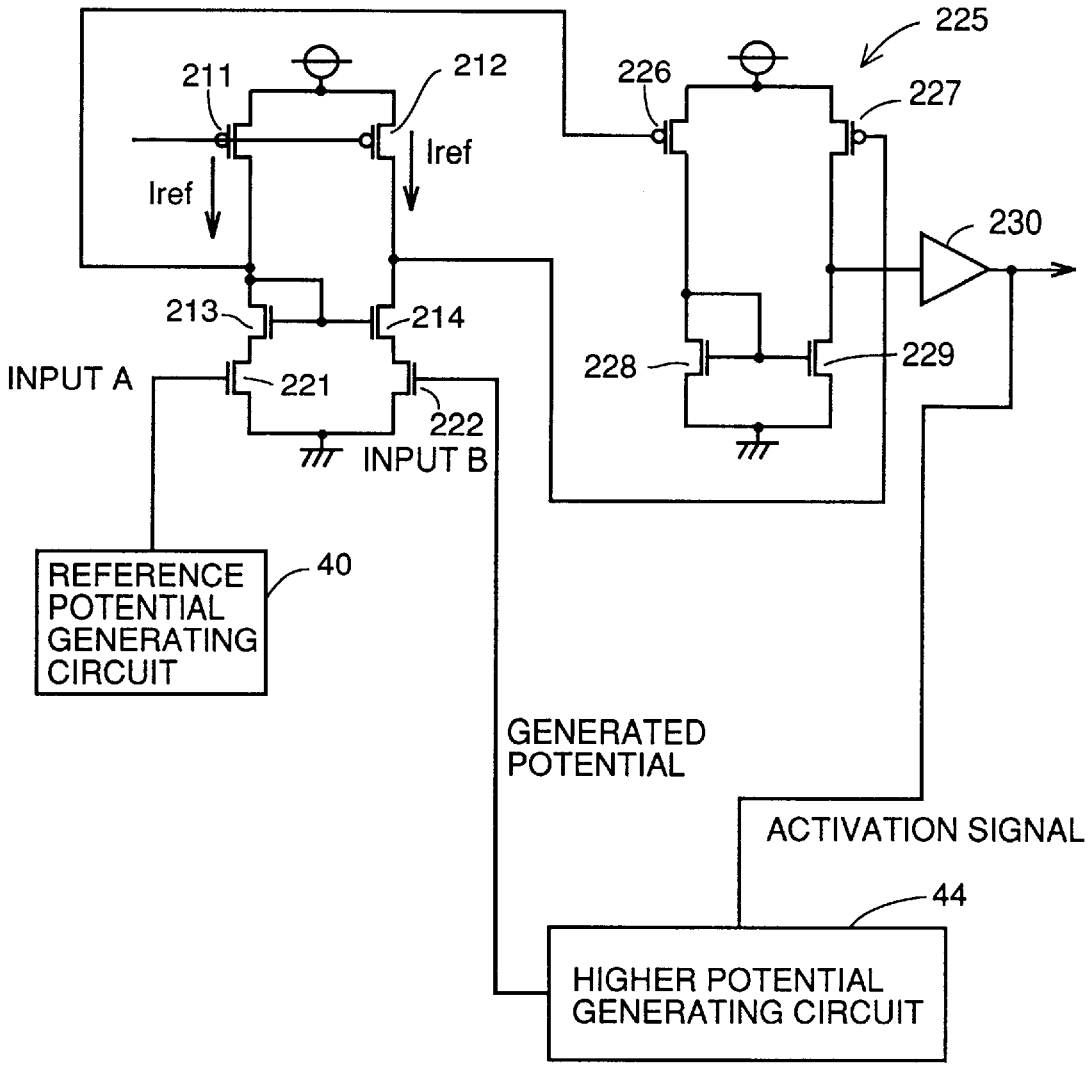
FIG. 12 is a circuit diagram showing a modification of the example shown in FIG. 11.

FIG. 12 is a circuit diagram showing a modification of the example shown in FIG. 11. In this example, a potential higher than the power supply voltage is generated. A higher potential generating circuit 44 is provided instead of internal potential generating circuit 43 shown in FIG. 11, and respective sizes of n channel transistors 221 and 222 are selected to be unbalanced. In addition, a potential higher than the power supply voltage is generated by higher potential generating circuit 44, this potential is compared to a reference potential in the comparison portion, and a potential higher than the reference potential is generated by higher potential generating circuit 44 in response to an activation signal.

Figure 13:
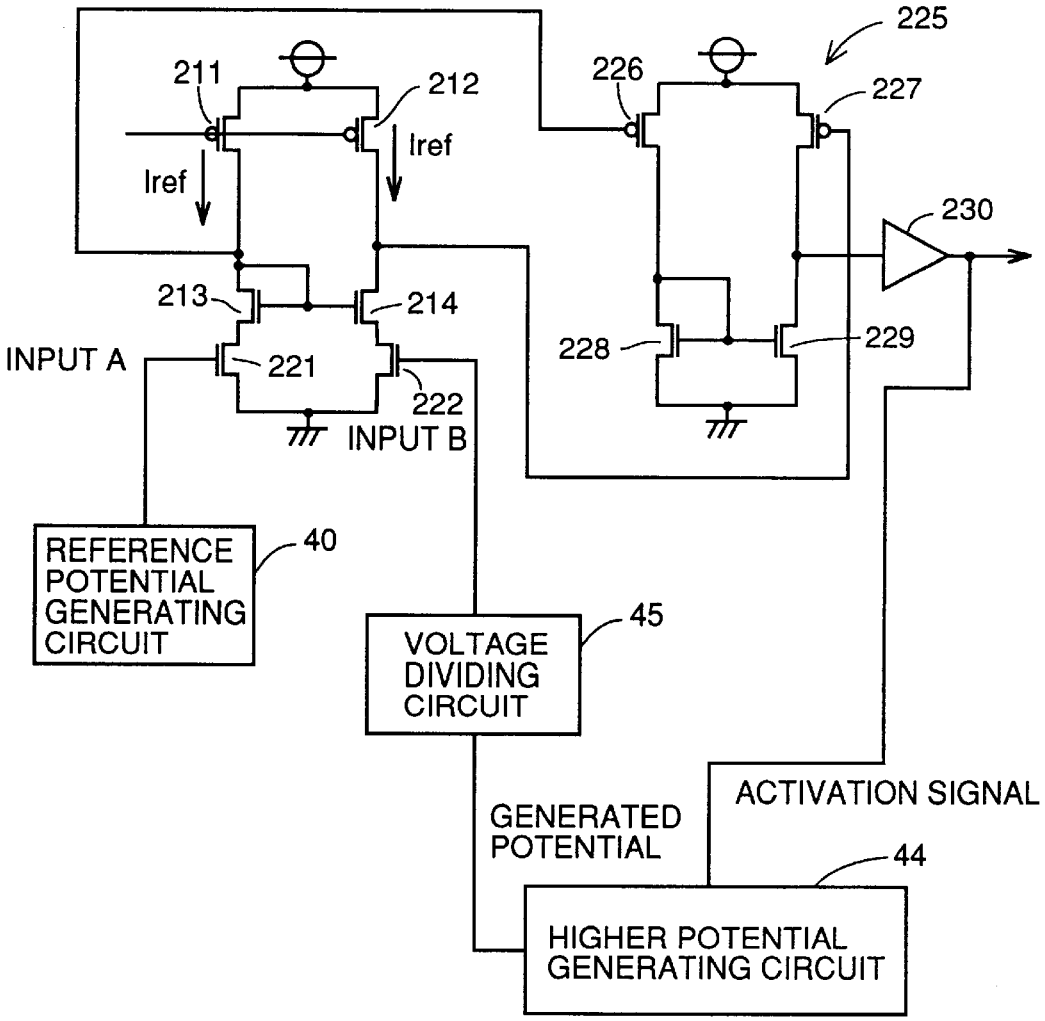
FIG. 13 is a circuit diagram showing a yet further example of the comparison portion.

FIG. 13 is a circuit diagram showing a yet further example of the current comparison portion. In the example shown in FIG. 13, a higher potential generated by a higher potential generating circuit 44 is divided by a voltage dividing circuit 45, and the divided voltage and a reference potential are compared to each other in a comparison portion. It is noted that respective sizes of n channel transistors 221 and 222 are not made unbalanced in this example.

FIGS. 14A to 14E are circuit diagrams each showing an example of the voltage dividing circuit shown in FIG. 13. More specifically, in FIG. 14A, resistances R11 and R12 are connected between a potential and the ground potential, and a divided voltage is generated from the connection point between resistances R11 and R12. In the example shown in FIG. 14B, p channel transistors 451 and 452 are diode-connected in series, and a divided voltage is generated from the connection point between p channel transistors 451 and 452. In the example shown in FIG. 14C, a p channel transistor 453 and an n channel transistor 454 are connected in series, the gate of p channel transistor 453 is grounded, the gate of n channel transistor 454 is connected to a potential line, and a divided voltage is output from the connection point between p channel transistor 453 and n channel transistor 454. In the example shown in FIG. 14D, an n channel transistor 455 and an n channel transistor 456 are connected in series, respective gates of these transistors are connected to a potential line, and a divided voltage is generated from the connection point between n channel transistors 455 and 456.

Figure 14A:
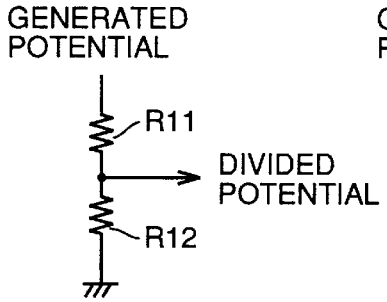
FIGS. 14A to 14E are circuit diagrams showing examples of a voltage dividing circuit shown in FIG. 13, respectively.
Figure 14B:
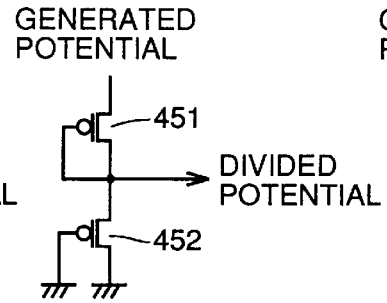
Figure 14C:
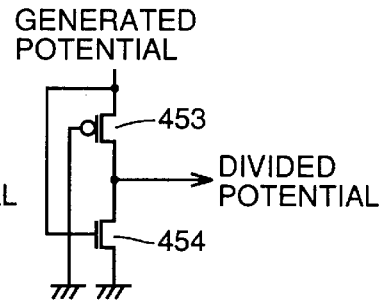
Figure 14D:
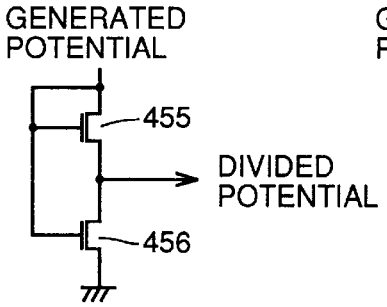
Figure 14E:
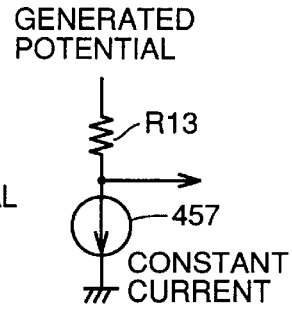

In the example shown in FIG. 14E, a resistance R13 and a constant current source 457 are connected in series, and a divided voltage is generated from the connection point therebetween.

Figure 15:
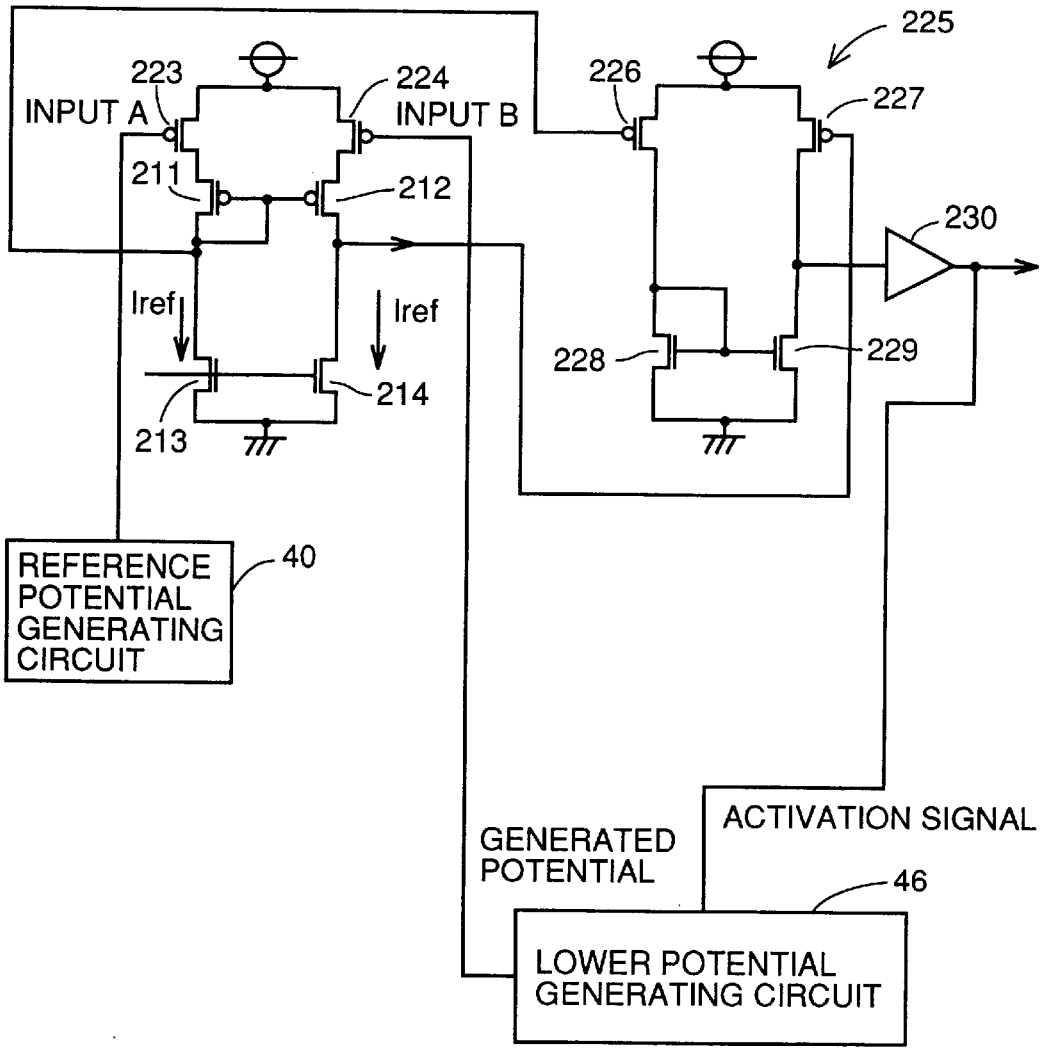
FIG. 15 is a circuit diagram showing a yet further example of the current comparison portion.

FIG. 15 is a circuit diagram showing a yet further example of the current comparison portion. In the example shown in FIG. 15, an amplifier 225 is connected to an output of the current comparison portion shown in FIG. 6D, a potential lower than the ground potential is generated by a lower potential generating circuit 46, and the generated lower potential and a reference potential from reference potential generating circuit 40 are compared to each other in the current comparison portion. Respective gate sizes of p channel transistors 223 and 224 are made unbalanced, and are selected so that respective resistance values of p channel transistors 223 and 224 at the time when they are rendered conductive are different from each other. Accordingly, in this example, a potential lower than the ground potential can be generated by lower potential generating circuit 46 in response to an activation signal.

Figure 16:
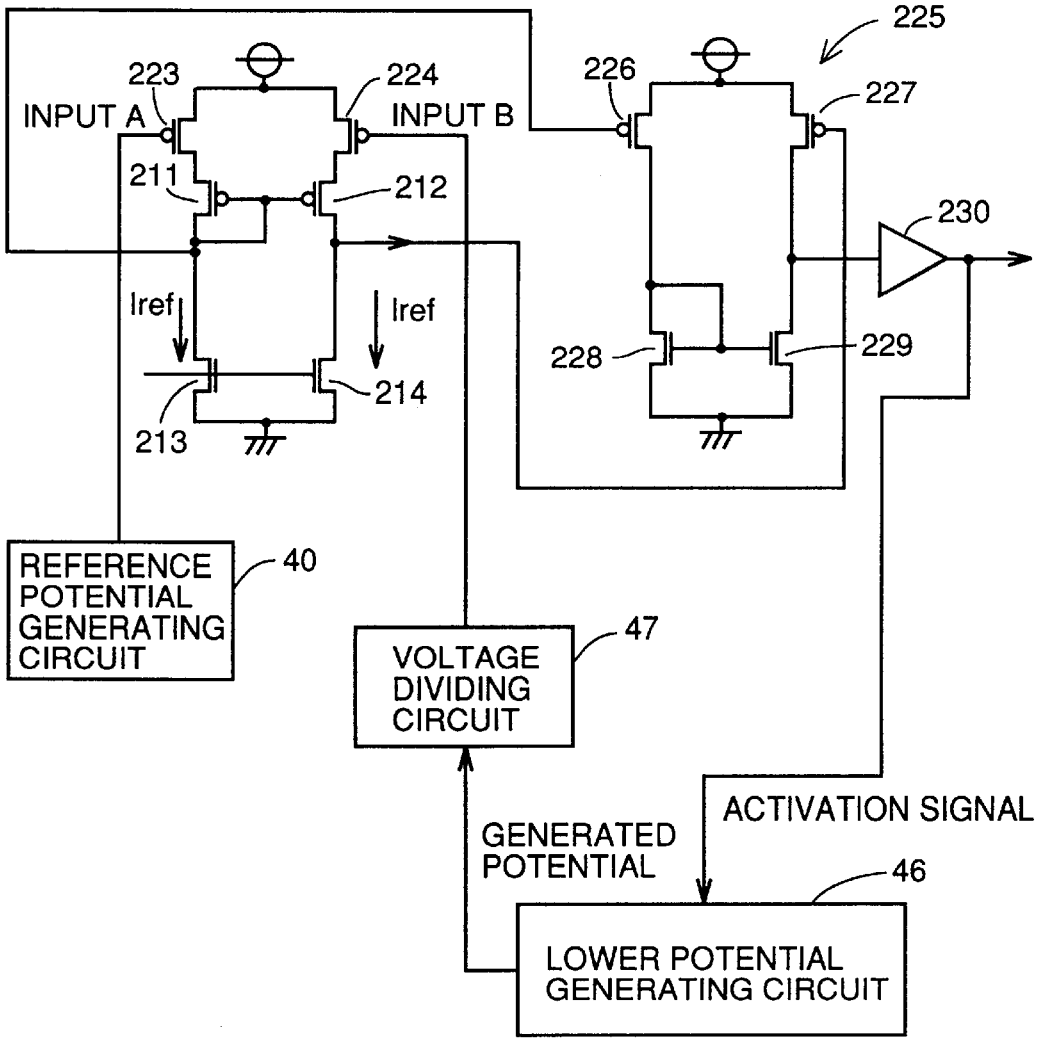
FIG. 16 is a circuit diagram showing a modification of the current comparison portion shown in FIG. 15.

FIG. 16 is a diagram showing a modification of the example shown in FIG. 15. In this example, a potential from a lower potential generating circuit 46 is divided in a voltage dividing circuit 47, and the divided voltage and a reference potential are compared to each other in the current comparison portion.

Figure 17A:
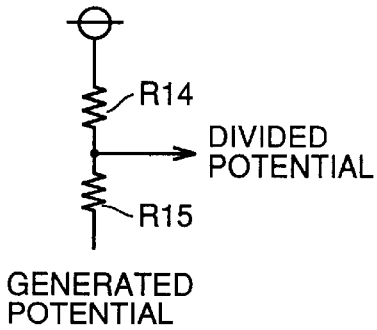
FIG. 17A to 17E are circuit diagrams showing specific examples of a voltage dividing circuit shown in FIG. 16, respectively.
Figure 17B:
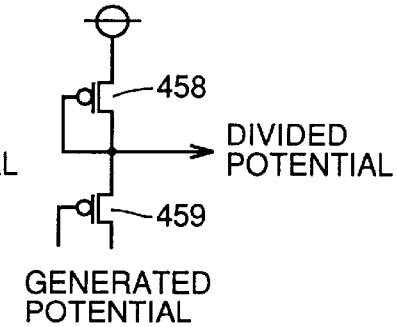
Figure 17C:
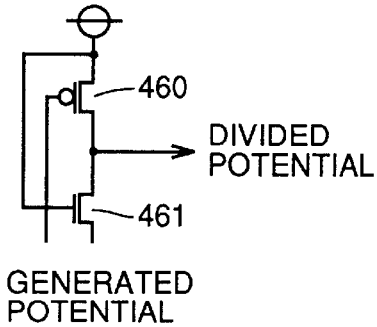
Figure 17D:
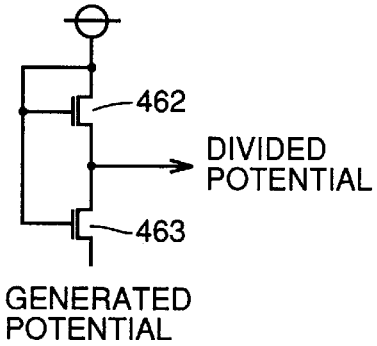
Figure 17E:
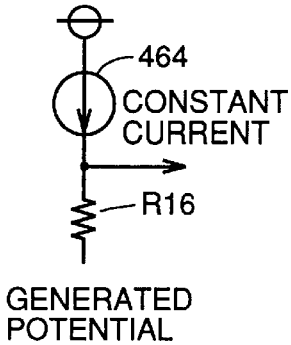

FIGS. 17A to 17E are diagrams each showing a specific example of the voltage dividing circuit shown in FIG. 16. In FIG. 17A, resistances R14 and R15 are connected between a power supply line and a potential line, and a divided voltage is generated from the connection point therebetween. In FIG. 17B, p channel transistors 458 and 459 are diode-connected in series, and a divided voltage is generated from the connection point therebetween. In the example shown in FIG. 17C, a p channel transistor 460 and an n channel transistor 461 are connected between a power supply line and a potential line, a potential is applied to the gate of p channel transistor 460, the power supply potential is applied to the gate of n channel transistor 461, and a divided voltage is generated from the connection point between p channel transistor 460 and n channel transistor 461. In the example shown in FIG. 17D, n channel transistors 462 and 463 are connected in series, and the power supply potential is applied to respective gates thereof. In the example shown in FIG. 17E, a constant current source 464 and a resistance R16 are connected between a power supply line and a potential line, and a divided voltage is output from the connection point therebetween.

Figure 18A:
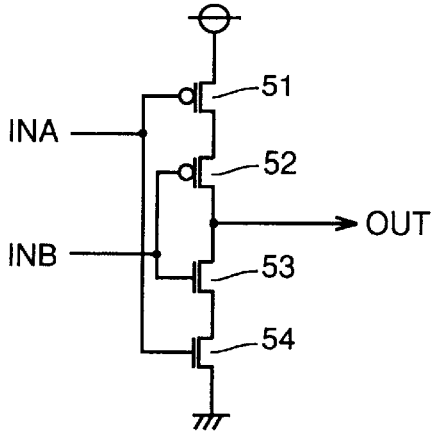
FIG. 18A is a circuit diagram showing a conventional clock inverter.
Figure 18B:
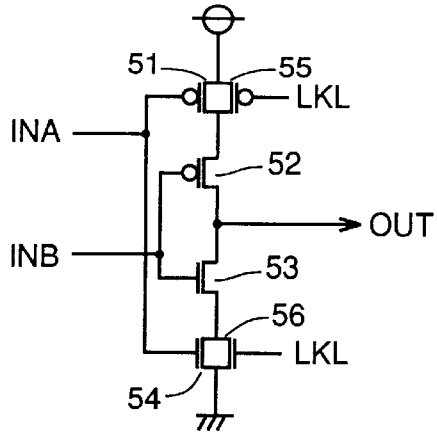
FIG. 18B is a circuit diagram showing a specific example of a clock inverter in accordance with an embodiment of the present invention.

FIG. 18A is a circuit diagram showing a conventional clock inverter, and FIG. 18B is a circuit diagram showing a specific example of a clock inverter in accordance with an embodiment of the present invention.

FIG. 18A shows a clock inverter used in the conventional ring oscillator shown in FIG. 58. In this clock inverter, p channel transistors 51 and 52 and n channel transistors 53 and 54 are connected in series to each other, the gates of p channel transistor 51 and n channel transistor 54 form one input, and the gates of p channel transistor 52 and n channel transistor 53 form the other input. In such a clock inverter, a clock signal INA changes prior to the change of a clock signal INB, whereby a current through path is cut off, and thereafter, an output OUT varies when clock signal INB changes. In this case, however, if the current though path is cut off by clock signal INA which changes prior to clock signal INB, the output is temporarily in a floating state, and therefore, this clock inverter is more susceptible to noise and might cause malfunction.

In a clock inverter in accordance with the embodiment shown in FIG. 18B, a p channel transistor 55 is connected in parallel to a p channel transistor 51, and an n channel transistor 56 is connected in parallel to an n channel transistor 54. Therefore, malfunction can be avoided by applying small current which does not cause malfunction to the gates of p channel transistor 55 and n channel transistor 56 even after a current through path is cut off by a clock signal INA which changes prior to a clock signal INB. This small current is generated from a leak current restricting circuit 25 shown in FIG. 4.

More specifically, small current Im divided in current dividing circuit 23 is applied to the gate of an n channel transistor 254 of leak current restricting circuit 25, and is further divided into current Ik by p channel transistors 251–253 connected in parallel to each other on the side of a power supply. At this time, a value of the divided current can be varied arbitrarily by changing the number w of transistors. Then, the divided current Ik is applied to the gate of p channel transistor 55 shown in FIG. 18B as an LKH signal. The LKH signal is also applied through the gate of p channel transistor 255 of leak current restricting circuit 25 to n channel transistor 256 which is diode-connected to the source thereof, whereby an LKL signal having a polarity opposite thereto is obtained, and this LKL signal is applied to the gate of n channel transistor 56 shown in FIG. 18B.

Figure 19:
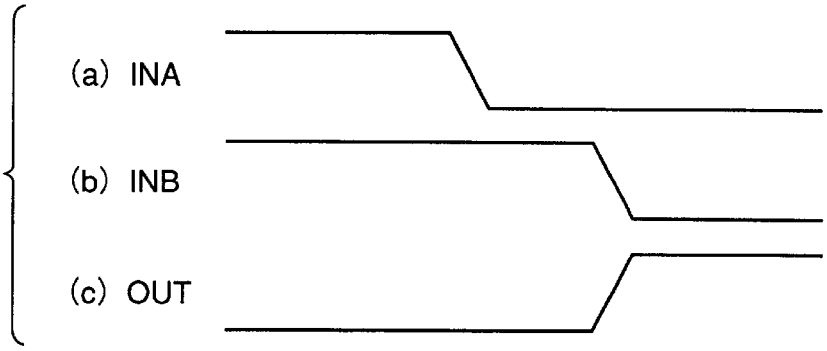
FIG. 19 is a timing chart illustrating an operation of the conventional clock inverter.

FIG. 19 is a timing chart illustrating operations of the clock inverters shown in FIGS. 18A and 18B. As shown in (*a*) and (*b*) of FIG. 19, when clock signal INA falls from an "H" level to an "L" level, clock signal INB is at an "H" level. Therefore, n channel transistor 53 is on, while n channel transistor 54 is off. In addition, p channel transistor 51 is on, while p channel transistor 52 is off. Consequently, an output is in a floating state.

In the clock inverter shown in FIG. 18B, however, when clock signal INA falls from an "H" level to an "L" level, n channel transistor 53 is on even if clock signal INB is at an "H" level. In addition, since n channel transistor 56 is turned on by an LKL signal, an output is at an "L" level, whereby the output can be prevented from being in a floating state.

Figure 20:
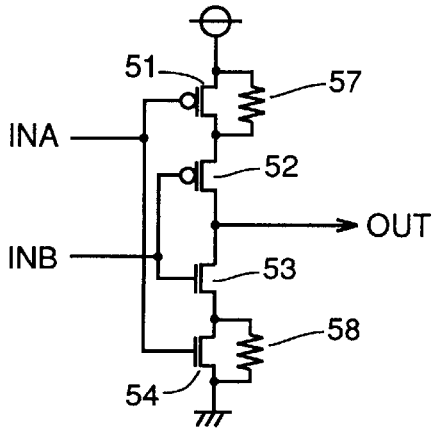
FIG. 20 is a circuit diagram showing a modification of the inverter in accordance with the embodiment of the present invention.

FIG. 20 is a diagram showing a modification of the embodiment shown in FIG. 18B. In the clock inverter in FIG. 20, a resistance 57 instead of p channel transistor 55 shown in FIG. 18B is connected in parallel to a p channel transistor 51, and a resistance 58 instead of n channel transistor 56 shown in FIG. 18B is connected in parallel to an n channel transistor 54. Thus, even if p channel transistor 55 and n channel transistor 56 shown in FIG. 18B are replaced with resistances 57 and 58, respectively, an output terminal is grounded from an n channel transistor 53 through resistance 58, and therefore, an output will not be in a floating state when clock signal INA falls from an "H" level to an "L" level.

Figure 21:
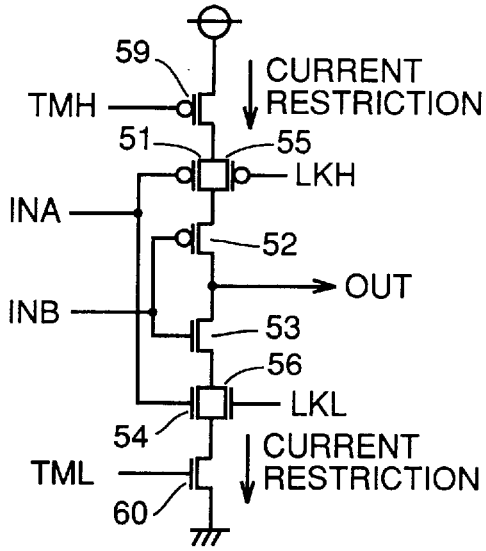
FIG. 21 is a circuit diagram showing an inverter in accordance with an embodiment of the present invention.

FIG. 21 is a circuit diagram showing a clock inverter in accordance with another embodiment of the present invention. In the present embodiment, a p channel transistor 59 is connected in series on the side of a power supply of the inverter shown in FIG. 18B, and a TMH signal shown in FIG. 4 is applied to the gate of p channel transistor 59. Furthermore, an n channel transistor 60 is connected on the side of the ground, and a TML signal is input to the gate of n channel transistor 60. In the present embodiment, current flowing into an inverter can be restricted by the TMH signal and the TML signal applied to the gates of p channel transistor 59 and n channel transistor 60, respectively.

Figure 22:
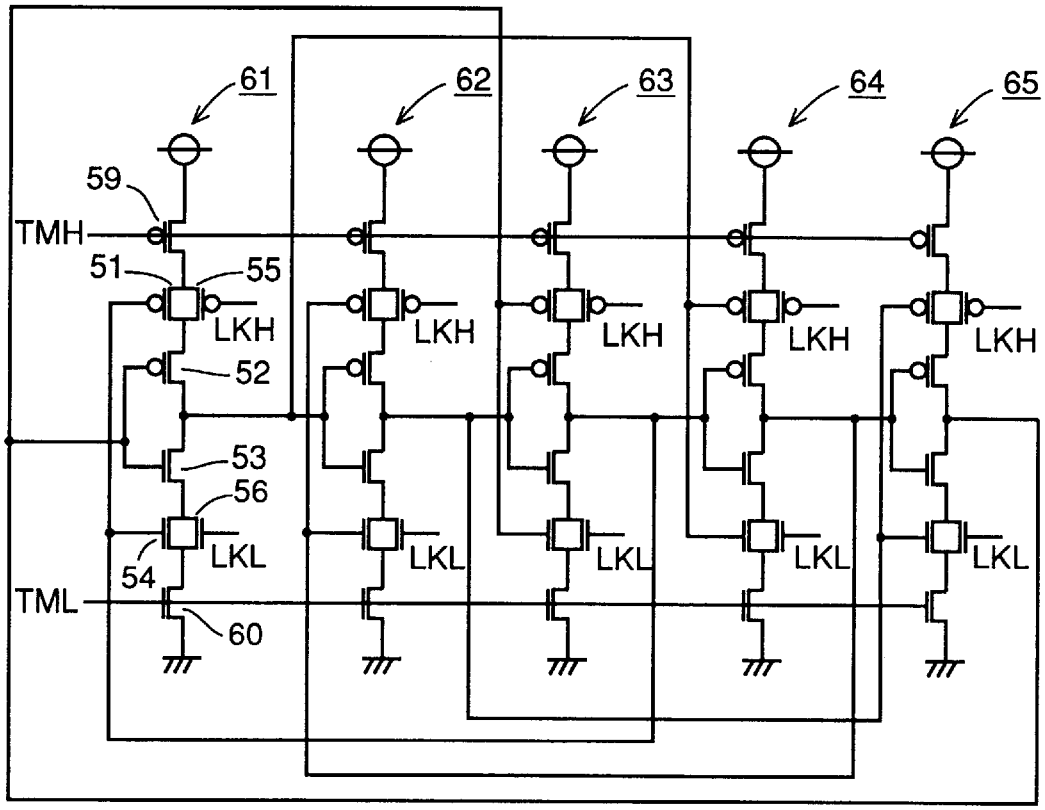
FIG. 22 is a circuit diagram showing a ring oscillator constituted by means of the inverter shown in FIG. 21.
Figure 56:
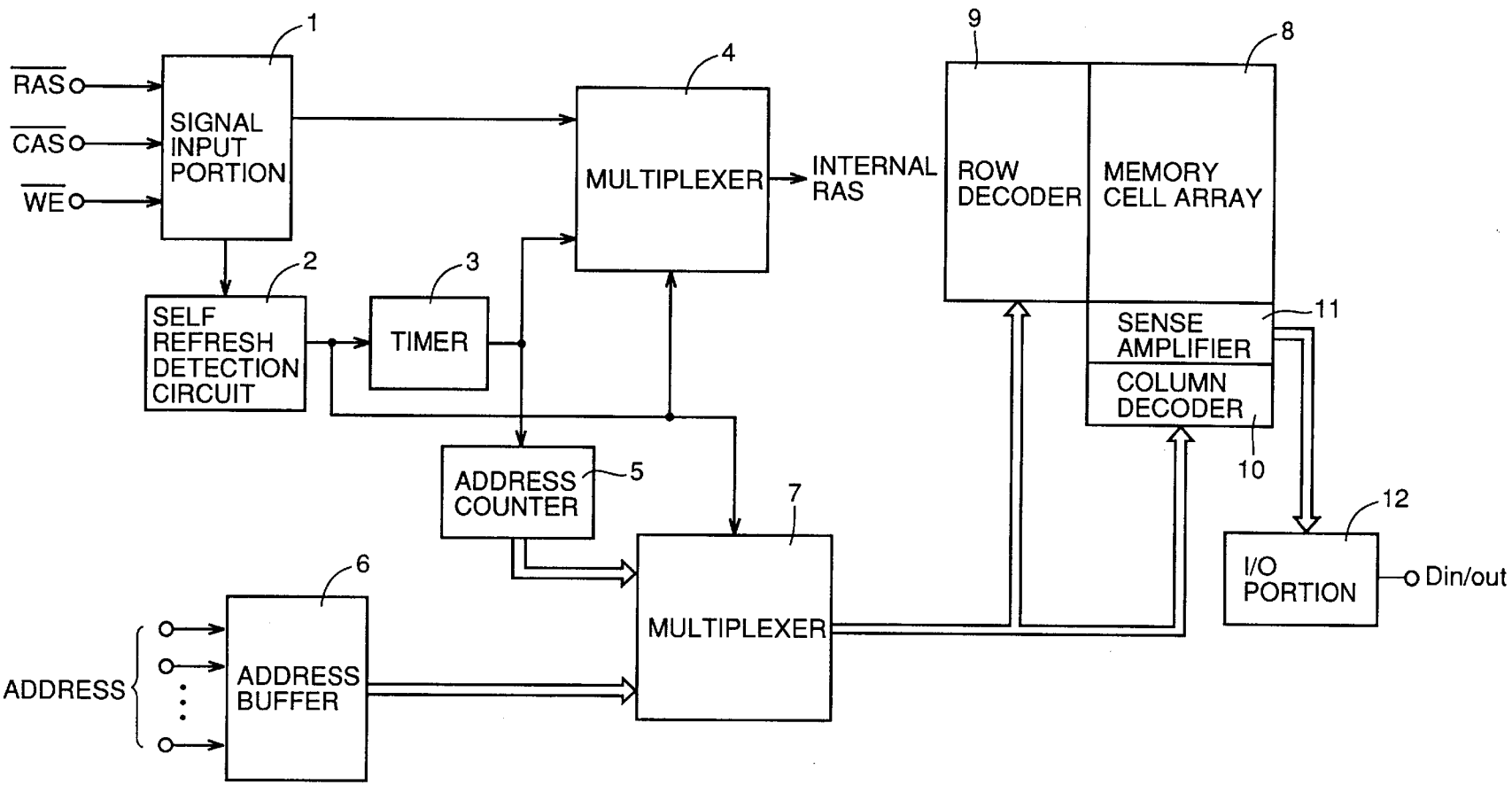
FIG.56 PRIOR ART
FIG. 56 is a schematic block diagram showing a conventional DRAM having a self refresh mode.
Figure 59:
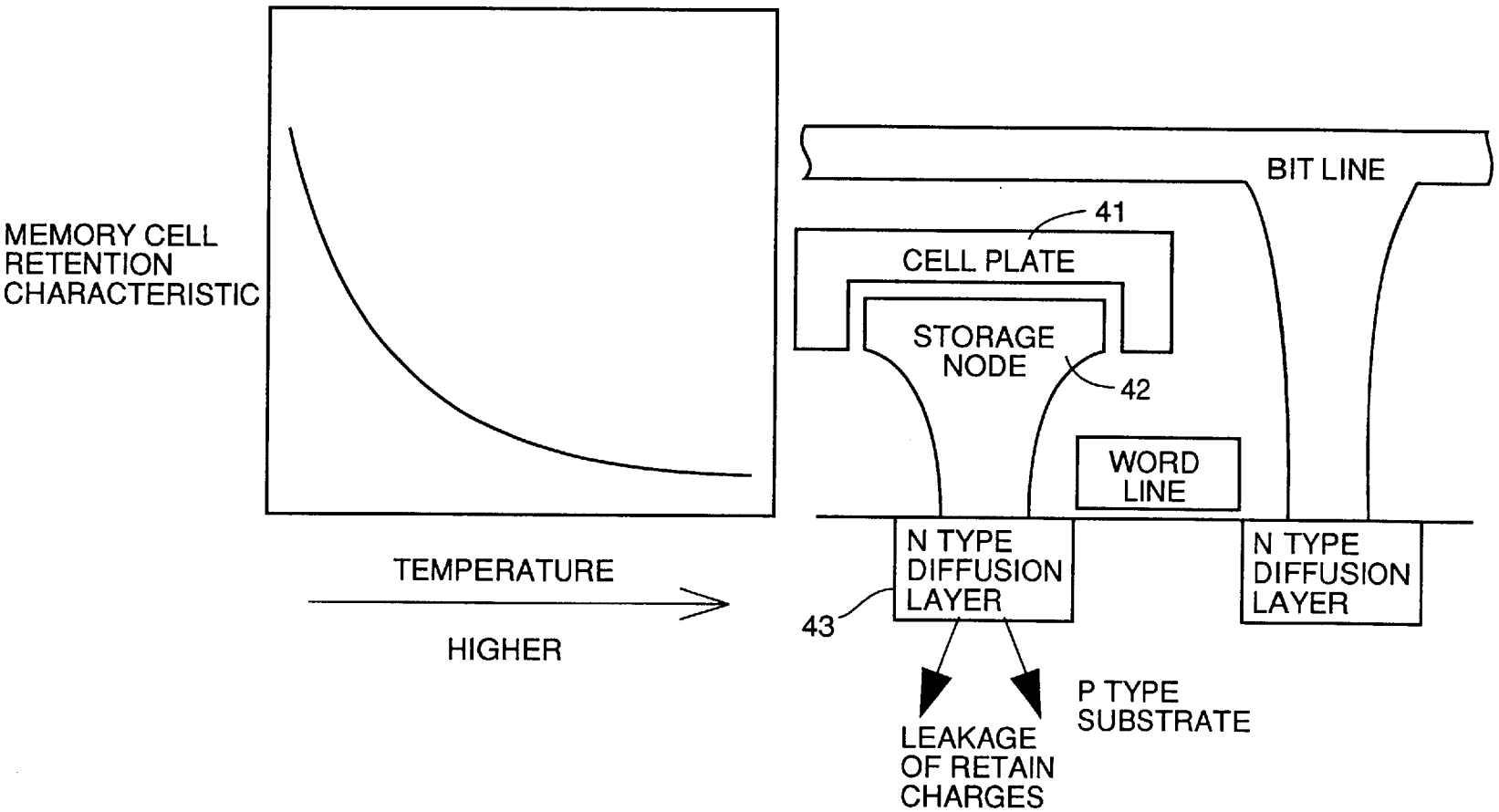
FIG.59 PRIOR ART
FIG. 59 is a diagram illustrating the reason why retained charges leak in a conventional DRAM.
Figure 60A:
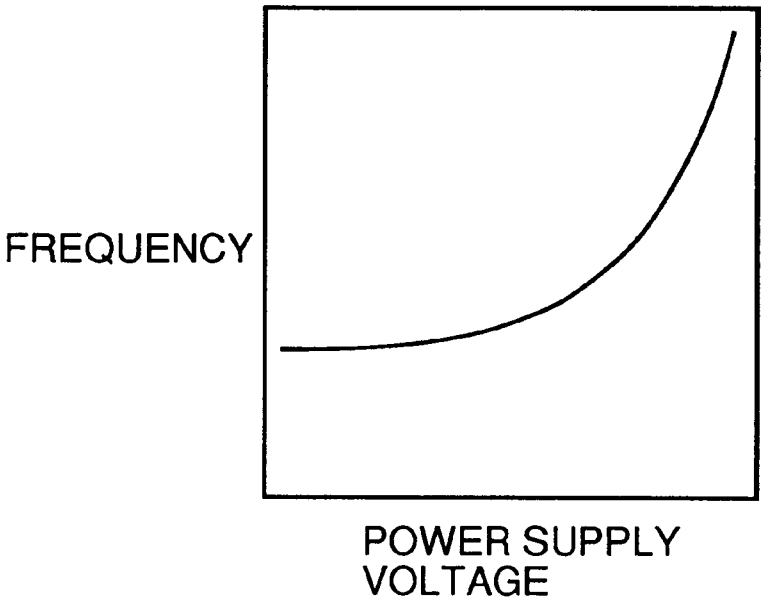
FIG.60A PRIOR ART
FIG. 60A is a diagram showing characteristics of a power supply voltage to a frequency in a conventional timer circuit.
Figure 60B:
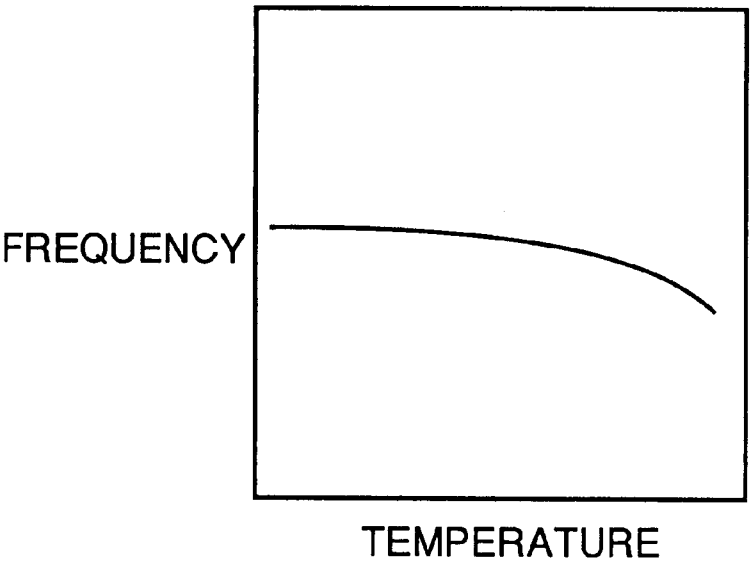
FIG.60B PRIOR ART
FIG. 60B is a diagram showing characteristics of a temperature to a frequency in a conventional timer circuit.

FIG. 22 is a circuit diagram showing a ring oscillator constituted by an inverter shown in FIG. 21. In the ring oscillator shown in FIG. 22, the odd number of stages 61–65 of the inverters shown in FIG. 21 are provided, the gates of p channel transistor 52 and n channel transistor 53 are connected, as one gate input, to an output of an inverter in the previous stage, and the gates of p channel transistor 51 and n channel transistor 54 are connected to an output of an inverter in the second previous stage. In the ring oscillator arranged as described above, although two gate input signals input to each of inverters 61–65 have the same phase, each inverter can receive an output earlier from the inverter in the second previous stage than from the inverter in the previous stage. Furthermore, since operation current of each inverter is restricted by the transistors for current control, that is, p channel transistor 59 and n channel transistor 60, a regular oscillation frequency can be obtained. In addition, through current can be prevented from flowing by control of a clock inverter, and an output can be prevented from being in a floating state by applying small current to the gates of p channel transistor 55 and n channel transistor 56, whereby the minimum amount of current required can be used, resulting in a ring oscillator having small power consumption. Furthermore, combination of this ring oscillator and the current generating circuit shown in FIG. 4 enables an oscillation frequency determined by current to be increased at a high temperature, and therefore, an oscillation frequency for realizing a refresh interval adapted to the refresh characteristic can be obtained if the ring oscillator of the present embodiment is used for timer 3 shown in FIG. 56.

Figure 23:
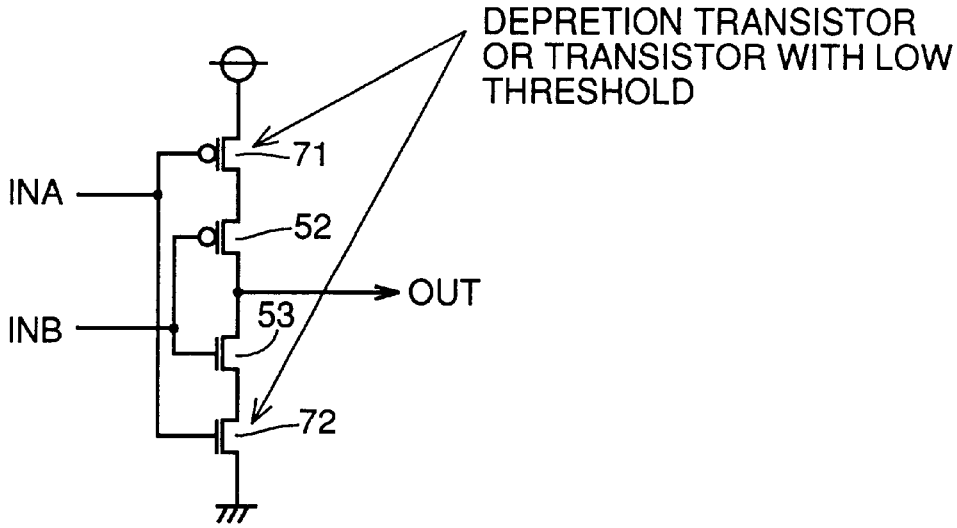
FIG. 23 is a diagram showing a modification of the inverter accordance with the embodiment of the present invention.

FIG. 23 is a diagram showing a modification of an inverter in accordance with the above-mentioned another embodiment of the present invention. In FIG. 23, a depletion transistor or a transistor having a low threshold is used for both a p channel transistor 71 connected to a p channel transistor 52 and an n channel transistor 72 connected to an n channel transistor 53. In the case of using a depletion transistor, current leaks even if a circuit is cut off with change of a clock signal INA, and therefore, an output can be prevented from being in a floating state. The use of a transistor with a low threshold is equivalent to the fact that leak current exists with the gate being off, and therefore, an output can be prevented from being in a floating state. In the present embodiment, an inverter can be constituted by four transistor elements, whereby a layout area can be reduced.

Figure 24:
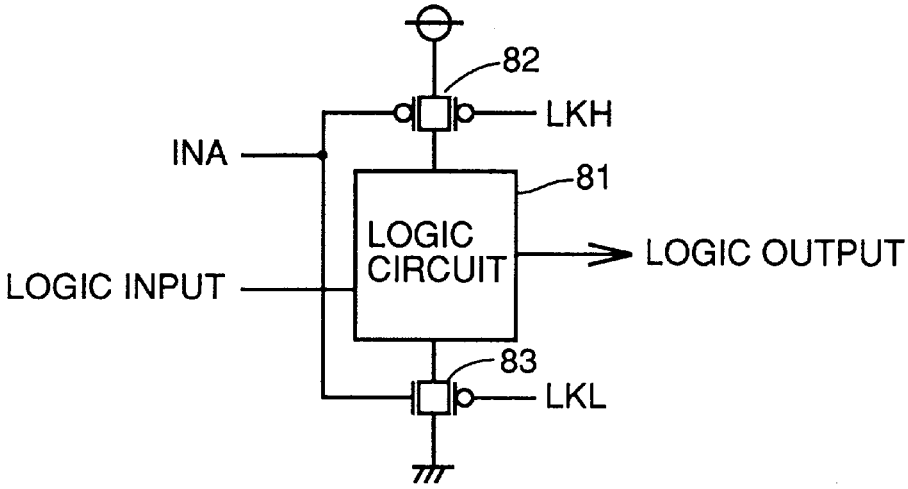
FIG. 24 is a diagram showing an embodiment in which the present invention is used for another logic circuit.

FIG. 24 is a diagram showing an example in which another logic circuit is constituted to have small power consumption. More specifically, a transfer gate 82 consisting of p channel transistors is connected to the side of a power supply of a logic circuit 81, and a transfer gate 83 consisting of n channel transistors is connected to the side of the ground thereof. A clock signal INA is applied to one input of each of transfer gates 82 and 83, and an LKH signal and an LKL signal are applied to the other input of transfer gate 82 and the other input of transfer 83, respectively. Thus, through current can be prevented from flowing into logic circuit 81, and a logic circuit with small current consumption can be constituted.

Figure 25:
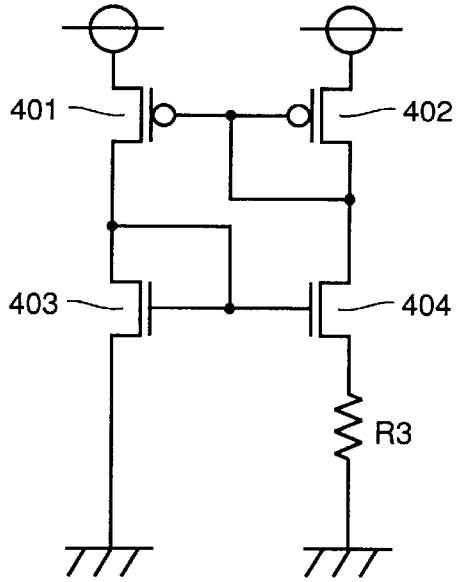
FIG. 25 is a diagram showing a current mirror circuit included in a reference potential generating circuit shown in FIG. 10A.

FIG. 25 is a diagram showing the current mirror circuits included in the reference potential generating circuit shown in FIG. 9B. Although the current mirror circuits are cross-coupled to each other in this circuit, there exists a feedback loop from the drain to the gate of a p channel transistor 402.

Therefore, if noise is introduced at the time of turning on a power supply and the source and the gate of each of p channel transistors 401 and 402 have the same potential, for example, current will not flow from the source to the drain thereof, so that current might deadlock.

An embodiment in which the deadlock as described above is eliminated and a power supply is stabilized will now be described.

Figure 26:
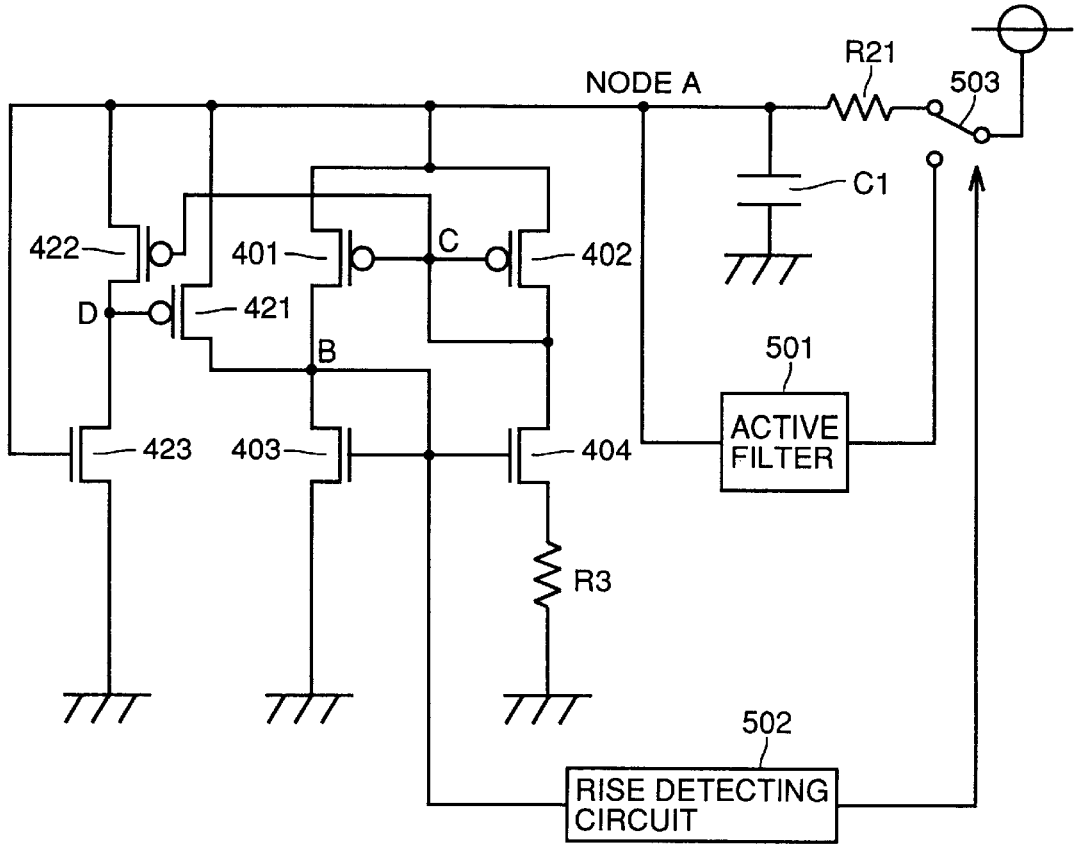
FIG. 26 is a diagram showing a current generating circuit with a power supply being stabilized.

FIG. 26 is a diagram showing a current generating circuit with a power supply being stabilized. In FIG. 26, a passive filter consisting of a resistance R21 and a capacitor C1 and an active filter 501 are connected in parallel between respective sources of p channel transistors 401 and 402 and a switch 503. Capacitor C1 is made to have a small capacitance value in order to reduce a layout area. The power supply voltage is applied to a common connection point of switch 503. An input of a rise detecting circuit 502 is connected to respective gates of n channel transistors 403 and 404, and an output of this detecting circuit 502 is applied to switch 503 as a switching signal.

In addition, a start up circuit consisting of p channel transistors 421 and 422 and an n channel transistor 423 is provided. The p channel transistor 421 has its drain connected to a node B, its source connected to a node A, and its gate connected to the drain of p channel transistor 422 and the drain of n channel transistor 423 (i.e. a node D). The source of p channel transistor 422 and the gate of n channel transistor 423 are connected to node A. The gate of p channel transistor 422 is connected to a node C.

Current does not flow into the start up circuit when the current generating circuit does not operate, and therefore, a potential on node B is close to the ground, and a potential on node C is close to the power supply. The operation of the circuit is started by forcibly applying current to node B. The n channel transistor 423 applies small current such as 1 $\mu$A at all times.

Prior to the start of the operation of the current generating circuit, a potential on node B is close to the power supply and p channel transistor 422 does not apply current, and therefore, a potential on node D is close to the ground. Accordingly, p channel transistor 421 is rendered conductive and applies current to node B.

When the current generating circuit starts its operation, a potential on node B is lower than the power supply potential by a threshold voltage, and therefore, p channel transistor 422 is rendered conductive and current therein is larger than that in n channel transistor 423, so that the potential on node D is close to the power supply. In addition, p channel transistor 421 is rendered non-conductive, and current supply to node B is stopped.

Figure 27:
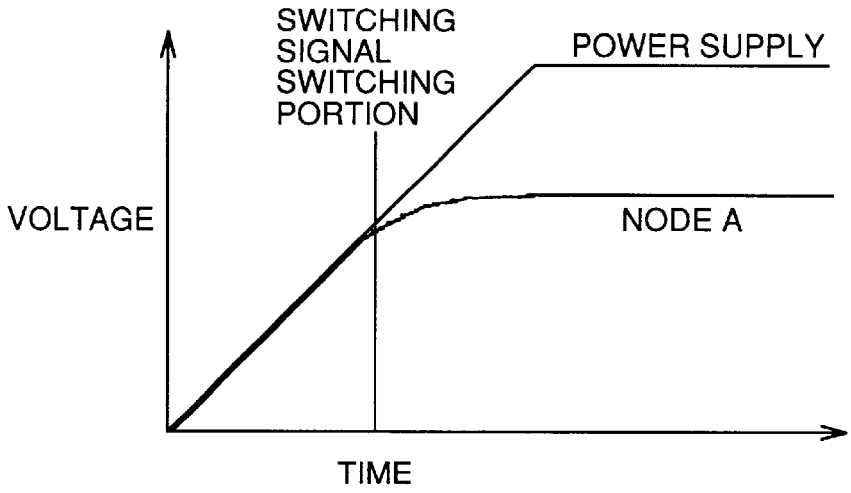
FIG. 27 is a diagram showing rising characteristics of a voltage of the current generating circuit shown in FIG. 26.

FIG. 27 is a diagram showing rising characteristics of a voltage of the current generating circuit shown in FIG. 26. At the time of turning on the power supply, switch 503 is switched to the side of the passive filter consisting of resistance R21 and capacitor C1, and capacitor C1 has a small capacitance, and therefore, the power supply is activated quickly at the time of turning on the power supply. As a result, characteristics in turning on the power supply can be improved.

On the other hand, when the power supply has been activated to some degree and an internal circuit begins to operate normally, rise detecting circuit 502 detects a fixed rising voltage and causes switch 503 to switch to the side of active filter 501. As a result, active filter 501 is activated and can deal with noise during operation of the internal circuit. Consequently, frequency response to noise can be improved by active filter 501.

Figure 28:
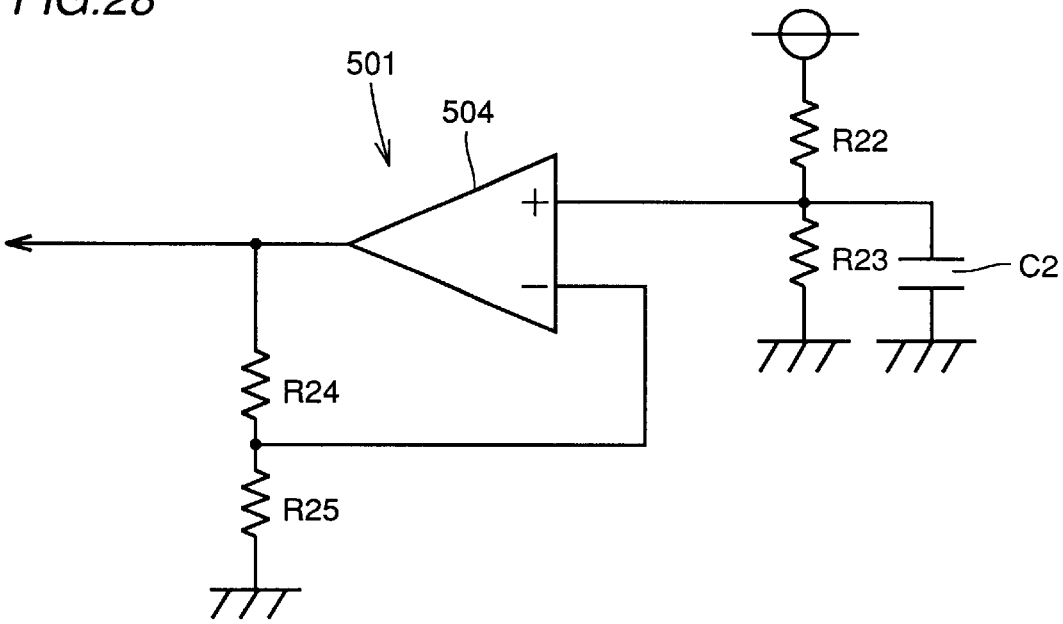
FIG. 28 is a circuit diagram showing an example of an active filter shown in FIG. 26.

FIG. 28 is a diagram showing a specific example of the active filter shown in FIG. 26. In FIG. 28, active filter 501 includes a comparator 504, a reference potential obtained by dividing the power supply voltage by resistances R22 and R23 is applied to a reference input terminal thereof. The power supply voltage is applied through switch 503 of FIG. 26 to resistance R22. A capacitor C2 is connected in parallel to resistance R23. A voltage obtained by dividing an output voltage of comparator 504 by resistances R24 and R25 is applied to a comparison input terminal of comparator 504. Since such an active filter 501 has been known, description of the operation thereof will not be repeated.

Figure 29:
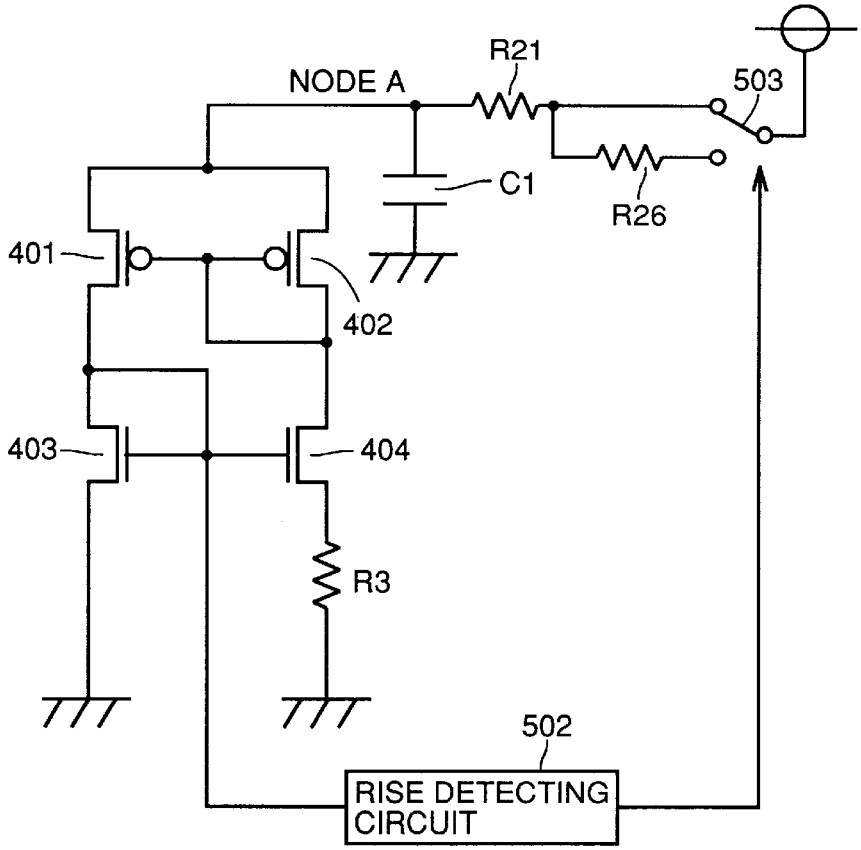
FIG. 29 is a circuit diagram showing a modification of the current generating circuit shown in FIG. 26.

FIG. 29 is a diagram showing a modification of the current generating circuit shown in FIG. 26. In the current generating circuit shown in FIG. 29, a resistance R26 instead of active filter 501 shown in FIG. 26 is connected in series to a resistance R21 after turning on the power supply.

Figure 30:
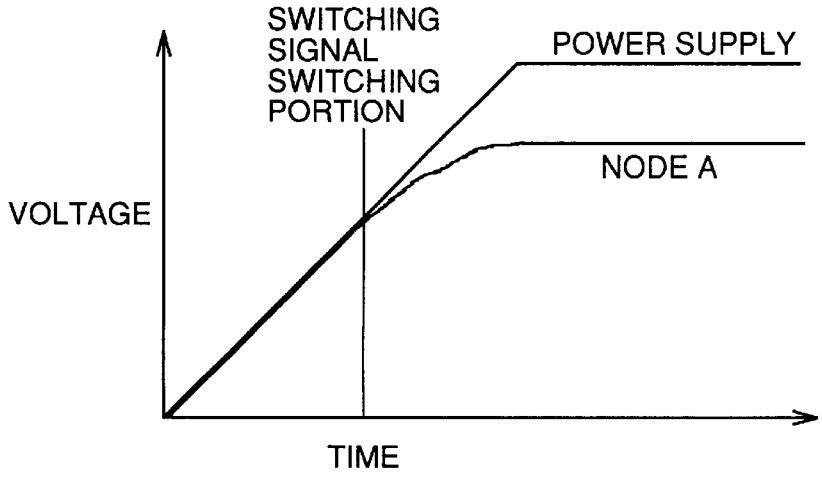
FIG. 30 is a diagram showing rising characteristics of a voltage of the current generating circuit shown in FIG. 29.

FIG. 30 is a diagram showing rising characteristics of a voltage of the current generating circuit shown in FIG. 29.

Frequency characteristics of an RC filter is different according to selection of a resistance value thereof and a value of a capacitor. Accordingly, frequency characteristics of noise removal can be improved even if the resistance value is increased. In this case, although a power supply potential of an internal circuit is reduced due to operating current of the internal circuit by voltage drop caused by resistance, it does not matter for a circuit with very small current consumption. If the resistance value is large at the time of activating the power supply, response might be delayed in the case where high speed property is required such as at the time of activating the power supply.

Then, as shown in FIG. 29, at the beginning of activating the power supply, switch 503 is made to switch to the side of resistance R21 and the filter consisting of resistance R21 and capacitor C1 is activated, so that characteristics in turning on the power supply is improved as shown in FIG. 30. On the other hand, a rise detecting circuit 502 detects the fact that the power supply has been activated to some degree and that an internal circuit has begun to operate normally, switch 503 is made to switch to the side of resistance R26 and a resistance value thereof is increased, making it possible to deal with noise during operation of the internal circuit.

Figure 31:
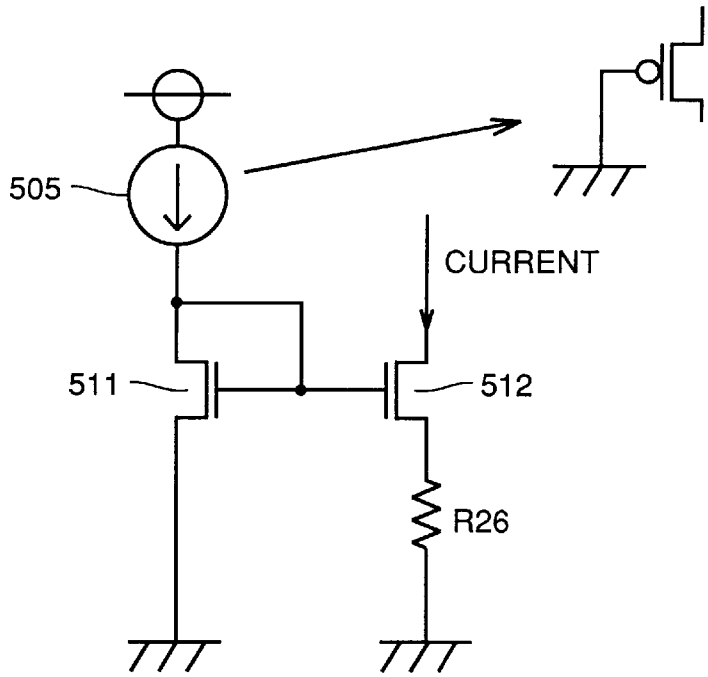
FIG. 31 is a diagram showing a reference current generating circuit in accordance with the present invention.

FIG. 31 is a diagram showing a reference current generating circuit in accordance with the present invention. In FIG. 31, a current mirror circuit is constituted by n channel transistors 511 and 512, the drain and the gate of n channel transistor 511 are diode-connected to each other, and a current source constituted by, for example, a p channel transistor is connected to the drain of n channel transistor 511. A resistance R26 is connected between the source of n channel transistor 512 and the ground. In this structure, there is any difference between n channel transistors 511 and 512. For example, these n channel transistors may be different from each other in a threshold value or a channel width.

Arbitrary current depending on the power supply voltage flows from current source 505 into n channel transistor 511, whereby potential difference is produced between the gate of n channel transistor 511 and the ground according to the amount of current flowing therein. An equivalent potential is produced between the gate of n channel transistor 512 and the ground. In this case, n channel transistor 512 is made different from n channel transistor 511 in that a threshold voltage of n channel transistor 512 is smaller than that of n channel transistor 511, in that a channel width of n channel transistor 512 is larger than that of n channel transistor 511, or the like. Accordingly, a potential between the gate and the source of n channel transistor 512 is smaller than that of n channel transistor 511. This appears as a potential difference between n channel transistors 511 and 512. This potential difference is applied to resistance R26, whereby current is obtained. In this case, resistance R26 may be a pure resistance component, or may be a parasitic resistance using a channel component of a transistor. In addition, if temperature characteristics of the potential difference between the gate and the source of n channel transistor 511 and n channel transistor 512 and temperature characteristics of resistance R26 are combined appropriately, current generated can be made to have appropriate temperature characteristics.

Figure 32:
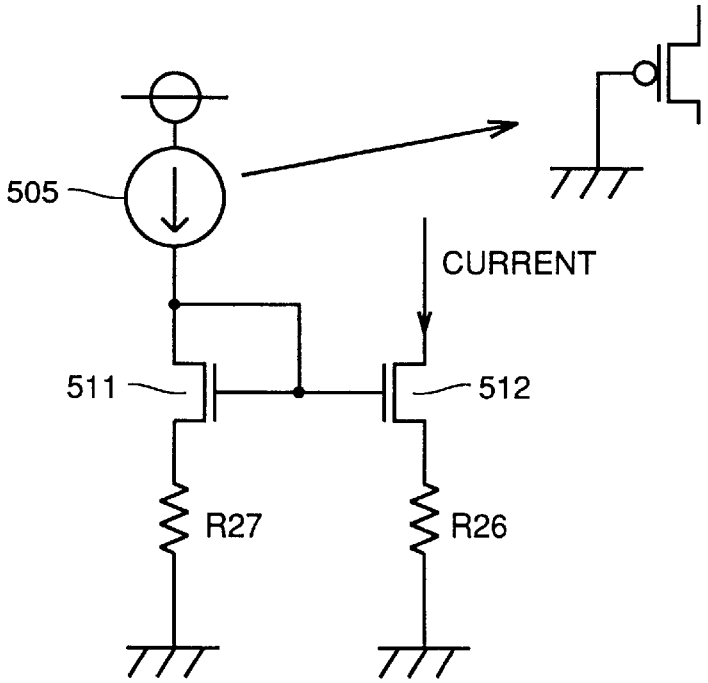
FIG. 32 is a diagram showing a modification of the reference current generating circuit shown in FIG. 31.

FIG. 32 is a diagram showing a modification of the reference current generating circuit shown in FIG. 31. In the example shown in FIG. 32, a resistance R27 is also connected to the source of an n channel transistor 511. The source of n channel transistor 511 floats up with respect to the ground potential due to voltage drop generated by current flowing therein and a component of resistance R27. Accordingly, the potential difference generated at both ends of resistance R26 shown in FIG. 31 is eliminated, and the amount of current generated in resistance R27 is increased. In the example shown in FIG. 32, if resistances R26 and R27 are made different from each other in component material and in temperature dependency, current generated can be made to have appropriate temperature dependency.

Figure 33:
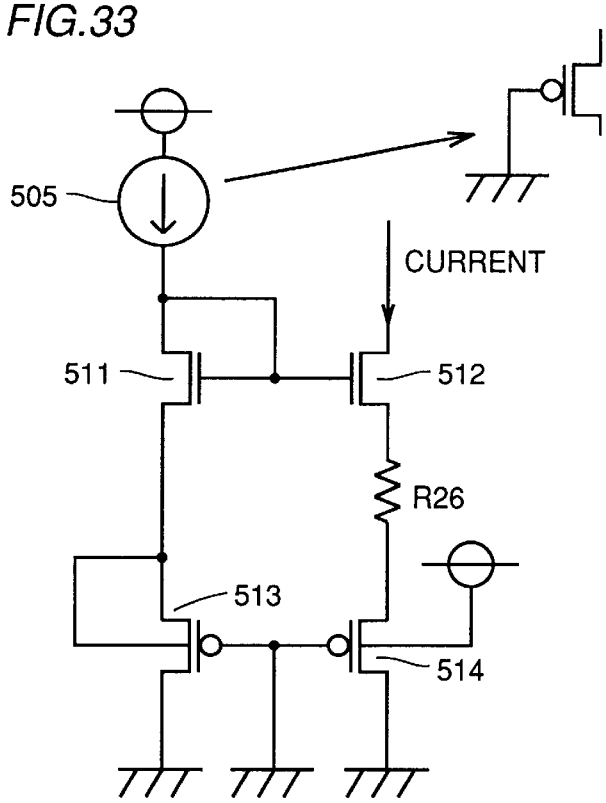
FIG. 33 is a circuit diagram showing another modification of the reference current generating circuit shown in FIG. 31.

FIG. 33 is a diagram showing another modification of the reference potential generating circuit shown in FIG. 31. In the example shown in FIG. 33, a p channel transistor 513 is connected between an n channel transistor 511 and the ground, a p channel transistor 514 is connected between a resistance R26 and the ground, and voltage dependency is provided by means of a channel resistance. A substrate potential of p channel transistor 513 is connected to a source potential thereof, and a substrate potential of p channel transistor 514 is connected to a power supply potential. Accordingly, the lower the power supply potential is, the closer respective substrate potentials of p channel transistors 513 and 514 are and the closer respective threshold values thereof are. However, if the power supply potential is increased, respective substrate potentials of p channel transistors 513 and 514 becomes significantly different from each other, and respective threshold values thereof are different from each other due to the difference in the backgate effect caused by the difference between the substrate potentials, whereby voltage dependency of current generated by a potential difference between the gate and the source of n channel transistor 511 is different from that of current generated by a potential difference between the gate and the source of n channel transistor 512.

In the example shown in FIG. 33, although the potential between the gate and the source of n channel transistor 512 is originally large, a threshold value of p channel transistor 514 becomes larger than that of p channel transistor 513 with increase in the power supply voltage, and therefore, a potential difference generated between both ends of resistance R26 is reduced, and current generated will be subject to power supply voltage dependency. Current generated is reduced if the power supply voltage is increased in this case, while current generated is increased if the power supply voltage is increased in the case of the reverse combination. At this time, since current generated by the first p channel transistor has power supply voltage dependency, this current will be offset, so that current which does not have power supply voltage dependency can be produced with appropriate setting of a parameter.

Figure 34:
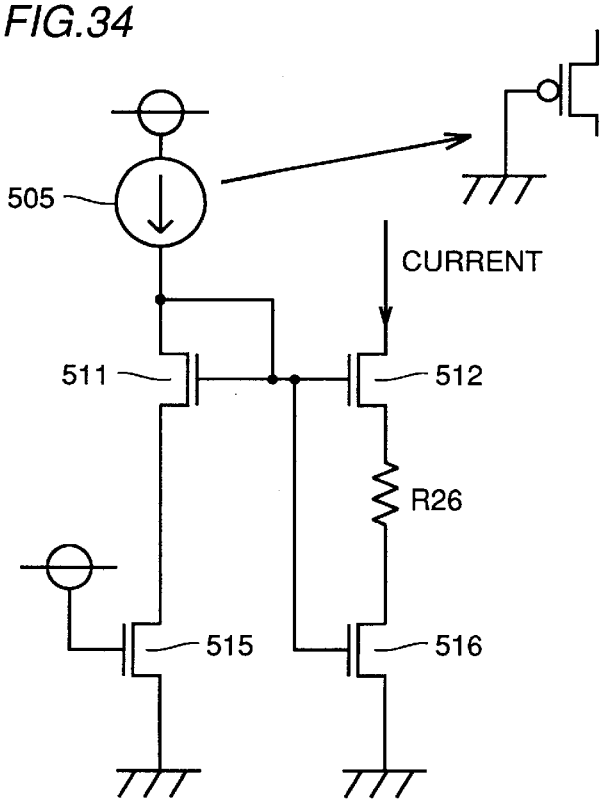
FIG. 34 is a circuit diagram showing another example of a current generating circuit using a channel resistance component of a transistor.

FIG. 34 is a diagram showing another example of the current generating circuit using a channel resistance component of a transistor. In FIG. 34, an n channel transistor 515 is connected between an n channel transistor 511 and the ground, and an n channel transistor 516 is connected between a resistance R26 and the ground. These n channel transistors 515 and 516 are different from each other in a gate potential. At this time, n channel transistor 515 has its gate connected to a power supply potential, and n channel transistor 516 has its gate connected to respective gate potentials of n channel transistors 511 and 512. Consequently, although channel resistance of n channel transistor 516 does not change significantly, channel resistance of n channel transistor 515 is subject to power supply voltage dependency, and therefore, the higher the power supply voltage is, the smaller the channel resistance is. Accordingly, the higher the power supply voltage is, the smaller a potential difference between both ends of resistance R26 is, so that current generated is reduced. In this case, since current generated by the first p channel transistor has power supply voltage dependency, current will be offset, so that current which does not have power supply voltage dependency can be produced with appropriate setting of a parameter.

Figure 35:
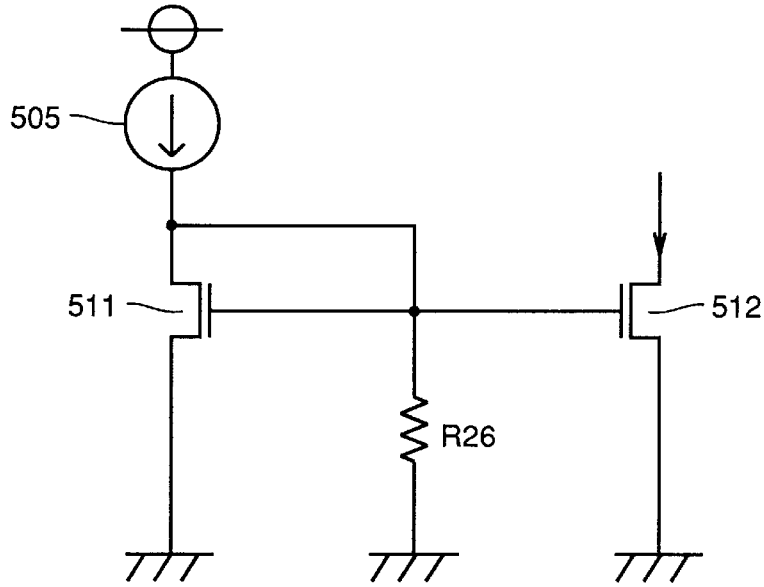
FIG. 35 is a circuit diagram showing a reference current generating circuit constituted by a diode-connected n channel transistor and a resistance.

FIG. 35 is a diagram showing a reference current generating circuit constitute by a diode-connected n channel transistor and a resistance. In FIG. 35, an n channel transistor 511 is diode-connected, and a resistance R26 is connected between the ground and respective gates of n channel transistors 511 and 512. In FIG. 35, if current flows into this circuit, the current is divided into current flowing into n channel transistor 511 and current flowing into resistance R26. Since n channel transistor 511 is diode-connected, a voltage having a value of about a threshold value thereof is generated between the gate thereof and the ground. In addition, since this voltage corresponds to a voltage at both ends of resistance R26, current according to this voltage flows also into resistance R26. If a parameter is set so that the sum of these currents is equal to the current flowing into the circuit, current generated on the side of n channel transistor 512 can be extracted.

Figure 36:
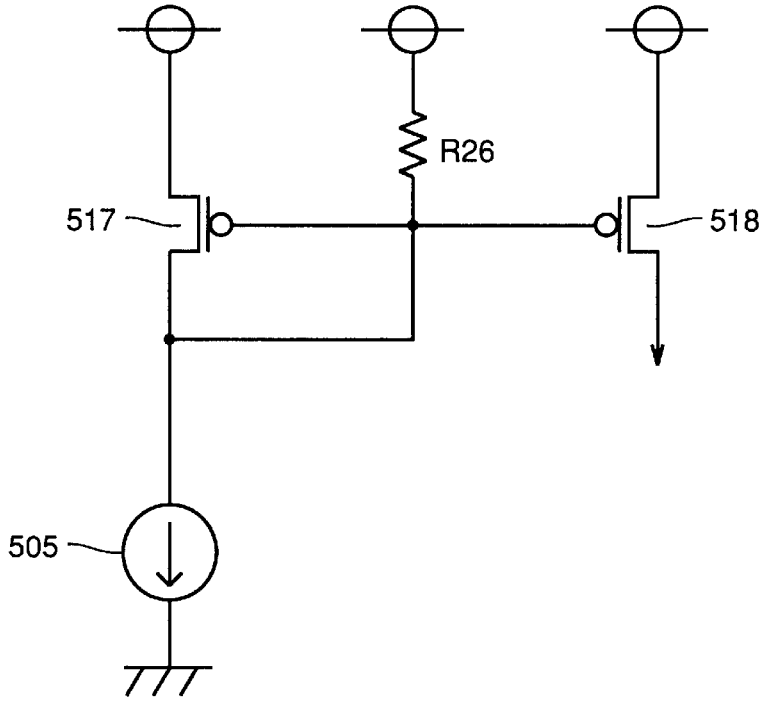
FIG. 36 is a circuit diagram showing an example in which the reference current generating circuit shown in FIG. 35 is constituted by p channel transistors.

FIG. 36 is an example in which n channel transistors 511 and 512 shown in FIG. 35 are replaced with p channel transistors 517 and 518, respectively, and the operation thereof is the same as that of FIG. 35.

Figure 37:
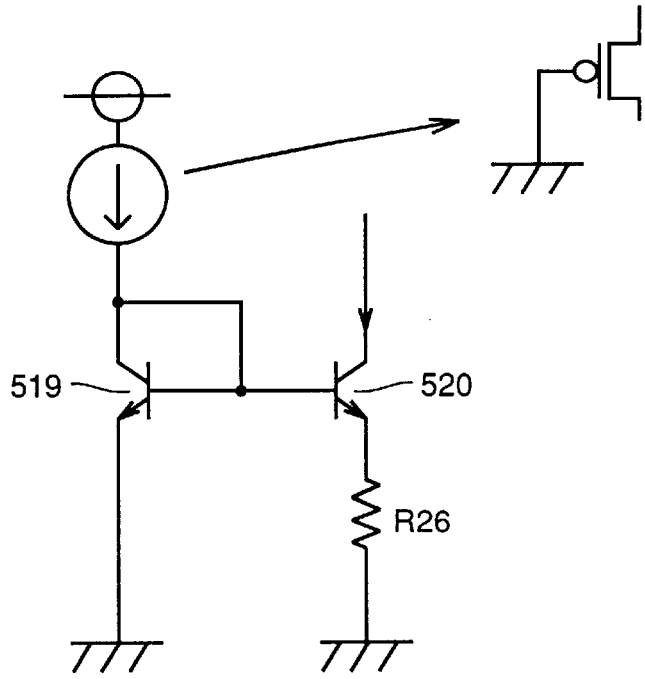
FIG. 37 s a circuit diagram showing an example of the reference current generating circuit shown in FIG. 31 in which n channel transistors thereof are replaced with bipolar transistors.

FIG. 37 shows a reference current generating circuit constituted by bipolar transistors 519 and 520 instead of n channel transistors 511 and 512 of the reference current generating circuit shown in FIG. 31, respectively, and the operation thereof is the same as that of FIG. 31.

Figure 38:
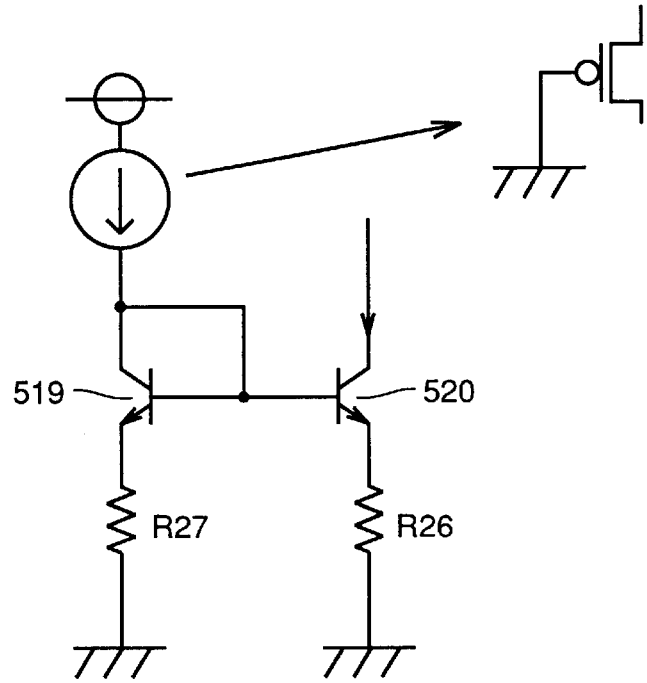
FIG. 38 is a circuit diagram showing an example of the reference current generating circuit shown in FIG. 32 in which n channel transistors thereof are replaced with bipolar transistors.

FIG. 38 shows a reference current generating circuit constituted by bipolar transistors 519 and 520 instead of n channel transistors 511 and 512 of the reference current generating circuit shown in FIG. 32, respectively, and the operation thereof is the same as that of FIG. 32.

Figure 39:
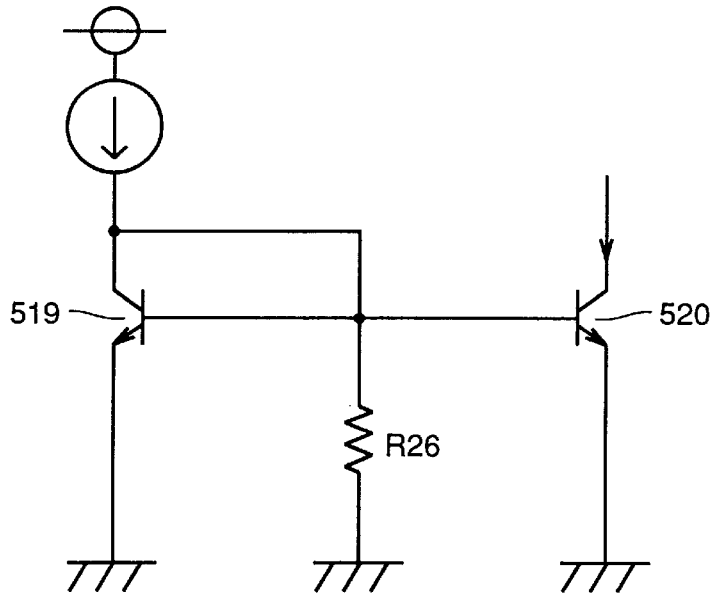
FIG. 39 is a circuit diagram showing an example of the reference current generating circuit shown in FIG. 35 in which n channel transistors thereof are replaced with bipolar transistors.

FIG. 39 shows a reference current generating circuit constituted by bipolar transistors 519 and 520 instead of n channel transistors 511 and 512 of the reference current generating circuit shown in FIG. 35, respectively, and the operation thereof is the same as that of FIG. 35.

Figure 40:
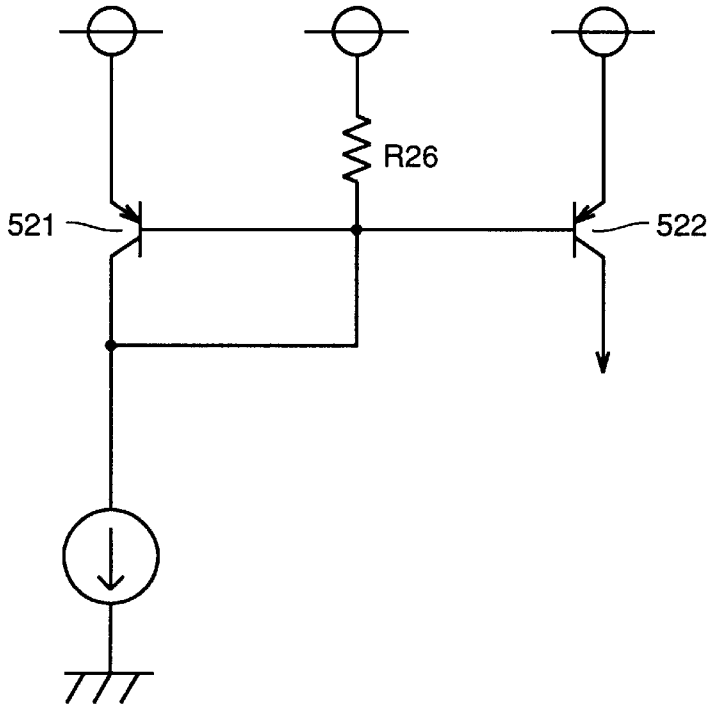
FIG. 40 a circuit diagram showing an example of the reference current generating circuit shown in FIG. 36 in which p channel transistors thereof are replaced with bipolar transistors.

FIG. 40 shows a reference current generating circuit constituted by bipolar transistors 521 and 522 instead of p channel transistors 517 and 518 of the reference current generating circuit shown in FIG. 36, respectively, and the operation thereof is the same as that of FIG. 36.

Figure 41:
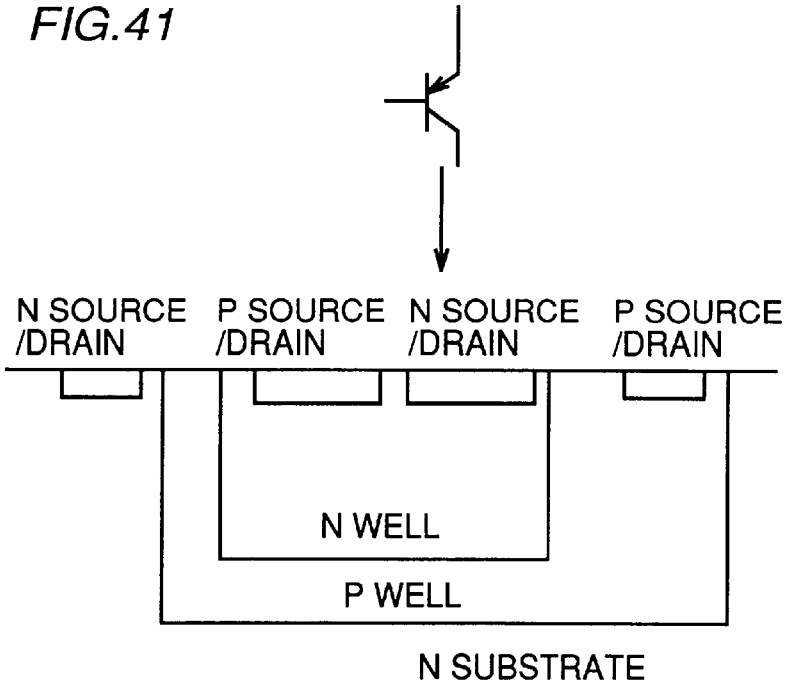
FIG. 41 is a diagram showing a triple well structure constituting bipolar transistor shown in FIG. 40.
Figure 42:
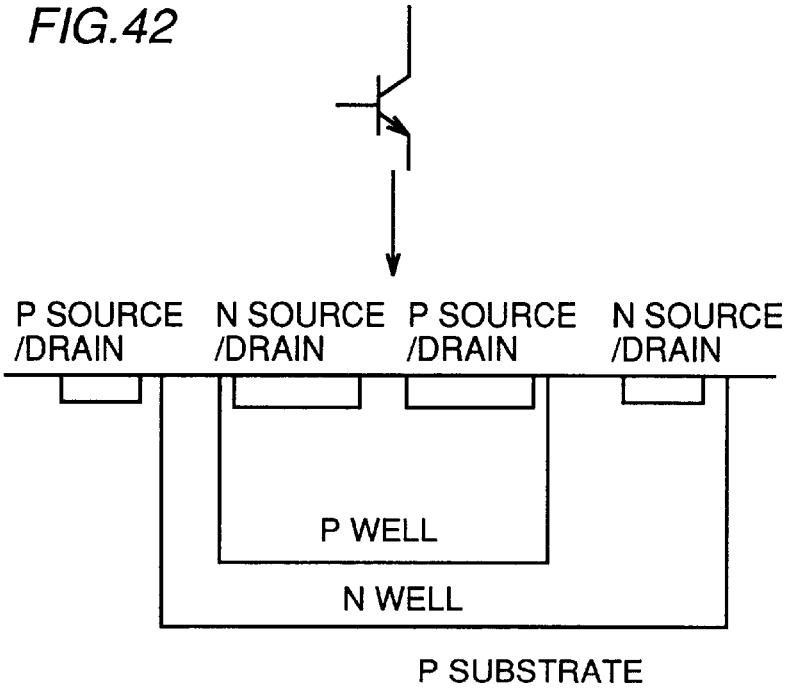
FIG. 42 is a,diagram showing a triple well structure constituting bipolar transistor shown in FIGS. 37 to 39.

FIG. 41 is a diagram showing a triple well structure constituting PNP type bipolar transistors 521 and 522 shown in FIG. 40, and FIG. 42 is a diagram showing a triple well structure constituting NPN type bipolar transistors 519 and 520 shown in FIGS. 37 to 39.

A PNP transistor can be constituted by a triple well structure consisting of an N substrate, a P well and an N well as shown in FIG. 41, and an NPN transistor can be constituted by a triple well structure consisting of a P substrate, an N well and a P well as shown in FIG. 42.

Figure 43:
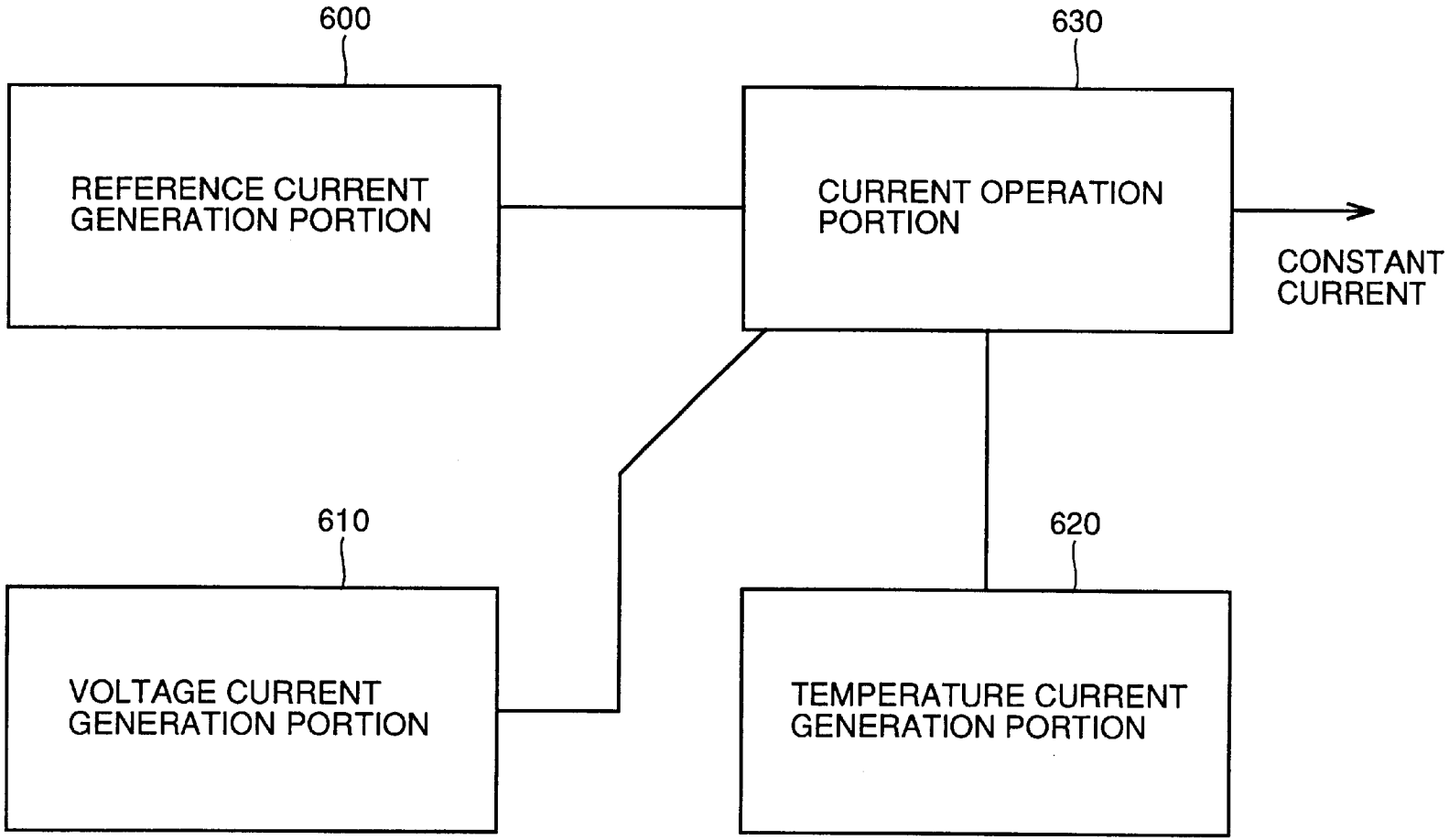
FIG. 43 is a block diagram showing a constant current generating circuit.
Figure 44:
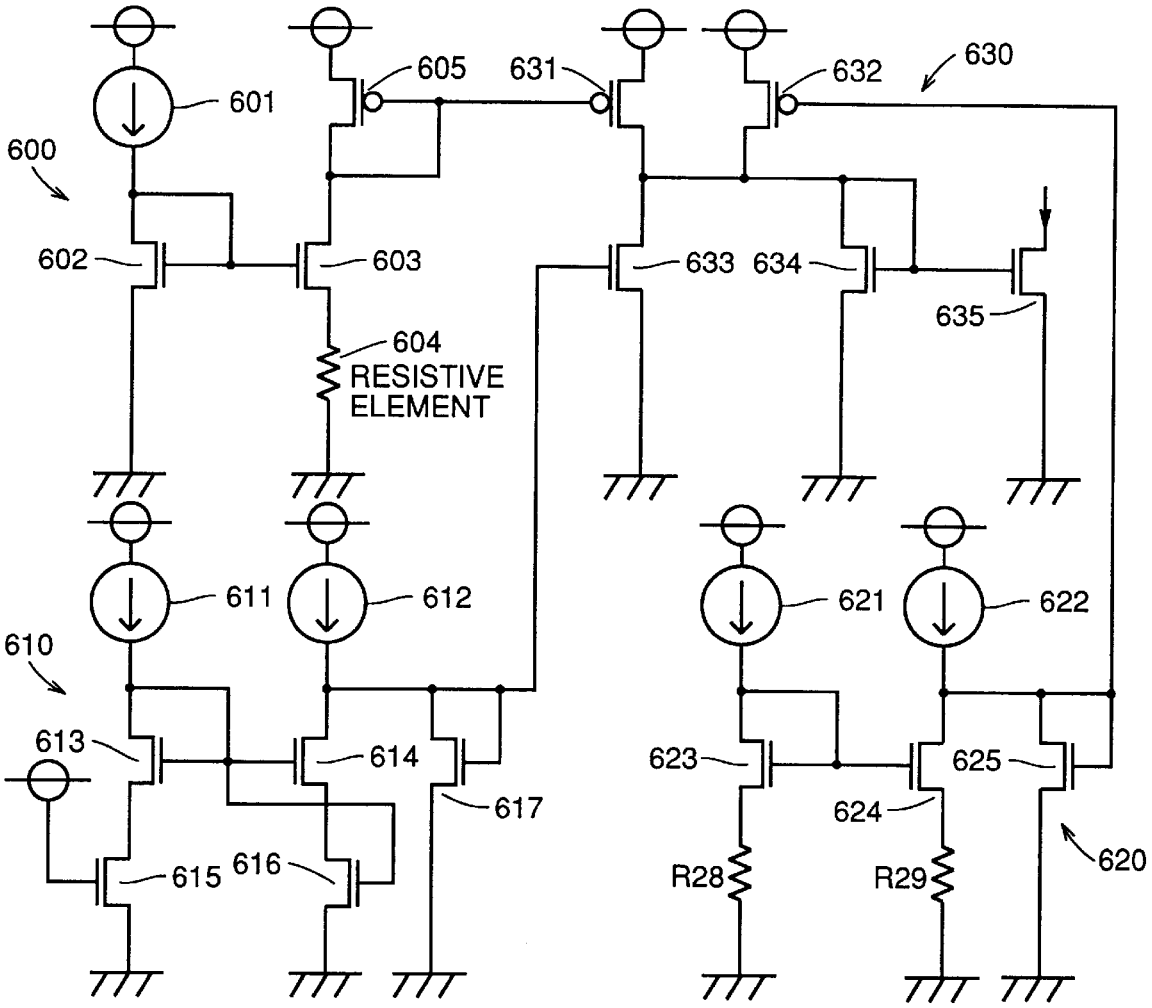
FIG. 44 is a specific circuit diagram of the constant current generating circuit.

FIG. 43 is a block diagram of a constant current generating circuit, and FIG. 44 is a specific circuit diagram thereof.

In FIG. 43, the constant current generating circuit is constituted by a reference current generation portion 600 for generating reference current, a voltage current generation portion 610 made to have voltage dependency intentionally, a temperature current generation portion 620 made to have temperature dependency intentionally, and a current operation portion 630 for performing operation of generated currents.

Reference current generation portion 600 is constituted by a constant current source 601, n channel transistors 602 and 603, and a resistance 604 as shown in FIG. 44, and carries out the same operation as that of FIG. 31 described above to generate reference current. Voltage current generation portion 610 is constituted by constant current sources 611 and 612 and n channel transistors 613 to 616, and carries out approximately the same operation as that of FIG. 34. More specifically, since n channel transistor 615 of voltage current generation portion 610 has its gate connected to a power supply potential and n channel transistor 616 thereof has its gate connected to respective gates of n channel transistors 613 and 614, a channel resistance of n channel transistor 616 does not change significantly. However, a channel resistance of n channel transistor 615 is subject to power supply voltage dependency, and the channel resistance is reduced with increase in the power supply voltage. Accordingly, the larger the power supply voltage is, the smaller current generated is. Thus, voltage current generation portion 610 generates current which depends on a voltage.

Temperature current generation portion 620 includes constant current sources 621 and 622, n channel transistors 623 and 624, and resistances R28 and R29. Temperature current generation portion 620 can generate current having temperature dependency if resistances R28 and R29 are made different from each other in component material and in temperature dependency. Current operation portion 630 is constituted by p channel transistors 631 and 632, and n channel transistors 633, 634 and 635. Reference current generated in reference current generation portion 600 is applied through a diode-connected p channel transistor 605 to the gate of p channel transistor 631 of current operation portion 630, current generated in voltage current generation portion 610 is applied through a diode-connected n channel transistor 617 to the gate of n channel transistor 633 of current operation portion 630, current generated in temperature current generation portion 620 is applied through a diode-connected n channel transistor 625 to the gate of p channel transistor 632 of current operation portion 630, and operation of currents is performed by p channel transistors 631 and 632 and n channel transistor 633. In addition, constant current is generated from n channel transistor 635 through diode-connected n channel transistor 634.

Figure 45:
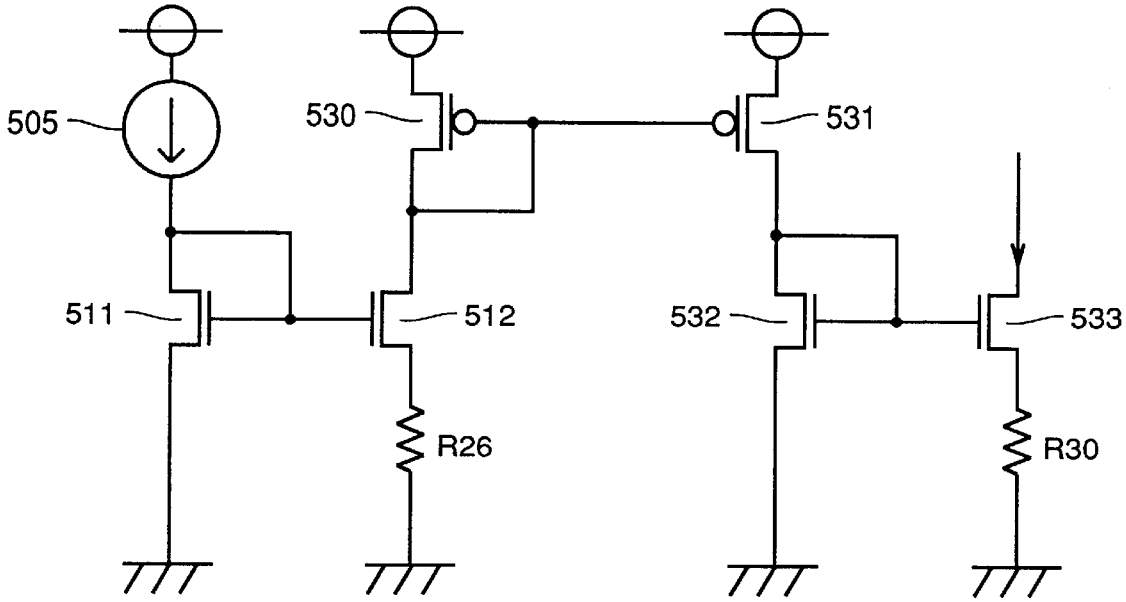
FIG. 45 a circuit diagram showing an example of the constant current generating circuit.

FIG. 45 is an electric circuit diagram showing an example of a constant current generating circuit. In this example, a plurality of stages of the reference current generating circuits shown in FIG. 31 are connected serially to each other to reduce voltage dependency. More specifically, a reference current generating circuit in the first stage is structured as in the case of FIG. 31, wherein a current mirror circuit constituted by p channel transistors 530 and 531 is connected to the drain of an n channel transistor 512, and p channel transistor 530 is diode-connected. A current mirror circuit constituted by n channel transistors 532 and 533 is connected to the drain of p channel transistor 531, and n channel transistor 532 is diode-connected. A resistance R30 is connected between the source of n channel transistor 533 and the ground.

In the constant current generating circuit shown in FIG. 45, it is a portion constituted by n channel transistors 532 and 533 and resistance R30 which generates actual current. However, voltage dependency of current generated in the reference current generating circuit itself in the first stage has been reduced and current from this reference current generating circuit in the first stage flows as driving current of the following stage, and therefore, voltage dependency can be further reduced.

Figure 46:
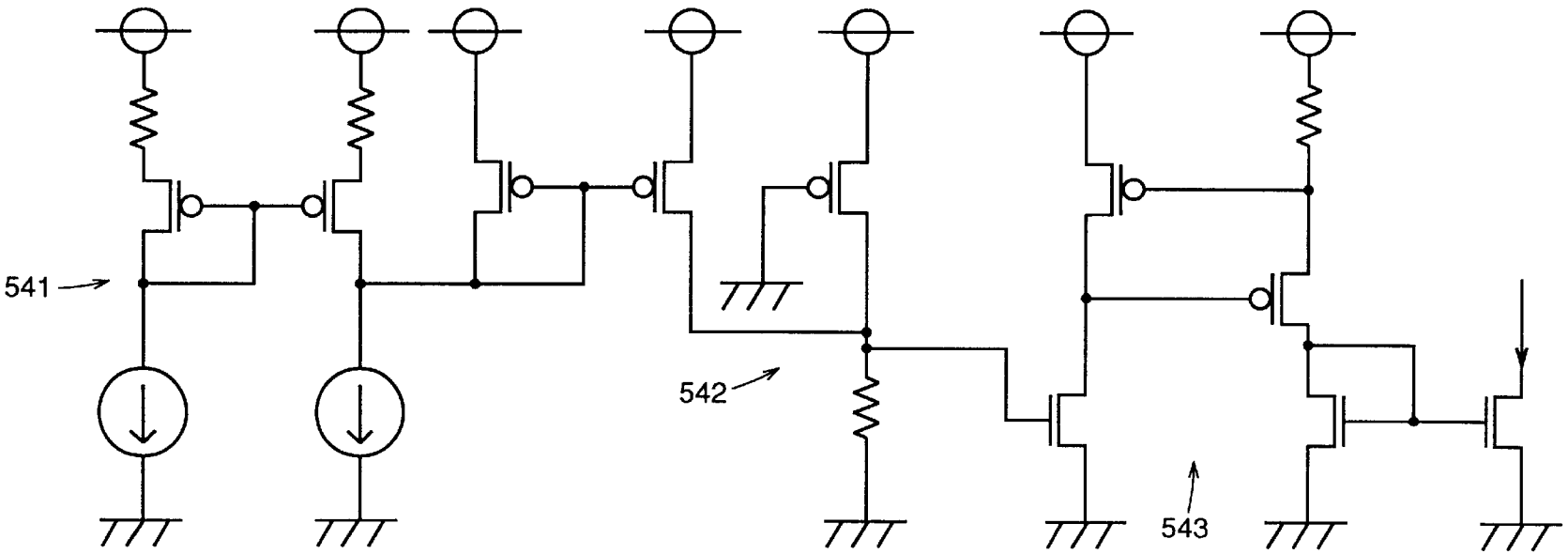
FIG. 46 is a circuit diagram showing another example of the constant current generating circuit.

FIG. 46 is a circuit diagram showing a further example of the constant current generating circuit. In the example shown in FIG. 46, a current generating circuit 541 having temperature dependency is provided in the first stage, a current generating circuit 542 having voltage dependency is provided in the second stage, and a constant current source 543 is provided in the third stage. In this example, both voltage dependency and temperature dependency can be reduced.

Figure 47:
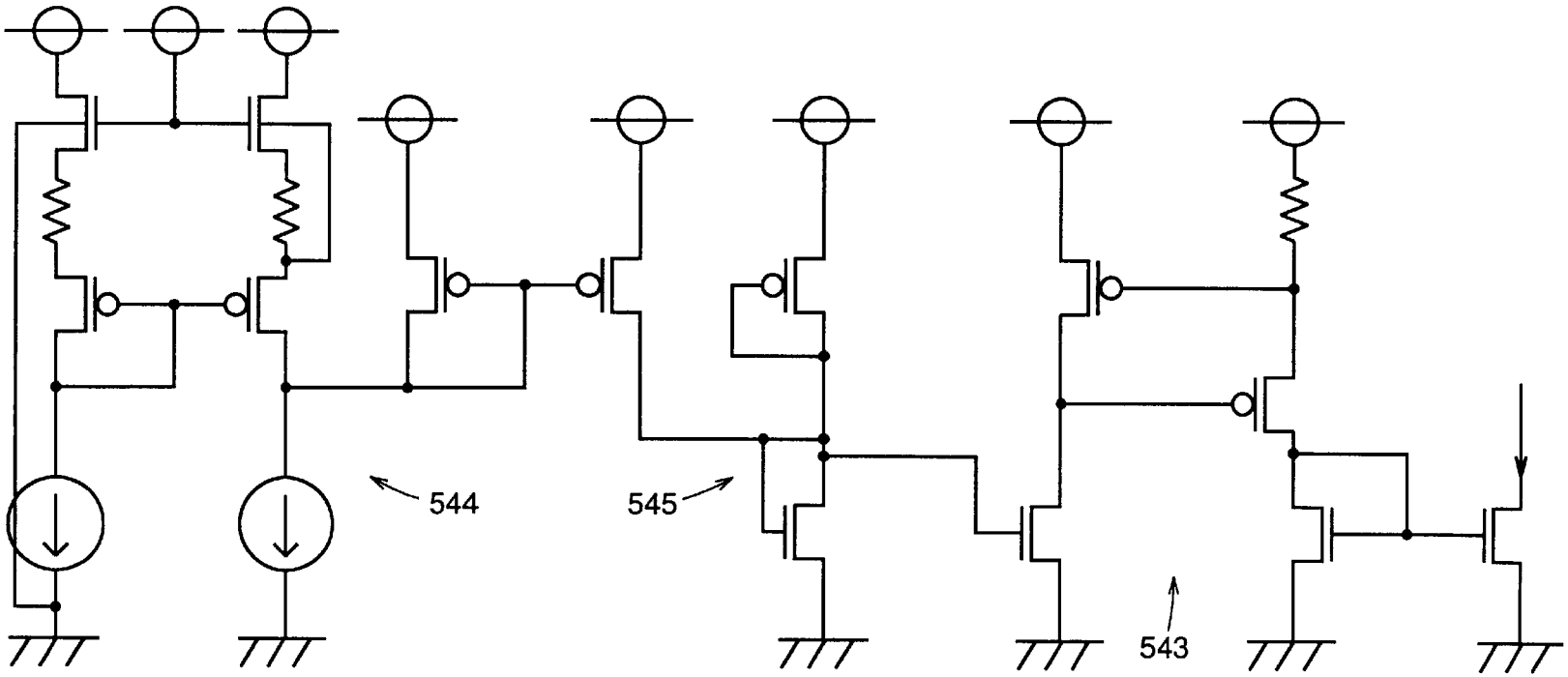
FIG. 47 is a circuit diagram showing a further example of the constant current generating circuit.

FIG. 47 is a circuit diagram showing a still further example of the constant current generating circuit. In this example as well, a current generating circuit 544 having temperature dependency in the first stage, a current generating circuit 545 having temperature dependency in the second stage, and a current source 543 in the third stage are cascade-connected to each other. In addition, current generating circuit 544 in the first stage can have not only temperature dependency but also voltage dependency by making substrate potentials thereof different from each other.

In FIGS. 45 to 47 described above, temperature dependency of constant current finally obtained is reduced by cascade-connecting a plurality of stages of reference current generating circuits to each other. In this case, since the reference current generating circuits have the same structure, change in characteristics due to variation in elements can be reduced, while a current mirror circuit must be inserted between reference current generating circuits. Accordingly, the number of circuit stages is increased, so that error between devices might be amplified and variation in constant current finally obtained might be large.

Figure 48:
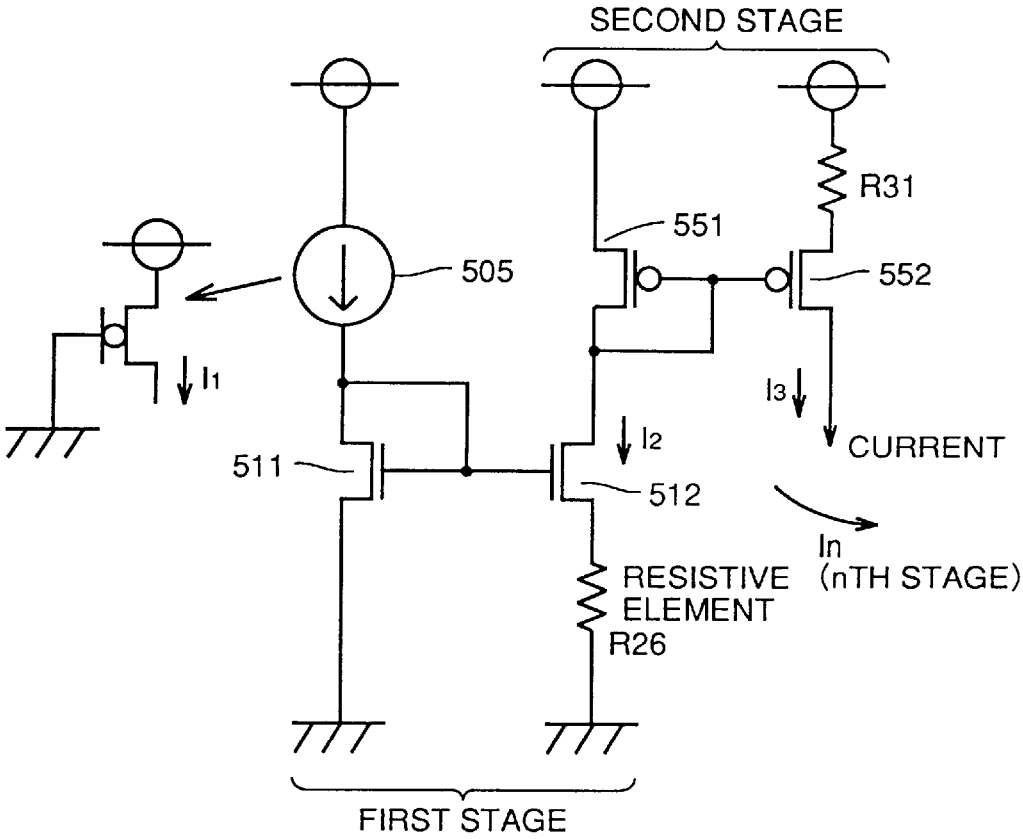
FIG. 48 is a circuit diagram showing a constant current generating circuit with the number of circuit stages being reduced.

FIG. 48 is a circuit diagram showing a constant current generating circuit with the number of circuit stages being reduced. A reference current generating circuit in the previous stage is structured as in the case of FIG. 31 described above. In addition, a current mirror circuit constituted by p channel transistors 551 and 552 is connected to the drain of an n channel transistor 512. The p channel transistor 551 is diode-connected, and a resistance R31 is connected between the source of p channel transistor 552 and a power supply potential. In FIG. 48, arbitrary current flows from a constant current source 505 into an n channel transistor 511, whereby a potential difference is produced between the gate of p channel transistor 551 and the ground according to the amount of the current flowing therein. An equivalent potential is generated between the gate of p channel transistor 552 and the ground. In this case, p channel transistor 552 is made different from p channel transistor 551 in that a threshold value of p channel transistor 552 is smaller than that of p channel transistor 551, in that a channel width of p channel transistor 552 is larger than that of p channel transistor 551, or the like. Accordingly, a potential between the gate and the source of p channel transistor 552 is smaller than that of n channel transistor 511. This appears as a potential difference between p channel transistors 551 and 552. Current is obtained by dividing this potential difference by resistance R26.

In this case, resistance R26 may be a pure resistance component, or may be a parasitic resistance using a channel component of a transistor, as described in conjunction with FIG. 31. In addition, current generated can have appropriate temperature characteristics by appropriately combining temperature characteristics of a potential difference between the gate and the source of p channel transistor 551 and p channel transistor 552 with temperature characteristics of resistance R26.

In the structure shown in FIG. 48, a current mirror circuit need not be inserted between reference current generating circuits, so that the number of circuit stages required to obtain final constant current can be reduced. Accordingly, variation in constant current due to amplification of error between devices can be suppressed. In addition, the arbitrary number of constant current circuits can be connected, and the larger the number of constant current circuits is, the more the voltage dependency of constant current can be suppressed.

Figure 49:
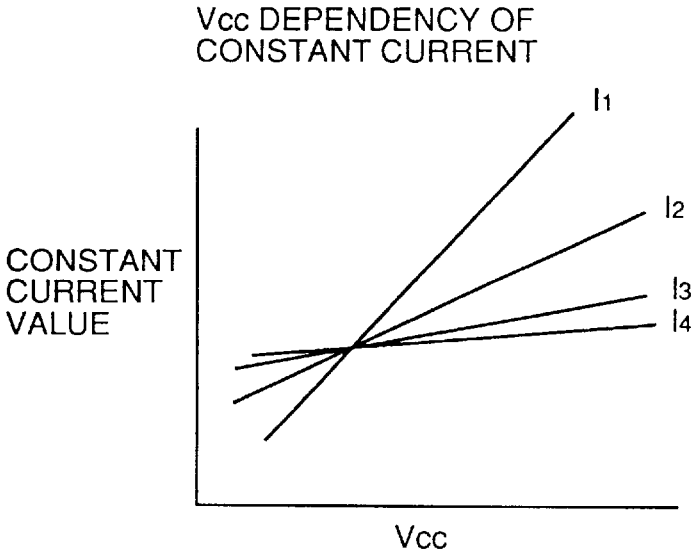
FIG. 49 is a diagram showing voltage dependency characteristics of constant current in the constant current generating circuit shown in FIG. 48.

FIG. 49 is a diagram showing voltage dependency characteristics of constant current in the constant current circuit shown in FIG. 48. As can be seen from FIG. 49, respective voltage dependencies of current $I_1$ flowing in n channel transistor 511, current $I_2$ flowing in n channel transistor 512, and current $I_3$ flowing in p channel transistor 552 are apparently reduced.

Figure 50:
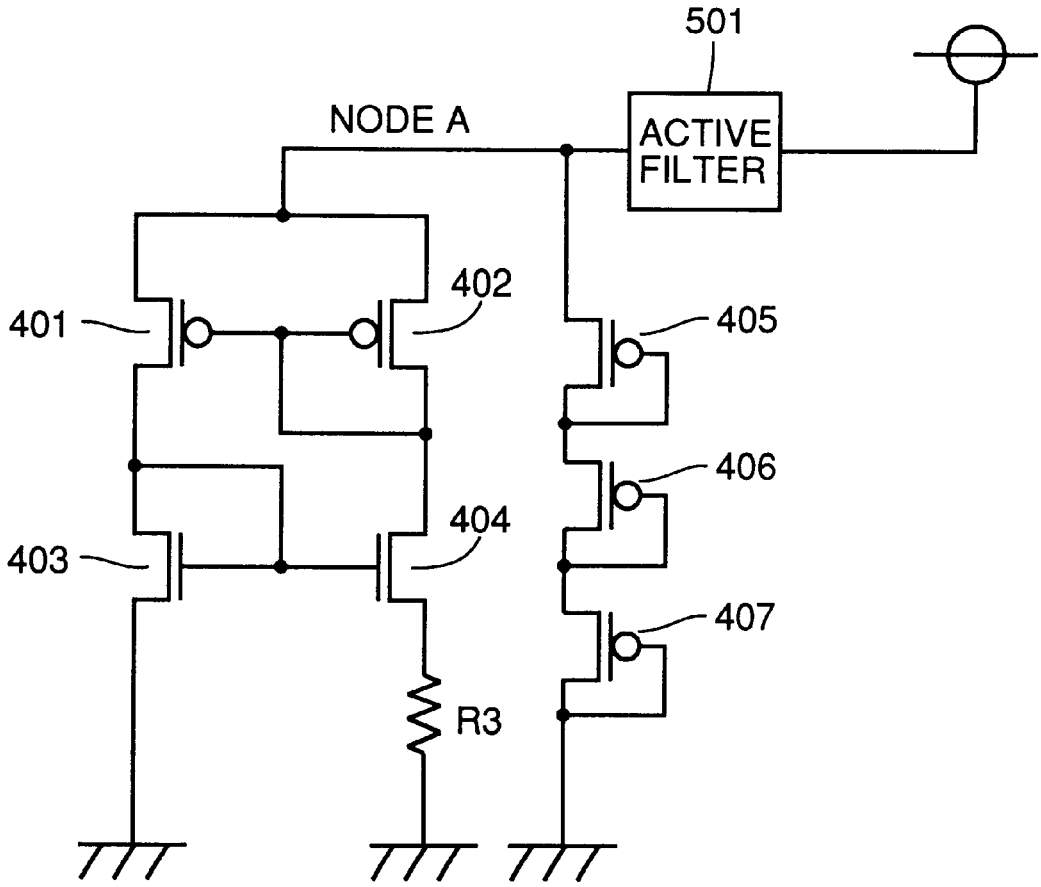
FIG. 50 is a circuit diagram showing another example of a power supply stabilization circuit.

FIG. 50 is a circuit diagram showing another example of the power supply stabilization circuit. The example shown in FIG. 50 is an improvement of the power supply stabilization circuit shown in FIG. 26. More specifically, active filter 501 shown in FIG. 28 described above is connected to a node A on the side of the power supply of a constant current circuit constituted by p channel transistors 401 and 402, n channel transistors 403 and 404 and a resistance R3, and diode-connected p channel transistors 405 to 407 are connected between node A and the ground.

In the power supply stabilization circuit shown in FIG. 50, the power supply voltage of the constant current circuit is determined by active filter 501, while each of p channel transistors 405 to 407 is diode-connected on the side of the constant current circuit, and therefore, the power supply stabilization circuit is stable with current flowing in the diode-connection with a potential difference between the ground and a voltage to be generated by active filter 501. In this case, since the constant current circuit operates with a voltage twice a threshold voltage of a transistor, three p channel transistors 405 to 407 are diode-connected in order to produce some margin for that voltage.

If the power supply noise is removed by active filter 501, the operation of the constant current circuit will not change. However, if noise which has not been removed by active filter 501 is transmitted, a voltage on both ends of the diode-connection is increased and ability to apply current is improved, thereby serving to extract positive noise to the ground. On the other hand, if negative noise is transmitted, a voltage on both ends of the diode-connection is reduced and the ability to apply current is degraded, thereby serving to pull up node A to the positive direction with respect to the negative noise. During these operations, propagation of noise and time for response of the diode-connection circuit structure to the noise will be at a sufficiently high speed when taking the fact that the diode-connection operates in a saturated region into consideration.

Figure 51:
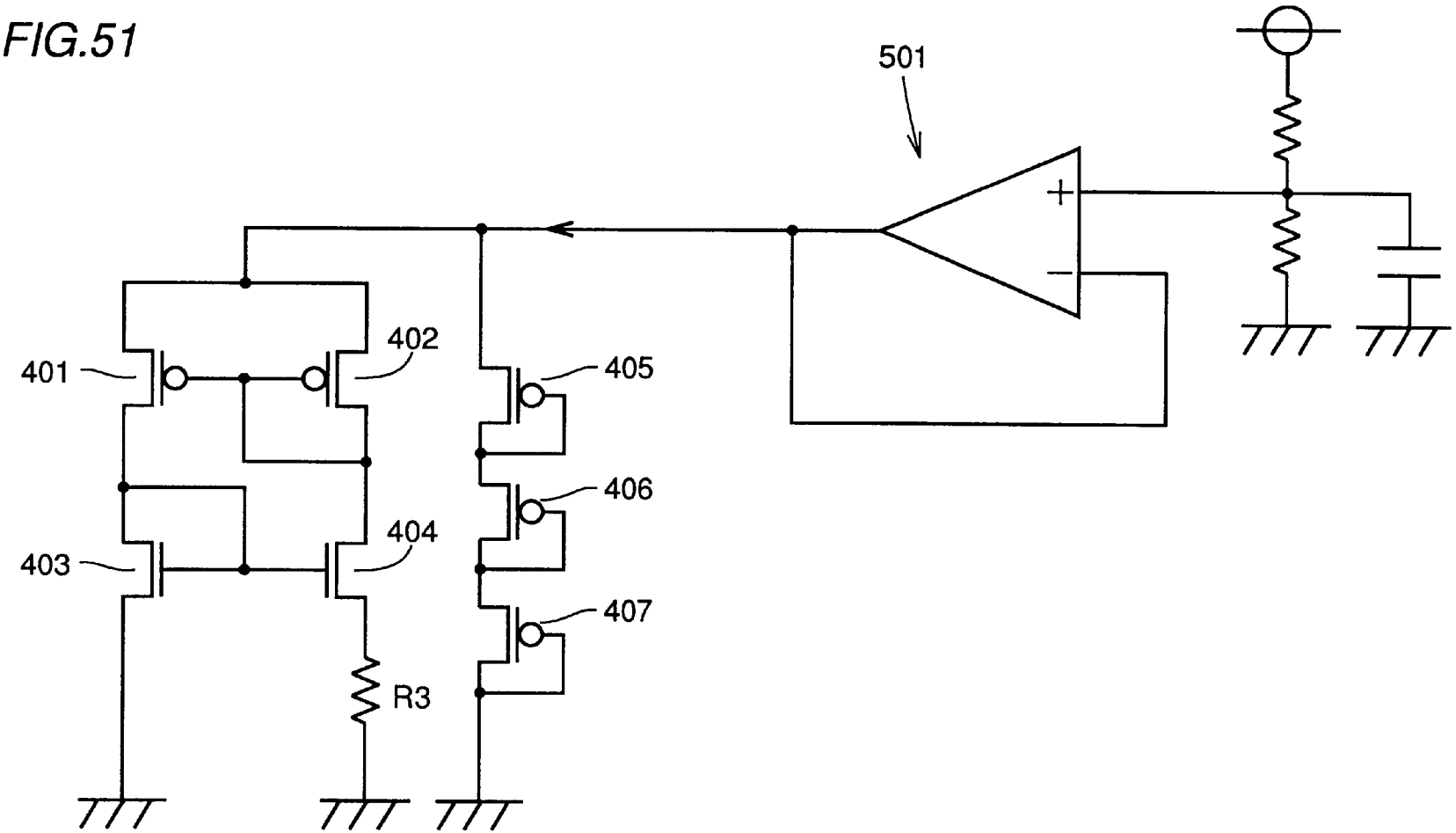
FIG. 51 is a specific circuit diagram of an active filter shown in FIG. 50.

FIG. 51 is a specific circuit diagram of the active filter shown in FIG. 50, and the operation thereof is the same as that of FIG. 50, and therefore, description thereof will not be repeated.

Figure 52:
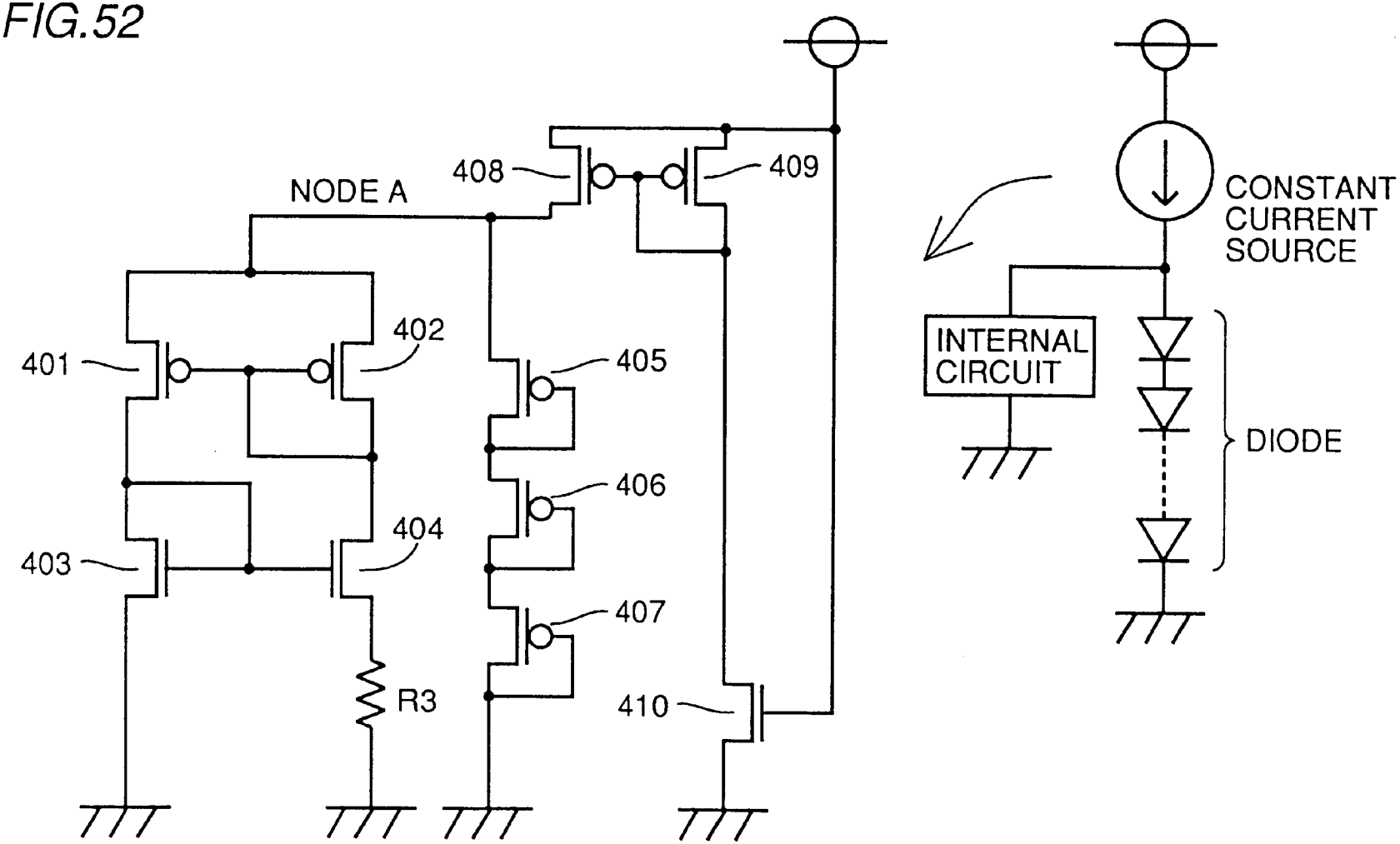
FIG. 52 is a circuit diagram showing a further example of the supply stabilization circuit.

FIG. 52 is a circuit diagram showing a further example of the power supply stabilization circuit. In the power supply stabilization circuit shown in FIG. 52, a current source constituted by p channel transistors 408 and 409 and an n channel transistor 410 is provided instead of active filter 501 of FIG. 50, and current to be supplied to a constant current circuit, which is an internal circuit, is determined by this current source. Current from the current source flows into p channel transistors 405 to 407 to generate a voltage, and this voltage is applied to a node A. In this example, power supply noise is removed in the current source. However, if noise which has not been removed by the current source is transmitted, a current path of the diode-connection absorbs the noise as described in connection with FIG. 50.

Figure 53:
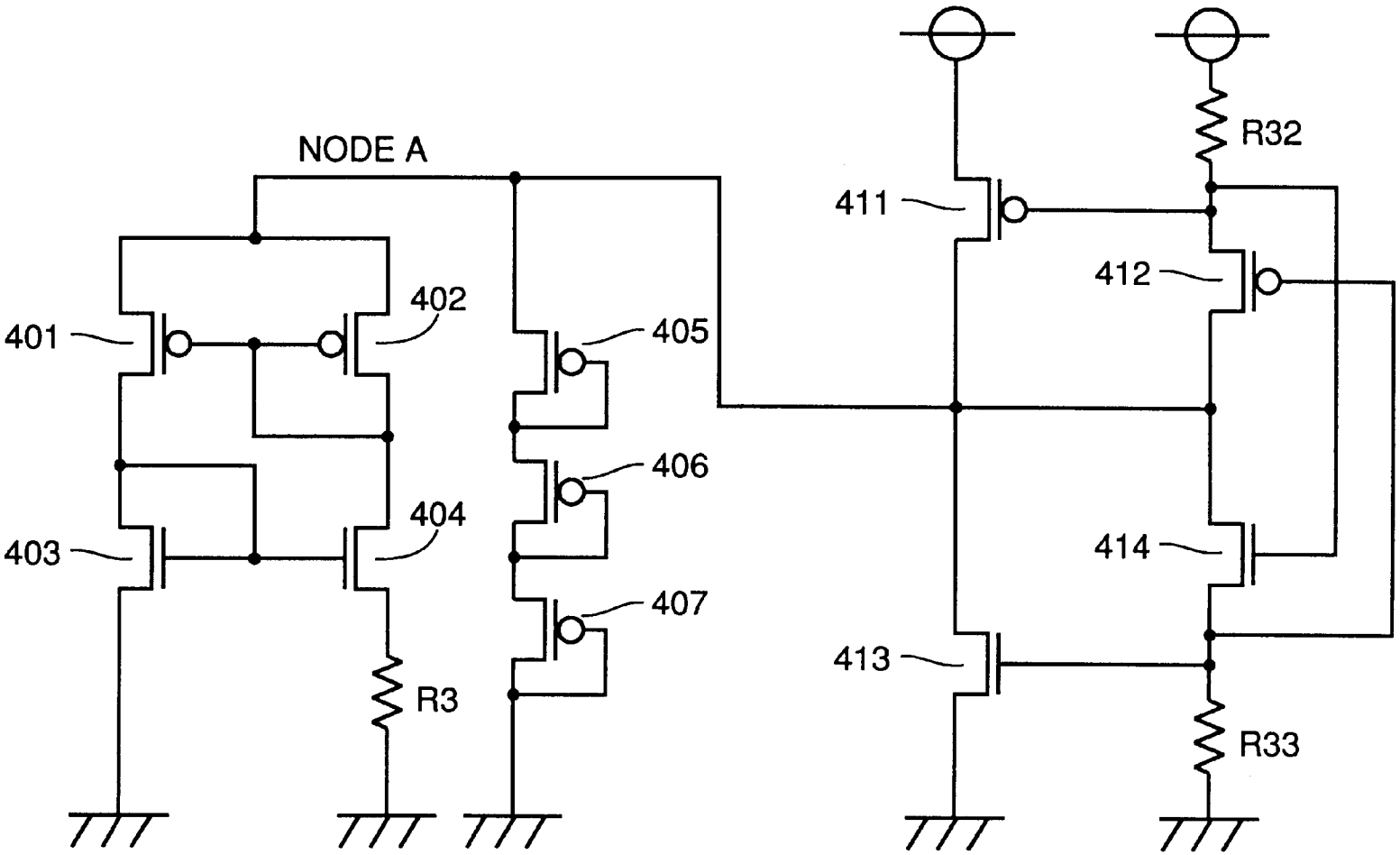
FIG. 53 is a circuit diagram showing a power supply stabilization circuit in which a constant current source is replaced with another circuit.

FIG. 53 is a circuit diagram showing a power supply stabilization circuit in which the current source is replaced with another circuit. A current source shown in FIG. 53 is constituted by p channel transistors 411 and 412, n channel transistors 413 and 414, and resistances R32 and R33. A series circuit of p channel transistor 411 and n channel transistor 413 is connected between a power supply potential and the ground, and the connection point therebetween is connected to a node A. In addition, resistance R32, p channel transistor 412, n channel transistor 414 and resistance R33 are connected in series between the power supply potential and the ground. Furthermore, the connection point between p channel transistor 412 and n channel transistor 414 is connected to node A. The gate of p channel transistor 411 and the gate of n channel transistor 414 are connected to the connection point between resistance R32 and the source of p channel transistor 412. The gate of n channel transistor 413 and the gate of p channel transistor 412 are connected to the connection point between the source of n channel transistor 414 and resistance R33.

Current of the current source shown in FIG. 53 is determined by respective values of resistance R33 and a voltage between the gate and the source of n channel transistor 413. More specifically, if current flows into the circuit, voltage is generated between the gate and the source of n channel transistor 413, and this voltage is generated as a voltage at both ends of resistance R33. Accordingly, current flowing into the circuit has a value obtained by dividing the voltage between the gate and the source of n channel transistor 413 by the value of resistance R33. The n channel transistor 414 serves to reduce an electric field between node A and resistance R33. In this circuit, similar circuit is located also on the side of the power supply, and therefore, there are constant current flowing from the power supply and current flowing out from node A in the entire circuit, and a voltage of an internal circuit is determined by the fact that excess current flows into the diode-connection of p channel transistors 405 to 407. Since a voltage is generated with current to be supplied from the current source flowing into the diode-connection, the power supply stabilization circuit is stable. The operation in the case where power supply noise is introduced and is not removed by the current source is the same as that of FIGS. 51 and 52 described above.

Figure 54:
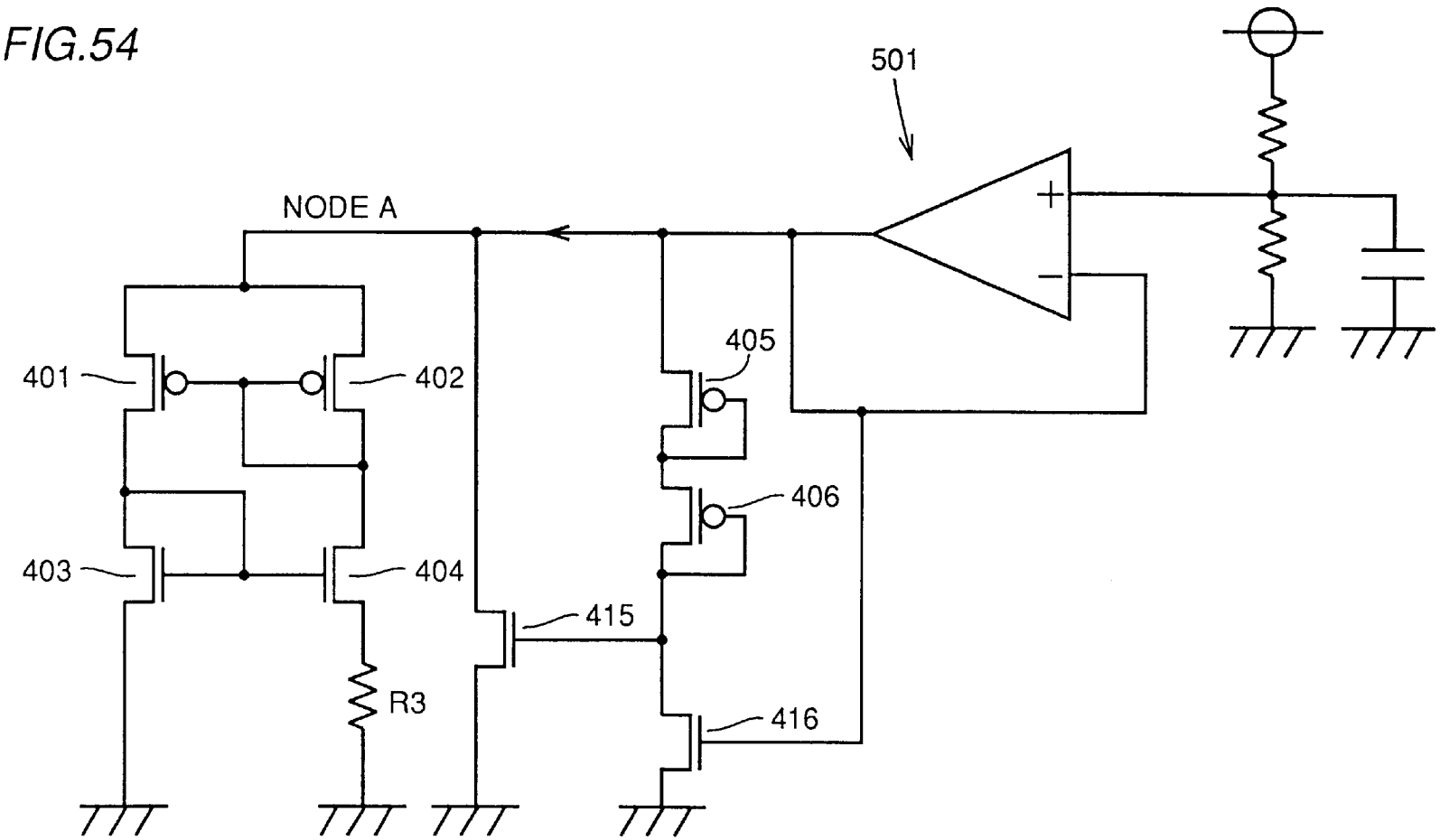
FIG. 54 is a circuit diagram showing a modification of the power supply stabilizing circuit shown in FIG. 51.

FIG. 54 is a diagram showing a modification of the power supply stabilization circuit shown in FIG. 51. An n channel transistor 416 is provided instead of p channel transistor 407 shown in FIG. 51, and an output of an active filter 501 is applied to the gate of n channel transistor 416. In addition, an n channel transistor 415 is connected between a node A and the ground, and has its gate connected to the drain of n channel transistor 416. The n channel transistor 416 is used as a resistance. If a potential on node A is reduced by noise, a resistance value of n channel transistor 416 is increased, and current determined by a voltage between the gate and the source of n channel transistor 415 and a resistance value of n channel transistor 416 is reduced, so that the reduced potential on node A is pulled up. In the power supply stabilization circuit shown in FIG. 54, a potential on node A can be determined by diode-connected p channel transistors 405 and 406, a resistance value of n channel transistor 416, and a voltage between the gate and the source of n channel transistor 415, even if there is no active filter 501.

Figure 55:
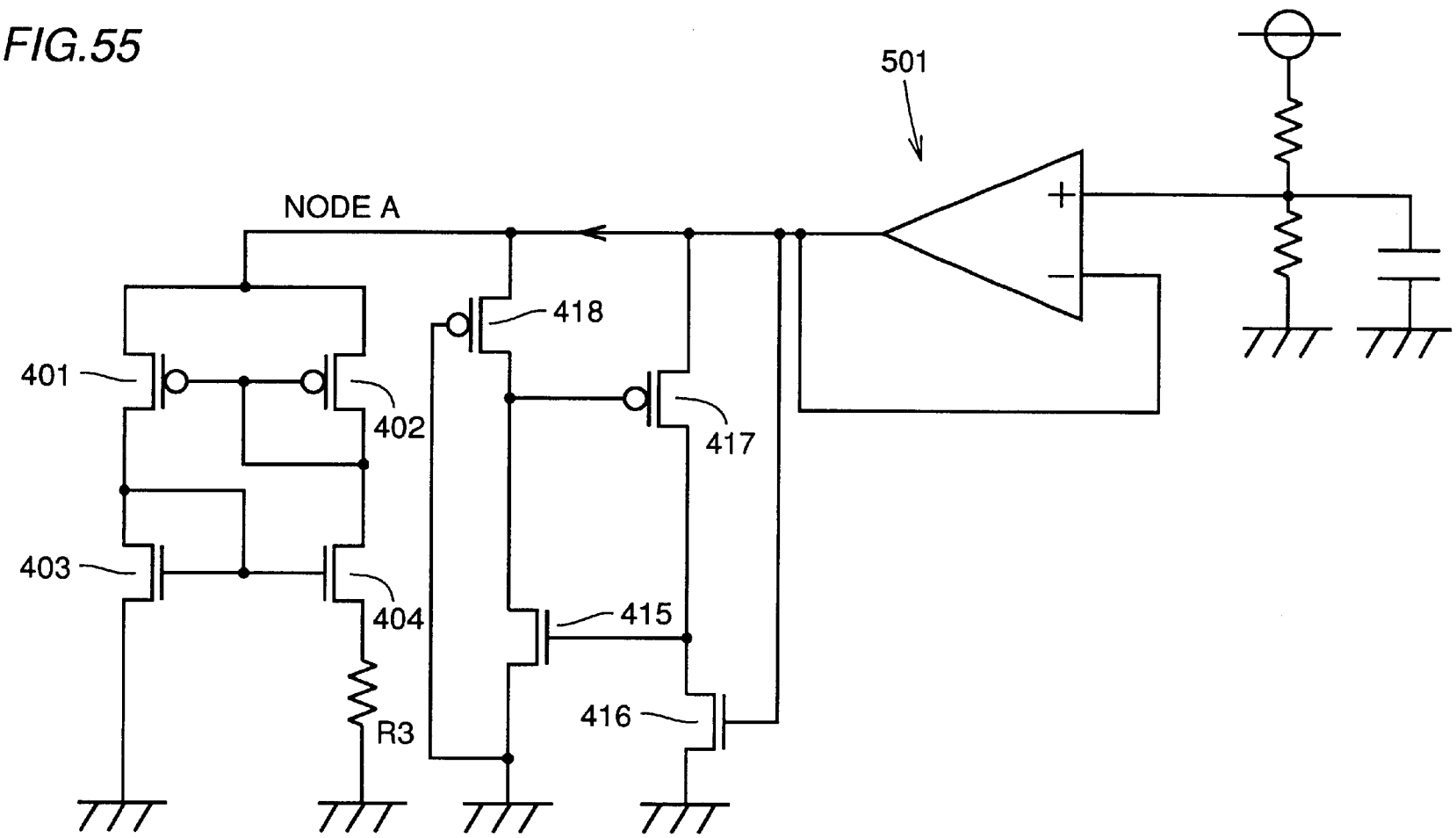
FIG. 55 is a diagram showing a modification of the power supply stabilizing circuit shown in FIG. 54.

FIG. 55 is a circuit diagram showing a modification of the power supply stabilization circuit shown in FIG. 54. In FIG. 55, a series circuit of a p channel transistor 417 and an n channel transistor 416 and a series circuit of a p channel transistor 418 and an n channel transistor 415 are connected between a node A and the ground. Each of n channel transistor 416 and p channel transistor 418 acts as a resistance, and current is determined by a potential between the gate and the source of n channel transistor 415 and a resistance value of n channel transistor 416 and by a potential between the gate and the source of p channel transistor 417 and a resistance value of p channel transistor 418.

As has been described above, in a temperature dependent circuit and a current generating circuit in accordance with the embodiments of the present invention, small current is extracted by dividing constant current, current having temperature dependency is produced from the constant current, and the small current and the current having temperature dependency are added to be output, and therefore, current having temperature dependency can be provided.

In an inverter in accordance with the embodiment of the present invention, transistors are connected to the sides of first and second power supplies of inverter means having two gates inputs, respectively, a current signal resulting from adding small current obtained by dividing constant current and current having temperature dependency is applied to the gate of each transistor, and therefore, an output can be prevented from being in a floating state.

Furthermore, in an oscillation circuit in accordance with the embodiment of the present invention, a first clock signal is applied to one gate of inverter means having two gate inputs, a second clock signal is applied to the other gate input, transistors are connected to the sides of first and second power supplies of each inverter means, respectively, and a current signal resulting from adding small current obtained by dividing constant current and current having a temperature dependency is applied to these transistors, whereby an oscillation frequency determined by current can be increased at a high temperature. Therefore, if the oscillation circuit is used for a timer for self refresh of a DRAM, for example, an oscillation frequency which realizes a refresh interval adapted to refresh characteristic of a memory cell can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circuit for generating a current having temperature dependency, comprising:

current providing means for providing current based on generated constant current converted in accordance with a preset fixed ratio;

temperature dependent current producing means for producing current having temperature dependency from said constant current; and adding means for adding current from said current providing means and current having temperature dependency from said temperature dependent current producing means.

2. The circuit for generating current having temperature dependency according to claim 1, wherein said temperature dependent current producing means includes a reference current generating circuit having transistors responsive to said constant current;

a current mirror circuit having transistors, wherein input electrodes of the transistors of said current mirror circuit are connected in common, reference current is supplied from one transistor of said reference current generating circuit to a first electrode and the input electrode of one transistor of said current mirror circuit, and reference current is supplied from another transistor of said reference current generating circuit to a first electrode of another transistor of said current mirror circuit; and two resistances respectively connected between a first power supply potential line and respective second electrodes of the transistors of said current mirror circuit, and having different temperature characteristics.

3. The circuit for generating current having temperature dependency according to claim 2, wherein said temperature dependent current producing means includes a plurality of transistors connected in parallel to each other for receiving and amplifying current having temperature dependency output from said current mirror circuit.

4. The circuit for generating current having temperature dependency according to claim 1, wherein said current providing means includes a transistor for outputting reference current in accordance with said constant current, and a plurality of transistors connected in parallel to each other for dividing the reference current from said transistor.

5. The circuit for generating current having temperature dependency according to claim 1, further comprising:

constant current generating means configured for generating said constant current and coupled to said current providing means and said temperature dependent current producing means.

6. A temperature dependent circuit for generating output current that varies in accordance with variation of temperature, comprising:

a current mirror circuit in which respective input electrodes of one transistor and another transistor are connected in common, current is supplied to a first electrode and said input electrode of said one transistor, and current is supplied to a first electrode of said another transistor; and resistive elements with different temperature characteristics respectively connected between a first power supply potential line and respective second electrodes of said one transistor and said another transistor of said current mirror circuit, for generating the output current that increases with increase in temperature;

wherein said output current is produced at an output of said another transistor, said resistive elements comprise a first resistive element associated with said one transistor, and a second resistive element associated with said another transistor, and temperature dependency of said second resistive element is greater than temperature dependency of said first resistive element.

7. The temperature dependent circuit in accordance with claim 6, wherein said resistive elements are transistors having different temperature characteristics of respective resistance values at the time when respective resistance elements are rendered conductive.

8. A temperature dependent circuit for generating output current that varies in accordance with variation of temperature comprising:

a current mirror circuit in which respective input electrodes of one transistor and another transistor are connected in common, current is supplied to a first electrode and said input electrode of said one transistor, and current is supplied to a first electrode of said another transistor;

resistive elements with different temperature characteristics respectively connected between a first power supply potential line and respective second electrodes of said one transistor and said another transistor of said current mirror circuit, for generating the output current that varies in accordance with variation of temperature;

reference potential generating means for generating a reference potential; and internal potential generating means responsive to an output of said current mirror circuit for generating an internal potential; wherein said resistive elements include a first transistor connected in series to said one transistor of said current mirror circuit and having an input electrode to which the reference potential is applied from said reference potential generating means, and a second transistor connected in series to said another transistor of said current mirror circuit and responsive to the internal potential from said internal potential generating means.

9. The temperature dependent circuit in accordance with claim 8, wherein said internal potential generating means generates the internal potential higher than a power supply voltage or lower than a ground potential.

10. The temperature dependent circuit in accordance with claim 9, further comprising:

voltage dividing means for dividing the potential generated by said internal potential generating means and applying the resultant potential to an input electrode of said second transistor.

11. The temperature dependent circuit in accordance with claim 10, further comprising;

amplifying means for amplifying the output of said current mirror circuit and applying an activation signal to said internal potential generating means.

* * * * *